US012523051B2

(12) United States Patent
Medina

(10) Patent No.: US 12,523,051 B2
(45) Date of Patent: Jan. 13, 2026

(54) WALL REPAIR KIT

(71) Applicant: Gustavo Medina, Sylmar, CA (US)

(72) Inventor: Gustavo Medina, Sylmar, CA (US)

( * ) Notice: Subject to any disclaimer, the term of this patent is extended or adjusted under 35 U.S.C. 154(b) by 0 days.

(21) Appl. No.: 18/467,448

(22) Filed: Sep. 14, 2023

(65) Prior Publication Data

US 2024/0003150 A1 Jan. 4, 2024

Related U.S. Application Data

(63) Continuation of application No. 17/468,706, filed on Sep. 8, 2021, now Pat. No. 11,795,714.

(30) Foreign Application Priority Data

Sep. 8, 2020 (GB) ..... 2014113
Sep. 7, 2021 (GB) ..... 2112730

(51) Int. Cl.
*E04G 23/02* (2006.01)

(52) U.S. Cl.
CPC ..... *E04G 23/0207* (2013.01); *E04G 23/0203* (2013.01)

(58) Field of Classification Search
CPC ..... E04G 23/0207; E04G 23/0203
See application file for complete search history.

(56) References Cited

U.S. PATENT DOCUMENTS 4,354,332 A * 10/1982 Lentz ..... E04G 23/0207 52/514
5,033,949 A * 7/1991 Jewett ..... E04G 23/0203 52/514
7,121,054 B2 * 10/2006 Shock ..... E04G 23/0207 52/514.5

(Continued)

FOREIGN PATENT DOCUMENTS

WO WO-2010083824 A1 * 7/2010 ..... F16B 11/006

OTHER PUBLICATIONS

Translation of WO 2010/083824 (Year: 2010).*

*Primary Examiner* — Andrew J Triggs
(74) *Attorney, Agent, or Firm* — Ergenzinger IP Law; Edward R Ergenzinger

(57) ABSTRACT

According to one aspect of what is invented, a wall repair kit 10 comprises a back blocking element 12, for blocking a hole 13 in a wall 15, behind the hole in the wall; and a front blocking element 14, for blocking the hole in the wall, in front of the hole in the wall. Embodiments are disclosed that comprise a connecting element 18, to connect the front blocking element and the back blocking element. Embodiments are disclosed wherein the front blocking element comprises an input aperture 16, to facilitate inputting a filler agent into the hole in the wall, through the front blocking element. Embodiments are disclosed that are operable with the connecting element travelling through the input aperture, to connect the back blocking element and the front blocking element. Embodiments are disclosed where a container, for containing filler agent, is removably attachable to the front blocking element. According to another aspect, a blocking element, for blocking a hole in a wall, comprises a blocking body; wherein the blocking body comprises a break arrangement, configured for breaking, to facilitate breaking off a portion of the blocking body.

17 Claims, 8 Drawing Sheets

(56) References Cited

U.S. PATENT DOCUMENTS

| | | | | |
|---|---|---|---|---|
| 8,959,873 | B2 * | 2/2015 | Longhenry | E04B 1/66 264/46.7 |
| 9,637,940 | B2 * | 5/2017 | Naylor | E04G 23/0203 |
| 10,041,263 | B2 * | 8/2018 | Vicious | E04G 23/0207 |
| 11,795,714 | B2 * | 10/2023 | Medina | E04G 23/0207 |
| 2024/0003150 | A1 * | 1/2024 | Medina | E04G 23/0207 |

* cited by examiner

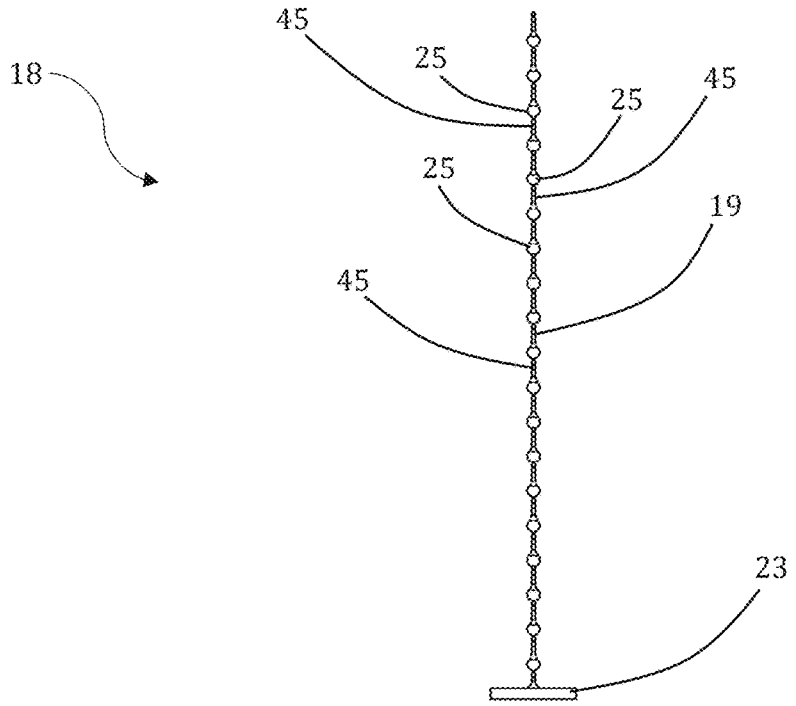
Fig. 5
Fig. 6
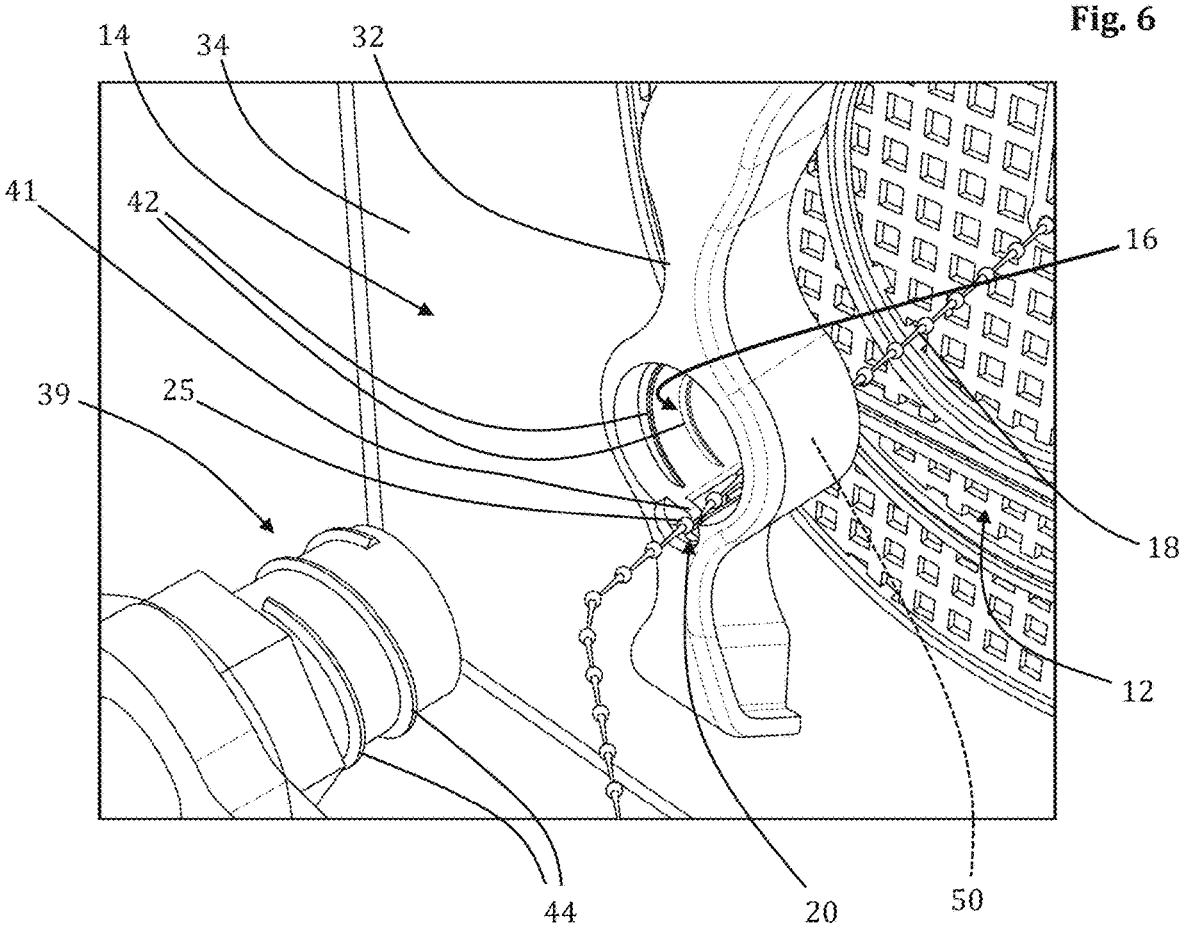

WALL REPAIR KIT

REFERENCES TO RELATED APPLICATIONS

The following application(s) are included in the chain of priority of the present application: US Ser. No. 17/468,706, (filed Sep. 8, 2021), (now U.S. Pat. No. 11,795,714); GB2014113.1, (filed Sep. 8, 2020); and GB2112730.3, (filed Sep. 7, 2021). The disclosure(s) of these application(s) are herein incorporated by reference, in their entirety The present invention relates to a wall repair kit, for repairing a hole in a wall.

Terms/Definitions

'Arrangement':

The term arrangement is a technical term which means a feature, or combination of features, (usually with a given purpose). For example, a 'measuring arrangement' is a feature or features, to facilitate measuring. A 'holding arrangement' is a feature or features, to facilitate holding.

'Feature':

The term 'feature' is a broad term that includes within its scope any feature under the Sun. A feature may, for example, be an element, body, member, or may even be an aperture (eg opening/hole/gap or the such like). Thus the term 'holding feature' includes within its scope, for example, any element, body, member, or even aperture, to facilitate holding. A 'feature' may also be a 'part' of a broader feature; for example, if a part of an invention is disclosed/claimed as comprising a 'padding feature', this does not limit the padding feature to being a separate feature that is added to the invention (eg a sponge element, adhered to the invention); the invention, for example, may have a part made of sponge, or have an inner sponge (or soft) layer—in such a case, if that part of the invention is clearly of a material/nature that provides padding, then this falls within a scope of what is defined in the present application as a 'padding feature'.

'Substantially':

It is known, to those with skill in the art of patenting, that the word 'substantially' can, in some instances, be used to broaden a term. It should be stated that, in the present application, use of the word 'substantially' with a term, to define a (characterizing) feature(s), gets all the benefit (ie the benefit of any broadening) afforded by use of the word 'substantially', and also includes within its scope the feature (s) being that term exactly, (without broadening). For example, if two features are described/defined in the present application as being 'substantially parallel', then that includes, within its scope, the features being 'close' to parallel (in so far as the word 'substantially' is deemed to broaden the term 'parallel'), and also includes within its scope the features being 'exactly' parallel).

'Velcro®' and 'Velcro®-Type':

It will be known that the term 'Velcro® ' has become synonymous (in layman's terms) for hook-and-hook, hook-and-loop, loop-and-loop, and all such similar attachment solutions. In the present application, where the term 'Velcro® ' is used, in includes within its scope all of the above, and whatever solutions would be considered to be, from a layman's point of view, 'Velcro® '. Thus it is a broad term. The term 'Velcro®', or 'Velcro®-type', may be used, (in the disclosure generally, and may also be used in a claim(s)), and is thus a broad term which includes within its scope any solutions/features which would be considered, from a layman's point of view, to be 'Velcro® '.

'Attached' and 'Connected':

If a feature (or two features) are defined in a claim as being attached, that would include within its scope the feature (or two features) being permanently attached, (of course), and would also include within its scope the feature (or two features) being removably attachable, (because, if removably attachable, the feature (or two features) can be attached, and therefore, when attached, would be within a scope of being 'attached'). Furthermore, the feature (or two features) being defined in a claim as being 'attached' would also include within its scope the feature that is defined as being 'attached' being formed as one part with a portion or a whole of the other feature it is defined as being 'attached' to. For example, if a table leg is defined in a claim as being 'attached' to a table top, that would include within its scope the table leg being formed as one part with a whole of the table top (eg if the table leg and table top were formed as one piece of plastic, for example) and would also include within its scope the table leg being formed as one part with a portion (rather than a whole) of the table top (eg if the table top was formed of more than one part, and the table leg was formed as one part with a part of the table top, but not a whole of it). (It would also include within its scope a portion (rather than a whole) of the feature that is defined as being 'attached' being formed as one part with a portion (or a whole) of the other feature it is defined as being 'attached' to. Thus if the table leg had a separate top half and bottom half, for example, (that are attached together, in use), an embodiment where the top half of the leg is formed as one part with a portion (or a whole) of the table top would also be within a scope of the table leg being 'attached' to the table top). It should be noted, some (few) patent offices require structural connection/relationship terms (in claims), to define structural connection/relationship between features of the claim. With this in mind, (and if it should be required, although it often is not), the term 'connected', if used in a claim, is a broad term, which includes within its scope direct connection, and also includes within its scope indirect connection. ('Direct' connection would be where two features, for example, are directly connected to each other (eg an arm is 'directly' connected to a shoulder). 'Indirect' connection would be where two features, for example, are connected, but via intermediate feature(s) (eg a person's foot is 'connected' to their head, but 'indirectly', (via their leg, abdomen, torso, etc, which are 'intermediate features')). Where the term 'connected' is used in a claim, it includes within its scope 'direct' connection, and also includes within its scope 'indirect' connection. The term may be used in a claim, (and is deemed supported), whether 'direct' and/or 'indirect' connection embodiment(s) is (/are) disclosed in the present application, and, as stated, includes within its scope 'direct' connection, and also includes within its scope 'indirect' connection. Furthermore, if a feature(s) is (/are) defined as being 'connected', that would include within its scope the (or any—ie more than one of the said) feature(s) being removably attachable, if, when attached, the feature(s) is (/are) in a state of being 'connected', (directly or indirectly). Thus if a first feature is defined as being 'connected' to a second feature, it would include within its scope the first feature and/or the second feature being removably attachable, if, when attached, the first feature is connected to the second feature, (directly or indirectly). Furthermore, of course, (and similarly to the word 'attached'), if a feature (or two features) are defined in a claim as being 'connected' it would also include within its scope the feature that is defined as being 'connected' being formed as one part with a portion or a whole of the other feature it is defined as being 'connected' to.

'The or Each' and 'the or Any':

The term 'the or each' (either in disclosure and/or a claim) can refer back to a single feature/thing, and/or can refer back to a plurality of features/things. When the term is read as referring back to a plurality of features/things, it should be taken as meaning, and including within its scope, 'at least one, or more, or all (ie each)' of the said features/things. Thus, to give an example, if a square is referred to/disclosed that has four corners, if the term 'the or each corner' is used, it includes within its scope 'one of the corners, (or two, or three, or all of the corners)'.

When any one feature/thing is afforded any feature(s)/definition in the present application, it is taken as read that, where a plurality of the said feature/thing is provided, 'the or each' said feature/thing may be provided/claimed comprising the said feature(s)/definition (ie at least one, or more or all). Similarly, wherever a plurality of the said feature/thing are afforded any feature(s)/definition, it is taken as read that 'the or each' said feature/thing may be provided/claimed comprising the feature(s)/definition (ie at least one, or more, or all of the plurality), and/or that even just one said feature/thing may be provided/claimed comprising the feature(s)/definition in an embodiment/claim wherein an invention is defined as comprising 'a' (eg singular) said feature/thing.

(The term 'the or any' may be used (again including within its scope, 'at least one, or more, or all (ie each)', instead of the term 'the or each').

'User Means':

It will be well known that, in certain patenting territories, (for example, the United States), use of the term 'means' or 'means for', if used in a (granted) patent claim, can be seen as a limiting term, limited to only giving the applicant/proprietor of the patent protection of means that are disclosed in the granted patent, or 'equivalent' means. This is not the case with the term 'user means' as it is used in the present application. The term 'user means' is a very broad term that is used in the field of product design/user-interface, and defines any means under the sun, provided for a user, for whatever action/result the user means is provided for. For example—a 'user means' to turn on a television could be provided by way of an ON/OFF button on the television. But it could also be provided by a button on a remote control which turns on the television when pressed. Both of these would fall (in the technical field of product design/user-interface) under the scope of the term 'user means' to turn on the television. Similarly, with certain inventions/products, a 'user means' may be provided to 'initiate' an action, for example. Thus, in the present application, a claim that defines an invention which comprises a 'user means' for [a particular action/result] is not subject to any 'means for' limitations that certain patent office territories (such as the United States) may appropriate to the term 'means for', but should be read as (and given protection for, if granted) any means under the sun, provided for a user, for [that particular action/result defined]. 'User means' is a technical term in the field of product design/user-interface.

Reference to Multiple Similar Elements in Plural

In the present application, there may be provided/numbered features wherein the same primary number is used, with a suffix. For example, a first side of the/an invention may be numbered 600', and a second side of the/an invention numbered 600". In any such case, (or where any other suffix is used, such as 'L' and 'R' to denote 'left' and 'right', or 'a' and 'b', for example), when such features are referred to together (ie 'the sides'), the plural may be numbered/referred to with the primary number (without the suffix). Thus the first side 600' (or 600*a*, for example) and second side 600" (or 600*b*, for example) may, for example, be referred to simply as 'the sides 600'. Furthermore, if a side is referred to (not specifying which one of the sides), the primary number (ie 600, for example) may be used, without any suffix.

BACKGROUND

It's not uncommon for damage to occur to walls (eg a drywall, for example), thus creating a hole in the wall. This can occur from events as simple, for example, as a door being opened with too much force, and a doorknob making a hole in the wall. Whether a hole is caused in this way, or any other way, the hole needs to be repaired.

However, repairing a hole in the wall can be cumbersome. For example, a standard repair, (of a drywall, for example), is to add a new cut/section of drywall, to repair the hole. However, to achieve this, an even larger hole tends to have to be made, (eg a square or cubic cut, for example). The new section of drywall is added, (often with multiple extra steps, to make sure it stays in place). (Even then, tape is often needed, and added over the gap between the perimeter of the added section, and the edge of the hole). Plaster then tends to be used, to finish the repair. This, along with all the steps required, tends to take quite a long time. It would be desirable if a more elegant solution was provided, to repair holes in walls.

SUMMARY

An invention(s) is defined by the accompanying claims, to which reference should now be made.

Examples of the present invention seek to provide a solution to any or all of the above problem(s) by providing, according to one aspect of what is invented: a wall repair kit, comprising: a back blocking element, for blocking a hole in a wall, behind the hole in the wall; a front blocking element, for blocking the hole in the wall, in front of the hole in the wall; and a connecting element, to connect the back blocking element and the front blocking element; wherein the front blocking element comprises an input aperture, to facilitate inputting a filler agent into the hole in the wall, through the front blocking element; wherein the wall repair kit is operable with the connecting element travelling through the input aperture of the front blocking element, to connect the front blocking element and the back blocking element.

(Note: The front blocking element may feasibly comprise more than one input aperture, to facilitate inputting a filler agent into the hole in the wall, through the front blocking element. If this is the case, if wall repair kit is operable with the connecting element travelling through any of the input apertures, then that is within a scope of the wall repair kit being 'operable with the connecting element travelling through the input aperture' and is within a scope of 'the connecting element travelling through the input aperture' (or the like)).

The connecting element travelling through the input aperture through which the filler agent is inputted creates an elegance of use, and design, which will become apparent.

Preferably the wall repair kit is operable with an output aperture, (out of which filler agent is outputted), of a filler agent container being received into the input aperture of the front blocking element, and the connecting element travelling through the aperture of the front blocking element, simultaneously.

Preferably, (when the front blocking element is in a blocking position, in front of the hole in the wall), the input aperture of the front blocking element is the only input aperture that the front blocking element has, through to the hole in the wall. (Most preferably, (when the front blocking element is in a blocking position, in front of the hole in the wall), the input aperture is the only aperture that the front blocking element has, through to the hole in the wall).

According to another aspect of what is invented, there is provided: a wall repair kit, comprising: a back blocking element, for blocking a hole in a wall, behind the hole in the wall; a front blocking element, for blocking the hole in the wall, in front of the hole in the wall; a filler agent, to fill the hole in the wall; and a container, to contain the filler agent; wherein the container is removably attachable to the front blocking element. (According to this aspect, the front blocking element may, or may not, comprise an input aperture(s), to facilitate inputting a filler agent into the hole in the wall, through the front blocking element).

Preferably, the front blocking element comprises an input aperture, to facilitate inputting the filler agent into the hole in the wall, through the front blocking element, and the container is removably attachable to the front blocking element, into a filling position, to facilitate outputting the filler agent out of the container, into the hole in the wall, through the input aperture of the front blocking element. This leads to an elegance of use that will become apparent.

According to another aspect of what is invented, there is provided: a blocking element, for blocking a hole in a wall, comprising: a blocking body, for blocking the hole in the wall; wherein the blocking body comprises a break arrangement, configured for breaking, to facilitate breaking off a portion of the blocking body, the portion being of a predetermined shape, determined by shape and position of the break arrangement. (As will be seen, this may be particularly useful, for a back blocking element, for blocking a hole in a wall, behind the hole in the wall).

The blocking element may comprise more than one said break arrangement.

Preferably there is a said break arrangement wherein the portion that the break arrangement facilitates breaking off comprises a whole of a perimeter of the blocking body. This allows for the blocking element to be made smaller, (by removing the removable portion), which may be useful, for using the blocking element for the repairing of smaller holes.

Preferably there is a said break arrangement wherein the portion that the break arrangement facilitates breaking off comprises a portion but not a whole of a perimeter of the blocking body. This may be useful, for example, for removing a side portion of the back blocking element, if, for example, a wall stud would otherwise get in the way, (and prevent the blocking element from being in position to block the hole in the wall successfully).

(According to this aspect, there may be provided a wall repair kit, comprising: a said blocking element, (comprising a said break arrangement), the blocking element being a back blocking element, for blocking the hole in the wall, behind the hole in the wall; and a front blocking element, for blocking the hole in the wall, in front of the hole in the wall).

According to another aspect of what is invented, there is provided: a wall repair kit, comprising: a back blocking element, for blocking a hole in a wall, behind the hole in the wall; a front blocking element, for blocking the hole in the wall, in front of the hole in the wall; and a connecting element, to connect the back blocking element and the front blocking element; wherein the front blocking element comprises: an aperture through which the connecting element travels, to facilitate connecting the front blocking element and the back blocking element; and a blocking arrangement, to block a portion of the connecting element, to hold the connecting element in a desired position.

Preferably, a portion or a whole of the blocking arrangement is provided within the aperture of the front blocking element, through which the connecting element travels. (According to this aspect, the 'aperture' of the front blocking element may, or may not, be an 'input aperture', to facilitate inputting a filler agent into the hole in the wall, through the front blocking element).

According to another aspect of what is invented, there is provided a wall repair kit, comprising: a back blocking element, for blocking a hole in a wall, behind the hole in the wall; and a front blocking element, for blocking the hole in the wall, in front of the hole in the wall.

According to another aspect of what is invented, there is provided a blocking element, for blocking a hole in a wall, comprising: a blocking body, for blocking the hole in the wall. (A front blocking element, for blocking a hole in a wall, in front of the hole in the wall, comprising: a blocking body, for blocking the hole in the wall, is an embodiment of this. A back blocking element, for blocking a hole in a wall, behind the hole in the wall, comprising: a blocking body, for blocking the hole in the wall, is an embodiment of this).

According to another aspect of what is invented, there is provided a blocking element, for blocking a hole in a wall, comprising: a blocking body, for blocking the hole in the wall, wherein a portion of the blocking element is removable. Thus broad definition is provided of a blocking element, for blocking a hole in a wall, comprising: a blocking body, for blocking the hole in the wall, wherein a portion of the blocking element is removable. The portion may comprise a whole of a perimeter of the blocking body. The portion may comprise a portion but not a whole of a perimeter of the blocking body. The blocking body may comprise a first removable portion; and a second removable portion. The blocking body may comprise a first removable portion; a second removable portion; and a third removable portion, (etc).

Note: Any of the aspects (of what is invented) may comprise/draw upon any of the feature(s) of any other aspect(s) of what is invented, and may draw upon any of the feature(s) and/or disclosure of the present application, as optional and/or preferable feature(s). Any aspect(s) (of what is invented) may comprise/draw upon any feature(s) of any other aspect(s) (of what is invented), whether the feature(s) be essential or preferable and/or optional to the other aspect(s) (of what is invented).

BRIEF DESCRIPTION OF THE DRAWINGS

Examples of the present invention will now be more particularly described, with reference to the accompanying drawings, by way of example only, in no way limiting a scope of the invention, in which:

FIG. 5 is a side view of an example connecting element;

FIG. 6 is a close-up view showing an example outputting portion of the example container close to being attached to the front blocking element, in a filling position, (in the example, by being screwed into an input aperture of the front blocking element), (black outline around the Figure simply denoting confines of the view shown);

Figure 1:
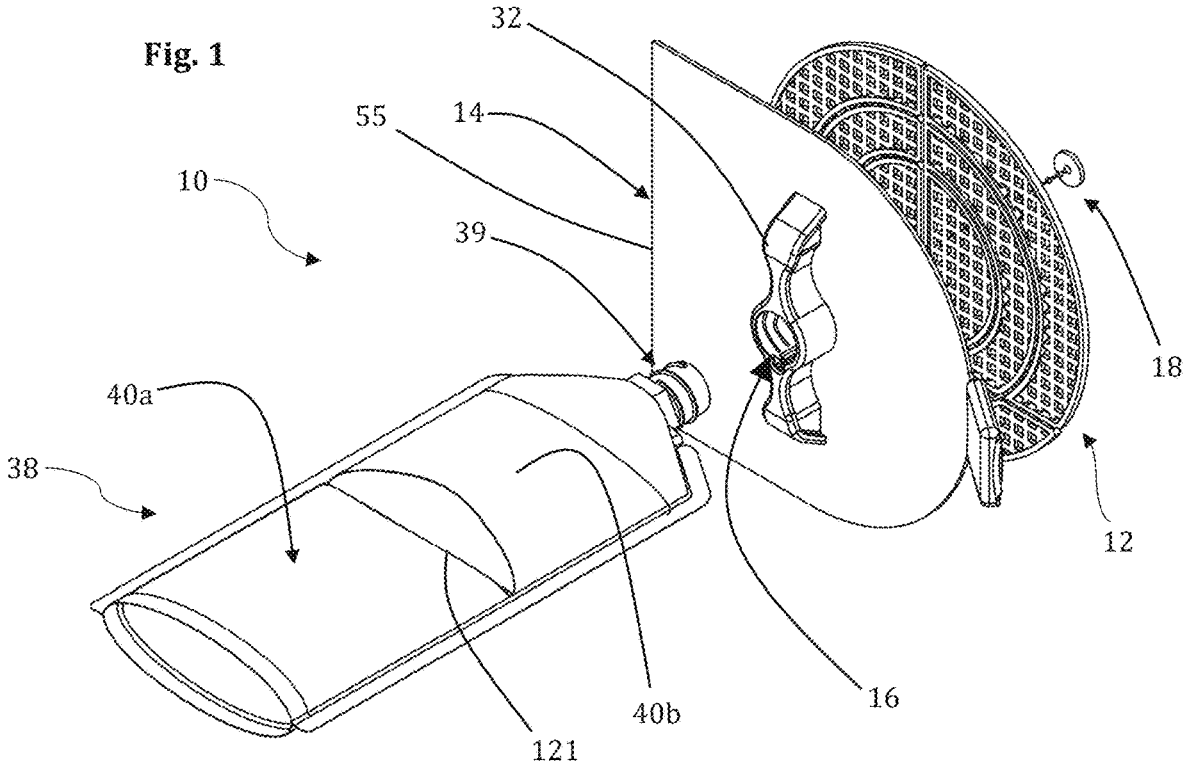
FIG. 1 is a perspective side view of a wall repair kit, showing features including a back blocking element, a front blocking element, and a filler agent container.

Note: At some patent offices, when claim(s) are allowed for patent, it is required that Figures that do not show all the feature(s) of the/an invention claimed (and/or that are not within a scope of what is claimed) are denoted as 'not being claimed' or 'not within a scope of what is claimed' (or words to that effect). Even in such case, it will be apparent that such Figure(s) may or do show feature(s) that are essential, or preferable and/or optional, to the/an invention claimed, which will be apparent, in light of the disclosure. Thus such Figure(s) (and/or disclosure related to such Figure(s) and/or embodiment(s)), should nevertheless be considered relevant to the/an invention claimed.

DETAILED DESCRIPTION

Referring to the drawings, there is shown a wall repair kit 10, comprising: a back blocking element 12, for blocking a hole in a wall, behind the hole 13 in the wall 15; and a front blocking element 14, for blocking the hole in the wall, in front of the hole 13 in the wall 15.

In all the example embodiments shown, the front blocking element 14 comprises an input aperture 16, to facilitate inputting filler agent 17 into the hole 13 in the wall 15, through the front blocking element. (In the example embodiment(s), with the front blocking element in use, (ie in a blocking position, blocking the hole in the wall in front of the hole in the wall), the front blocking element has only one aperture through to the hole in the wall. However, it should be stated, it is feasible embodiments may be provided wherein there are a plurality of apertures though to the hole in the wall. (There may thus, for example, feasibly be more than one input aperture 16 through to the hole in the wall, to facilitate inputting a filler agent into the hole in the wall, through the front blocking element). (It should also be stated, it is feasible aperture(s) could be provided, through to the hole in the wall, that are not for inputting filler agent into the hole in the wall. For example, it is feasible there could be one, or more than one, openable and closable aperture(s), for example, than can be opened, for example, to increase air engaging the filler agent, once it has been inputted into the hole in the wall. This may, for example, slightly accelerate drying time of the filler agent, for example. Thus various options and/or embodiments are possible).

Figure 4:
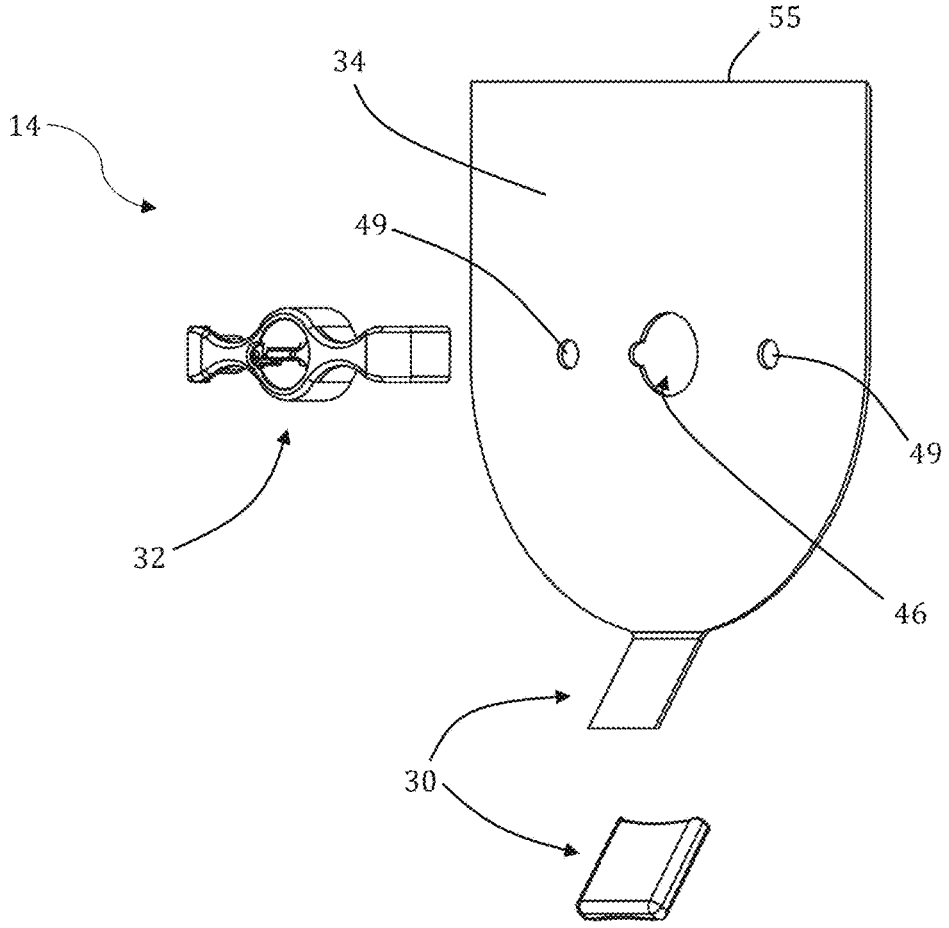
FIG. 4 is an exploded view of the example front blocking element.
Figure 7:
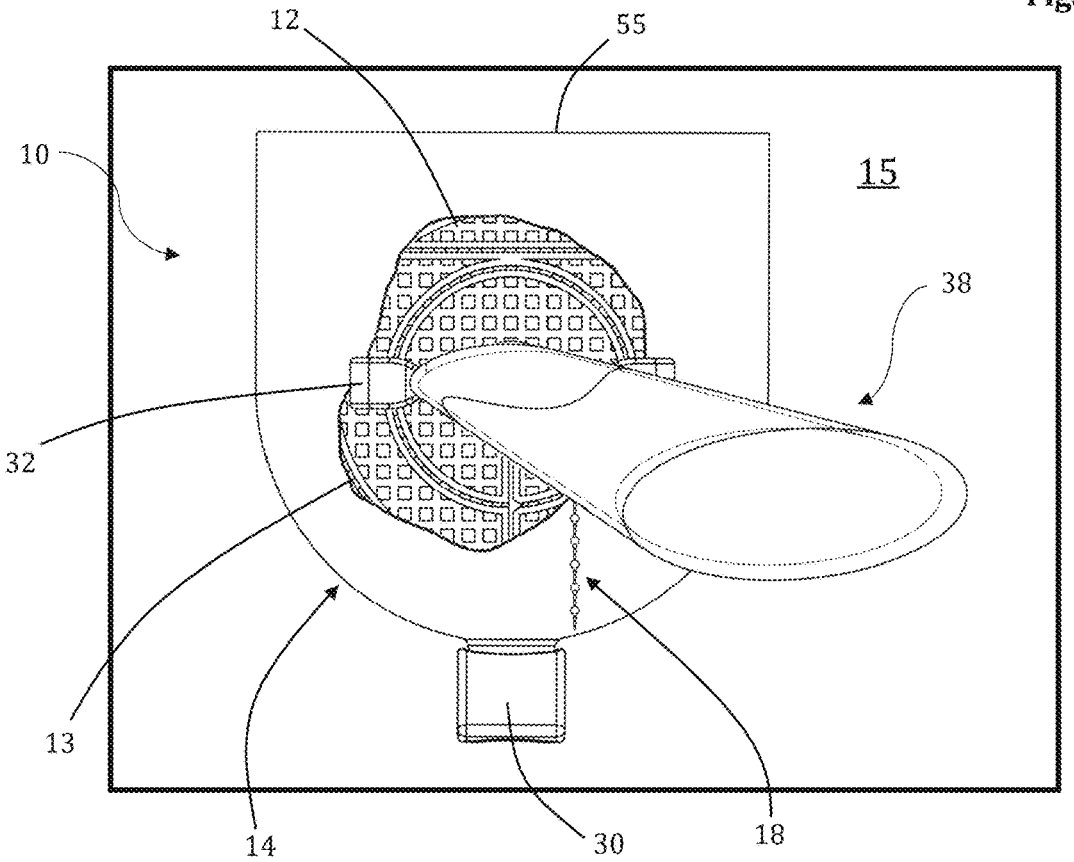
FIG. 7 is a front perspective view of the wall repair kit, in use, with an example filler agent container shown attached to the front blocking element, and about to output filler agent into an example hole in a wall, (black outline around the Figure simply denoting confines of the view shown)
Figure 8:
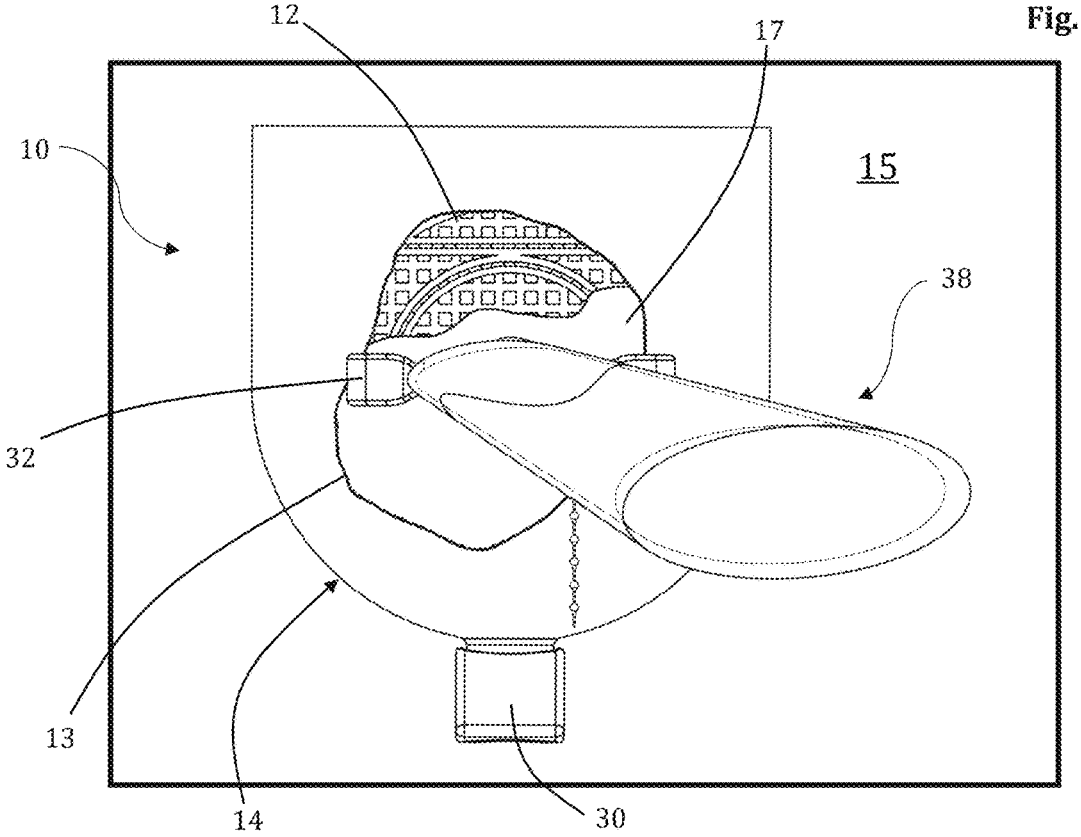
FIG. 8 is a front perspective view of the same example embodiment as shown in FIG. 7, in use, now showing some filler agent inputted into the hole in the wall, (black outline around the Figure simply denoting confines of the view shown)
Figure 9:
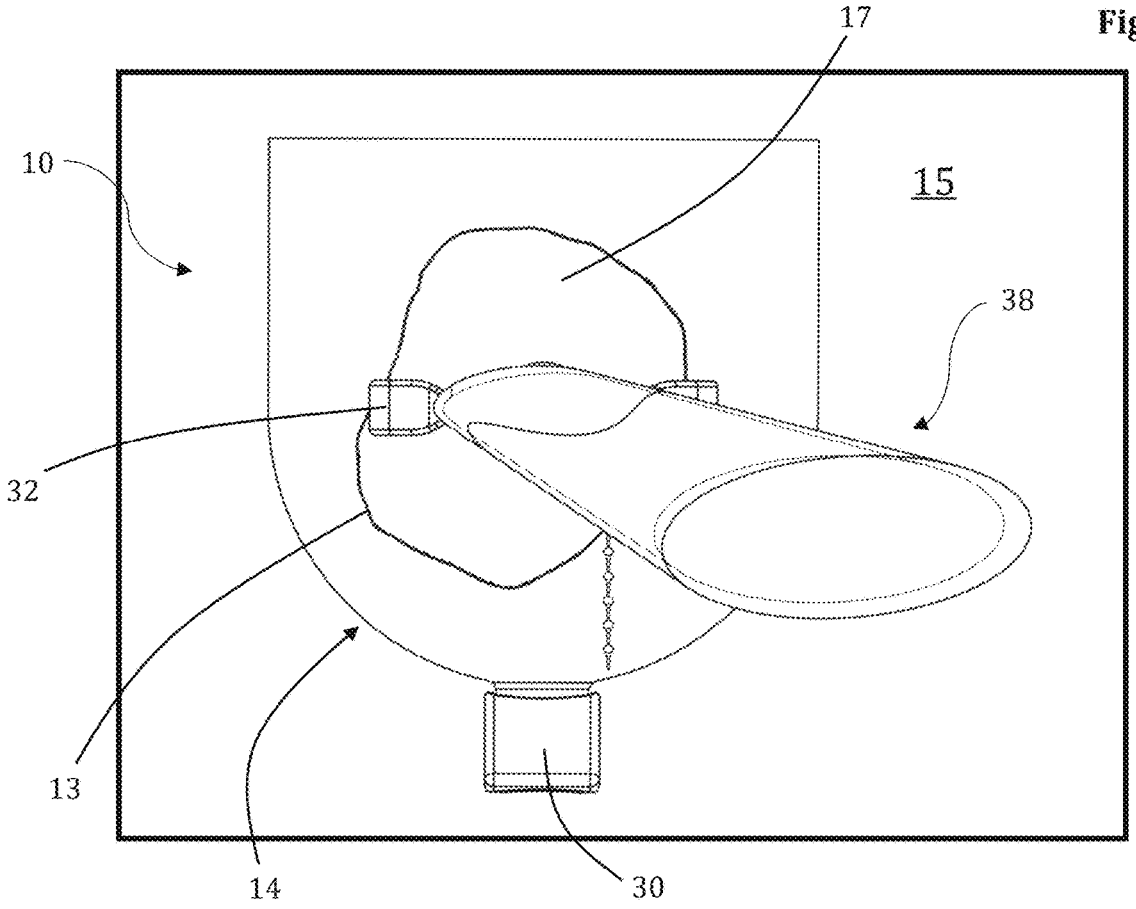
FIG. 9 is a front perspective view of the same example embodiment as shown in FIG. 7 and FIG. 8, in use, now showing filler agent having been inputted into the hole in the wall, with the hole now filled with filler agent, (black outline around the Figure simply denoting confines of the view shown)

Preferably, the input aperture 16 of the front blocking element is the only input aperture that the front blocking element has. (ie Preferably there is only one input aperture 16). (An example of this is clearly shown in the drawings, (perhaps best shown in FIG. 1, and the sequence of FIGS. 7 to 9), where, the input aperture 16 of the front blocking element is the only input aperture, (to facilitate inputting the filler agent into the hole in the wall, through the front blocking element), the front blocking element has. (Preferably, when the front blocking element is in a blocking position, in front of the hole in the wall, the input aperture of the front blocking element is the only aperture that the front blocking element has, through to the hole in the wall. (The example embodiment(s) in the drawings clearly show an example(s) of this). (Note: Even the example as shown in FIG. 4 is an example within a scope of this, because the example aperture(s) 49, when the front blocking element is in the blocking position, (as shown, for example, in FIGS. 7 to 9), are not visible, and are not 'an aperture(s) through to the hole in the wall'. Therefore, as shown in FIGS. 7 to 9, this is an example of wherein, when the front blocking element is in a blocking position, in front of the hole in the wall, the input aperture of the front blocking element is the only aperture that the front blocking element has, through to the hole in the wall. (It should be stated that embodiments may be provided wherein the front blocking element does not have such aperture(s) 49, and wherein, at absolutely all times, the input aperture is the only aperture the front blocking element has. This, of course, would also be within a scope of wherein, 'when the front blocking element is in a blocking position, in front of the hole in the wall, the input aperture of the front blocking element is the only aperture that the front blocking element has, through to the hole in the wall'))). (Note: If the front blocking element were to have aperture(s), (such as apertures 99 of the back blocking element, for example), this could be counter-productive, (eg due to leading to the hole repair being uneven, when the filler agent dries, for example)).

Preferably the wall repair kit 10 comprises a connecting element 18, to connect the front blocking element 14 and the back blocking element 12. (However, it should be stated, it is feasible embodiments may be provided, wherein there is no connecting element. For example, (provided by way of example only), an embodiment may be provided, for example, wherein a portion or a whole of a wall-facing side of the back blocking element sticks to the wall, and a portion or a whole of a wall-facing side of the front blocking element sticks to the wall. (Sticking may be achieved with or without extra adhesive element(s), (eg double-sided sticky tape, for example). Thus a portion or a whole of the wall-facing side of the back blocking element may feasibly be adhesive. Thus a portion or a whole of the wall-facing side of the front blocking element may feasibly be adhesive. The back blocking element and the front blocking element may thus be stuck, in position. (Thus a connecting element may not be needed). However, there are drawback(s) to this. For example, the adhesive may fail, for example. Thus the back blocking element and/or the front blocking element may fall out of position, (and may even fall off the wall). Thus, preferably, the wall repair kit 10 comprises a connecting element, to connect the front blocking element 14 and the back blocking element 12).

(It will be noted, (particularly in FIG. 2), that the example back blocking element comprises a plurality of apertures 99. (Only several are numbered, as there are a large amount, in the example). (In the example, the apertures 99 are square, but this is just an example, and in other examples, they may be a shape other than square). These apertures 99 can be useful, because, in use, filler agent, (that is dryable from a non-solid state, to a solid state), when inputted into the hole in the wall, is able to travel into these apertures. This creates more 'grip' on the back blocking element, (by the filler agent). When the filler agent dries, this makes it even more likely that the back blocking element will stay in position. Thus such apertures 99 can play a useful/important role. (In other embodiments, such apertures may be provide in a different shape and/or size and/or pattern).

In the example, the wall repair kit is shown comprising an example connecting element 18. In the example, the connecting element is an elongate connecting element. (An example elongate body 19 of the example connecting element is shown in FIG. 5). In the example, (provided by way of example only), the example connecting element comprises example portion(s) 25), (also shown by way of example only), in the example embodiment of FIG. 5. (It will be apparent that this is provided by way of example only). (Only several of the example portion(s) 25 are numbered, in FIG. 5). In the example, the example connecting element also comprises example portion(s) 45, (also shown by way of example only), in the example embodiment of FIG. 5. (It will be apparent that this is provided by way of example only). The example portions 25 are 'larger/broader' than the example portions 45. (The example portions 45 are thus 'smaller/narrower' than the example portions 25). (The benefit of this, in the example embodiment, will be shown, with reference to disclosure of a 'blocking arrangement)).

In the example, the connecting element is what could be described as a 'tag', or 'tag element', (provided simply by way of example only). (The example connecting element 18 is provided simply by way of example only, and it will be apparent that various other shapes and/or designs etc may be provided. Thus what is shown is provided by way of example only, and various options and/or embodiments are possible.

In the example embodiment(s) shown, there is just one connecting element 18. However, it should be stated, it is feasible, (in other embodiments), that there may be provided a plurality of connecting elements. Thus the wall repair kit may feasibly comprise more than one connecting element, to connect the front blocking element and the back blocking element. (It should also be stated, in the present application, any feature(s)/disclosure afforded to the connecting element, (ie to 'one' connecting element), may be afforded to more than one (or all) of the connecting elements, (if there are a plurality of connecting elements).

(It should be stated, even in embodiments where only one connecting element is shown and/or required, a plurality of any or all of the features shown/disclosed may be provided, (eg a plurality of connecting elements and/or back blocking elements and/or front blocking elements and/or filler agent (eg in a container)), so that the user can repair a plurality of different holes in a wall(s)).

(It should also be stated that, although the example connecting element 18 is an example of a connecting element that is provided by way of/in just one part, it is feasible the (or any) connecting element could be provided in a plurality of parts. For example, the connecting element could, for example, comprise a chain, where there are a plurality of chain parts that can be connected (and separated), and, when connected, can be used as the connecting element. (This is just one example of a connecting element that may be provided in a plurality of parts, taken simply by way of example only). Thus various options and/or embodiments are feasibly possible. However, the elegance of the connecting element being one part, (as demonstrated in the example embodiment(s) of the Figures), is preferred.

Figure 2:
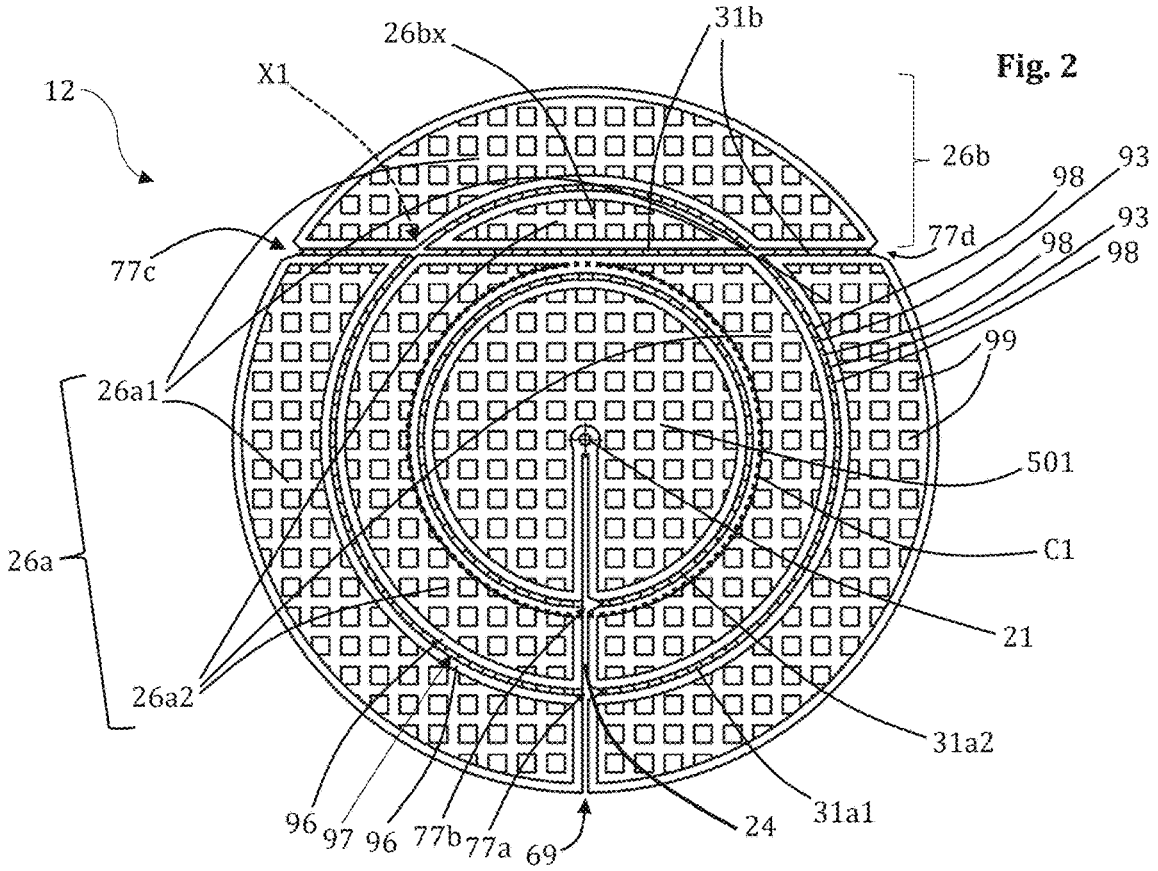
FIG. 2 is a front view of the example back blocking element.

(In the example, (provided by way of example only), the back blocking element comprises an aperture(s) 21 through which the connecting element goes. (An example of this is best shown in FIG. 2). In the example, (provided by way of example only), the connecting element comprises a portion 23 that is larger than the example aperture 21 through which the example connecting element goes. (As best shown/suggested in FIG. 1, in the example, this blocks this portion of the connecting element from being able to travel through the example aperture 21 through which the example connecting element goes, in use). These examples, (the examples shown/provided), in no way limit the (or any) connecting element, and it will be apparent that many options and/or embodiments are possible, for the (or any) connecting element, to connect the front blocking element 14 and the back blocking element 12. It should also be stated that the example shown is just one example of how a connecting element(s) may extend from the back blocking element. It will be apparent there are a large array of possibilities for how this may be achieved, not limited to the example(s) shown. (The present application, for example, mentions various different options and/or embodiments for various different connecting/attachment arrangements. So the same is the case for the back blocking element and a connecting element(s). (And it should also be stated that a portion or a whole of the connecting element(s) may be provided as one part with a portion or a whole of the back blocking element). Thus various options and/or embodiments are possible. (It should also be stated, the example shown is just one example of how a connecting element may travel through the back blocking element. Various options and/or embodiments are possible, not limited to the example shown)).

Preferably, the wall repair kit is operable with the connecting element 18 travelling through the input aperture 16 of the front blocking element 14, to connect the back blocking element 12 and the front blocking element 14. (Examples of this are clearly shown in the Figures, with FIG. 1 and FIGS. 6 to 9 perhaps being most demonstrative. (In FIG. 6, the example connecting element can be seen, travelling through the example input aperture, to connect the back blocking element and the front blocking element)). Example embodiments are clearly shown in the Figures of wherein the connecting element 18 travels through the input aperture 16 of the front blocking element, to connect the back blocking element and the front blocking element. (FIG. 6 shows an example of this most clearly). This can provide a more elegant design, and can make use of the product more elegant and simple.

It will be apparent that it can be highly advantageous for the front blocking element and the back blocking element to be held tightly to the wall. Thus (various) feature(s) may be provided, to facilitate this. (The benefit of this will be particularly apparent, in light of FIGS. 7 to 9, for example). Preferably the front blocking element comprises a holding arrangement, to hold the connecting element, (in a position). (An example(s) of this is shown in the drawings, (best shown in FIG. 6). (In the example embodiment(s), (best shown in FIG. 6), the example holding arrangement holds the connecting element in a (desired) position). (Holding the connecting element in a (desired) position can be extremely useful, to achieve getting the front blocking element and the back blocking element tight to the wall). (A portion or a whole of the holding arrangement may be provided within the input aperture 16, (as shown in the example of FIG. 6, for example). However, it should be stated, a portion or a whole of the holding arrangement may feasibly be provided outside of the input aperture, (ie at a point/position not at all within the input aperture, holding the connecting element, after it has travelled through the input aperture. (For example, a portion or a whole of the holding arrangement could be provided anywhere on an outward facing side 29 (eg at any position/place on an outward facing surface of the example blocking body 34, (in the example embodiment of FIG. 4, for example)) of the front blocking element, configured to hold the connecting element once it has travelled through the input aperture). (It is feasible a portion of the holding arrangement may be provided within the aperture, and a portion of the holding arrangement may be provided outside the aperture). An example of a holding arrangement, is best shown in FIG. 6. In FIG. 6, it can be seen that the example holding arrangement is holding the example connecting element, (in a (desired) position). The example holding arrangement is configured so that the connecting element can be pulled, (to get the back blocking element tight to the wall). Then the connecting element is held by the holding arrangement, (in that position). This, therefore, (in the example), maintains the tightness. (If the connecting element is pulled tight, (tightening the back blocking element to the back of the wall), and the front blocking element is tight against the wall, (eg by the user pushing it against the wall with their other hand, for example, (if it is not held adhesively, for example)), then the holding arrangement can be used, to hold the connecting element in a (desired) position, to thus keep the back blocking element and the front blocking element tight to the wall).

Preferably the front blocking element comprises a blocking arrangement 20, to block a portion of the connecting element, to hold the connecting element in a desired position. (An example of this is best shown in FIG. 6). (A blocking arrangement, to block a portion of the connecting element, to hold the connecting element in a desired position, is an example of a holding arrangement, to hold the connecting element in a (desired) position)). Preferably the connecting element comprises a plurality of portions 45 that fit through the blocking arrangement, and a plurality of portions 25 that do not fit through the blocking arrangement. In the example embodiment, the example connecting element comprises portions 25, and portions 45. (The example is an example of the connecting element comprising a plurality of portions 45 that fit through the blocking arrangement, and a plurality of portions 25 that do not fit through the blocking arrangement). However, it should be stated, it is feasible there may be only one portion 25 that does not fit through the blocking arrangement. (It should also be stated, it is feasible there may only be one portion that fits through the blocking arrangement). (However, the connecting element comprising a plurality of portions that do not fit through the blocking arrangement (and a plurality of portions that do fit through the blocking arrangement) may be useful, to facilitate getting the front blocking element and the back blocking element tight to the wall, (and may be useful for using the wall repair kit on walls of different thickness). In the example, portions 45 fit through the example blocking arrangement. In the example, portions 25 do not fit through the example blocking arrangement. Thus this is an example of wherein there is a blocking arrangement, and the connecting element comprises a plurality of portions that fit through the blocking arrangement, and a plurality of portions that do not fit through the blocking arrangement. In the example of FIG. 6, the example blocking arrangement is shown blocking, by blocking one of the example portions 25, (numbered with the number '25' in FIG. 6), of the example connecting element. An example blocking portion 41, (provided/shown by way of example only), can clearly be seen blocking an example portion 25 of the example connecting element 18, in FIG. 6. This can be seen, in the example embodiment, stopping the connecting element travelling back through the example input aperture 16. The example blocking arrangement can be seen blocking backward movement of the portion of the connecting element that is blocked. (In the example, it can be seen that, in so doing, it stops the example connecting element from travelling backwards, (back through the input aperture of the front blocking element)). Thus the example is shown holding the connecting element in a desired position, the connecting element having travelled through a portion or a whole of the input aperture. (The blocking arrangement is holding the connecting element in a (desired) position, and is thus an example of a holding arrangement, (to hold the connecting element, (in a (desired) position)). In the example, it will be apparent, (by viewing FIG. 6), that this, in the example embodiment, facilitates maintaining tightness (of the front blocking element and the back blocking element, to each other, and thus to the wall). (In the example, the connecting element can be pulled tight, (before use of the blocking arrangement). The blocking arrangement, in the example, (as shown in FIG. 6) has then been used to stop one of the example portions 25 of the connecting element (as shown) from being able to go backwards, back through the aperture of the front blocking element, (thus holding it in position). Thus, in the example embodiment, this maintains tightness of the front blocking element (and the back blocking element) to the wall. (It is feasible the blocking arrangement may comprise a plurality of blocking portions. Thus what is shown in FIG. 6 is an example embodiment of a blocking arrangement that comprises at least one blocking portion). (Whilst the example blocking portion 41 is shown provided by way of one part, it is feasible the (or any) blocking portion(s) may be provided by way of more than one part. For example, there could be a portion than extends from one side (eg of a channel the connecting element travels through), and a portion that extends from the other side (eg of the channel the connecting element travels through), and, together, the portions could block a portion 25 of the connecting element. Thus the blocking portion could be provided by way of two parts which may, (or may not), be in direct contact. Nevertheless, this would be an example of a blocking arrangement that comprises a blocking portion).

Preferably a portion or a whole of the blocking arrangement is provided within the input aperture of the front blocking element. (This is the case in the example embodiment(s) shown, (most clearly shown in FIG. 6)). (In the example embodiment, a whole of the blocking arrangement is provided within the aperture of the front blocking element. (This, again, is clearly shown in the example of FIG. 6)). However, it should be stated, it is technically feasible that a (portion or a whole of a) blocking arrangement may be provided at any position/place, not limited to within the aperture of the front blocking element. Thus the/a blocking arrangement may be provided anywhere, about the front blocking element, (eg at any position, for example, on the outward-facing side 29 of the front blocking element, for example). Thus various options and/or embodiments are possible. (Thus it is broadly stated that the front blocking element preferably comprises a blocking arrangement, to block a portion of the connecting element from travelling backwards, back through the aperture, (and that the example embodiment(s) are provided/shown by way of example only)).

(Note: The example given, (of there being a blocking arrangement), is provided by way of example only, and a blocking arrangement is just one example of a holding arrangement, (to hold the connecting element in a (desired) position). A holding arrangement(s) is not at all limited to a blocking arrangement. For example, the/a holding arrangement(s) may comprise a clipping arrangement (at any point/position, not limited to the position shown, (whether a portion or a whole of it is within the aperture 16 or not)), (to clip the connecting element in place), and/or a (small) clamping arrangement, for example, (at any point/position, not limited to the position shown, (whether a portion or a whole of it is within the aperture 16 or not)), (and/or the/a holding arrangement(s) may comprise any other feature(s), to facilitate holding the connecting element in a (desired) position). Thus what is shown is only one example of an arrangement, to facilitate the front blocking element and the back blocking element being held tightly together, (and thus to the wall). Any solution may be provided, to facilitate the front blocking element and the back blocking element being held tightly to the wall. Furthermore, it is even feasible a tightening mechanism could be provided, to facilitate this. For example, the front blocking element may comprise a (small) rotatable mechanism, for example. Thus the connecting element could, for example, be held, and the rotatable mechanism could then be rotated, to pull the connecting element, thus tightening the front blocking element and the back blocking element to the wall. Thus what is shown/described is provided by way of example only, and it will be apparent there are a large array of ways to maintain tightness. Thus what is shown is only one example of an arrangement, to facilitate the front blocking element and the back blocking element being held tightly together, (and to the wall). Thus it should be stated, the blocking arrangement is provided by way of example only. The front blocking element may comprise any holding arrangement(s). (And the (or any) holding arrangement(s) may be provided anywhere, about the front blocking element).

(Thus, in the example, the wall repair kit is configured to hold the back blocking element tight to the back of the wall, and the front blocking element tight to the front of the wall, (via the connecting element)).

In the example embodiment(s), the front blocking element comprises an input aperture 16, through to the hole in the wall, (which is to be repaired). Filler agent can thus be inputted into the hole in the wall, through the example input aperture 16. (This very process is shown, (particularly clearly), in the sequence of FIGS. 7 to 9). (An example container 38, (to contain the filler agent) is shown in various of the Figures). Whilst it is feasible a different (ie another) aperture could be provided, (ie the front blocking element could comprises another aperture), for the connecting element to travel through, preferably the same aperture is used, for the connecting element to travel through, and for inputting filler agent into the hole. (The example(s) shown in the Figures is an example of wherein the front blocking element comprises an input aperture, to facilitate inputting a filler agent into the hole in the wall, through the front blocking element; wherein the wall repair kit is operable with the connecting element travelling through the input aperture of the front blocking element, to connect the back blocking element and the front blocking element). Preferably the wall repair kit is operable with the connecting element travelling through the input aperture of the front blocking element, and the container being in a filling position, simultaneously. (This is shown in the Figures, and an example of this is most clearly shown/alluded to in FIG. 6, (especially in combination with FIGS. 7 to 9)). (Note: This even includes within its scope, for example, an embodiment wherein, in the filling position, an output aperture of the container is 'flush' to the input aperture of the front blocking element, (but not received into the input aperture), (if the wall repair kit is operable with the connecting element travelling through the input aperture of the front blocking element, and the container being in a filling position, simultaneously). (It should also be stated, the wall repair kit being 'operable with the connecting element travelling through the input aperture, and the container being in a filling position, simultaneously' would include within its scope even an embodiment wherein the connecting element, for example, travels through the output aperture of the container, (and thus into the container)). (The wall repair kit being 'operable with the connecting element travelling through the input aperture, and the container being in a filling position, simultaneously' differentiates, for example, from an embodiment, for example, wherein the connecting element is of a thickness/broadness (ie, broadly speaking, of a dimension) such that it cannot travel through the output aperture of the container, and wherein it cannot travel to a side of the output aperture of the container. Nevertheless, if such an example is operable with the connecting element travelling through the input aperture of the front blocking element, to connect the back blocking element and the front blocking element, it is within a scope of the wall repair kit being operable with the connecting element travelling through the input aperture of the front blocking element, to connect the back blocking element and the front blocking element). (Most preferably, the wall repair kit is operable with an output aperture of the container, out of which the filler agent is outputted from the container, received into the input aperture of the front blocking element, and the connecting element travelling through the input aperture, simultaneously. (An example of this is most clearly shown in FIGS. 7 to 9, (especially with reference to what is shown in FIG. 6, (and an example is clearly shown/alluded to in FIG. 1 also). (In the example(s), an example outputting portion 39 of the example container 38 is received into the example input aperture 16 of the front blocking element 14. Since the outputting portion 39 comprises an output aperture of the container, (out of which the filler agent is outputted from the container), this is an example of wherein an output aperture of the container, out of which the filler agent is outputted from the container, is received into the input aperture of the front blocking element)). (Note: Even if the output aperture of the container is received into the input aperture of the front blocking element, and the connecting element were to travel into the output aperture of the container, this would nevertheless be an example of wherein the wall repair kit is operable with the connecting element travelling through the input aperture of the front blocking element, and the container being in a filling position, simultaneously. However, most preferably, preferably the input aperture 16 of the front blocking element 14 is of a dimension such that the connecting element 18 can travel through the input aperture 16, to a side of an output aperture 39 of the container 38, when the container is in a filling position. (An example of this is best shown/alluded to in FIG. 6, where it is clear that the example connecting element is travelling through a different portion of the input aperture of the front blocking element to the portion of the input aperture that the example outputting portion (and thus the example output aperture) of the example container is, (or at least will be, with reference to FIG. 6), received into). (Note: The input aperture 16 of the front blocking element 14 being of a dimension such that the connecting element 18 can travel through the input aperture 16, to a side of an output aperture 39 of the container 38, when the container is in a filling position includes within its scope, for example, wherein the output aperture of the container is 'flush' to the input aperture of the front blocking element, (in the filling position), (but not received into the input aperture). However, most preferably, the input aperture of the front blocking element is dimensioned such that the wall repair kit is operable with an outputting portion of the container, comprising the output aperture of the container, received into the input aperture of the front blocking element, and the connecting element travelling through the input aperture, to a side of the outputting portion of the container. (An example(s) of this is best shown/depicted in FIG. 6, where it is clear the connecting element is travelling through the input aperture of the front blocking element, and that the outputting portion of the container, (and thus the output aperture of the container, in the example), can be received into the input aperture of the front blocking element. The connecting element will thus be travelling through the input aperture of the front blocking element, to a side of the outputting portion of the container. (The output aperture of the example container is then shown being received into the input aperture of the front blocking element in FIGS. 7 to 9)). (Note: As stated, it is feasible embodiments may be provided wherein, in the filling position, the output aperture of the container is 'flush' to the input aperture of the front blocking element, (but not received into the input aperture). Thus what is shown in FIG. 6 (in combination with FIGS. 7 to 9), is an example, broadly speaking, of wherein the input aperture of the front blocking element is of a dimension such that the connecting element can travel through the input aperture, to a side of the output aperture of the container, when the container is in a filling position. In the example embodiment, (provided by way of example only), the outputting portion of the container is received into the input aperture of the front blocking element, in the filling position. However, looking at the example embodiment of FIG. 6, for example, if, (in a slightly differing embodiment, for example), the output aperture of the container was not received into the input aperture of the front blocking element in the filling position, and was instead 'flush' to the input aperture, such an embodiment would nevertheless be an example embodiment of wherein the input aperture of the front blocking element is of a dimension such that the connecting element can travel through the input aperture, to a side of the output aperture of the container, when the container is in a filling position.

(Note: Whether the output aperture of the container goes part of the way through the input aperture of the front blocking element, or goes the whole way through, (even perhaps going (slightly) 'past' the input aperture), this is considered to be within a scope of the output aperture of the container being received into the input aperture of the front blocking element).

(Note, whether the connecting element fully travels through the input aperture of the front blocking element, (eg with a portion of the connecting element then protruding out of the input aperture, at a front of the front blocking element), or whether it does not fully travel through the input aperture of the front blocking element, (ie travels through a portion, but not the whole way through, the input aperture of the front blocking element), nevertheless, both are considered to be within the scope of the connecting element 'travelling through' the input aperture of the front blocking element. (So the same is the case for any disclosure relating to the connecting element 'travelling through an aperture' of the front blocking element)).

Preferably the connecting element is breakable. (In the example, the example connecting element, (preferably once the filler agent has dried), can be broken, simply by pulling on it strongly. (Thus, in the example, (preferably once the filler agent has dried), the user could, for example, release the connecting element from the holding arrangement, and then, (either before, or after removing the front blocking element from the front of the wall), break the connecting element. In the example embodiment, this can be done, simply from pulling on the connecting element, (strongly)). In the example, the example connecting element is made out of a type of plastic. In other embodiments, it may be made out of other material(s), (not limited to plastic)). (In the example, (provided by way of example only), the example connecting element is non-rigid. The example, however, is provided by way of example only, and it will be apparent that a vast array of different options and/or embodiments are possible for the (or any) connecting element(s), not limited to the example(s) provided). (Thus rigid embodiments may feasibly be possible).

(In the example, (provided by way of example only), the connecting element 18 is non-rigid, and the front blocking element comprises a holding arrangement, to hold the non-rigid connecting element, (in a (desired) position). However, as stated, it will be apparent that a vast array of different options and/or embodiments are possible for the (or any) connecting element(s), (and for the (or any) holding arrangement(s)), not limited to the example embodiment(s) shown).

The back blocking element may be partially or wholly collapsible, to facilitate fitting the back blocking element through the hole in the wall.

Referring to the back blocking element, the back blocking element comprises a blocking body. (This is simply a broad term given to the body of the back blocking element that blocks the hole in the wall. In the example of FIG. 2, for example, the whole back blocking element is the blocking body, (ie all that is seen in FIG. 2 is a blocking body). (Similarly, referring to the front blocking element, the front blocking element comprises a blocking body. (This is simply a broad term given to the body of the front blocking element that blocks the hole in the wall). Thus the back blocking element comprises a blocking body, to block the hole in the wall, (behind the hole in the wall). Thus the front blocking element comprises a blocking body, to block the hole in the wall, (in front of the hole in the wall).

Preferably the back blocking element comprises a separation 69 that travels from a perimeter of the blocking body, inwards. (An example of this is shown clearly, (shown most clearly in FIG. 2), where an example separation 69 that travels from a perimeter of the blocking body, inwards, is shown. (In the example embodiment, the separation is (and therefore comprises) a slit(s) 24. An example is shown most clearly in FIG. 2, where the example back blocking element is shown comprising an example slit 24 that extends from a perimeter of the blocking body, inwards. (As will be explained, this may be useful and/or important, to facilitate feeding the back blocking arrangement through the hole in the wall). (Whilst the example back blocking element comprises just one slit 24, it is feasible embodiments may be provided where there may be more than one slit. (Thus there may feasibly be more than one separation that travels from the perimeter of the blocking body, inwards)). The slit(s) can be useful, in helping get the back blocking element through the hole in the wall. For example, the slit 24 can be useful, in helping rotate the back blocking element through the hole in the wall. For example, the slit can be helpful by allowing the user to separate the back blocking element at the slit, and push (ie in any way position) a portion of the back blocking element, (where the back blocking element is separated at the slit), through the hole in the wall. The example back blocking element can then be rotated, with the result of ever more of the back blocking element going through the hole, until it finally has fully gone through. (Note: A slit is an example of a 'separation' in the back blocking element. Thus the example shown, (best shown in FIG. 2), is an example of where there is a separation in the back blocking element. (And example feature 24 is an example of a separation in the back blocking element). As has been described, this can be extremely useful, for getting the back blocking element through the hole in the wall). In the example, the example slit, (which is an example of a separation), goes all the way to the centre of the blocking body of the back blocking element, (which can clearly be seen in the example of FIG. 2). (The centre of the example blocking body is denoted with a cross-hair, in FIG. 2, which is clearly visible). However, in other embodiments, the (or any) separation(s) may, or may not, travel this far inwards, (or may feasibly travel further). Preferably the separation travels at least half of the distance towards the centre of the blocking body of the back blocking element. (ie Looking at dashed circle C1, denoted in the example of FIG. 2, for example, which denotes halfway between the perimeter of the blocking body and the centre of the blocking body, (which, as stated, is denoted with a cross-hair), preferably the separation travels at least this far, inwards. (Dashed line C1 shown in FIG. 2 is always half the distance between the centre of the blocking body and the perimeter of the blocking body. Thus any separation that travels inwards from the perimeter, up to (or beyond) this dashed circle C1, would be an example of a separation that travels 'at least half' of the distance towards the centre of the blocking body of the back blocking element. (As shown, though, preferably it travels inwards further than this, with the example separation of FIG. 2 travelling all the way to the centre of the example blocking body). In the example, the back blocking element is flexible, such that the back blocking element can be separated at the separation, but the back blocking element can then return to its original shape, (ie the shape as shown in FIG. 2). In the example, the back blocking element is resiliently flexible, such that the back blocking element can be separated at the separation, but the back blocking element then resiliently, (ie naturally, of its own accord, (at least to some extent, and preferably wholly)), returns to its original shape, (ie the shape as shown in FIG. 2). It will be apparent that, despite the separation, the back blocking element is able to be effective in blocking the hole in the wall.

Thus, preferably the back blocking element comprises a separation that travels from a perimeter of the back blocking element, inwards. It may, or may not, travel straight. (In the example, it travels straight, (ie in a straight line). It may, or may not, travel exactly towards a centre of the blocking body of the back blocking element. (In the example embodiment, the example separation travels exactly towards the centre of the blocking body, (very clearly shown in FIG. 2, for example). But in other embodiments, it may not. For example, looking at the example of FIG. 2, the example slit travels exactly towards the centre. But if an embodiment of a slit was provided that is similar, but travels slightly off-centre, (eg towards around 1 cm off centre, for example, (or more, for example, (or less)), it could nevertheless perform much the same function, (and would nevertheless be usable, to facilitate rotating the back blocking element through a hole in the wall). (Thus various options and/or embodiments are possible)).

Preferably, length of the separation 69 is at least a quarter a distance of a shortest point between the perimeter of the blocking body, and the centre of the blocking body. More preferably, preferably length of the separation is at least a third a distance of a shortest point between the perimeter of the blocking body, and the centre of the blocking body. Still more preferably, preferably length of the separation is at least half a distance of a shortest point between the perimeter of the blocking body, and the centre of the blocking body. (In the example, because the example blocking body is exactly circular, the distance from the perimeter of the blocking body to the centre of the blocking body is the same, the whole way around the perimeter. But in other embodiments, this may, feasibly, not be the case. For example, in an embodiment where the blocking body is squarer, for example, it will be apparent that the distance from the perimeter of the blocking body to the centre of the blocking body is different, at different points around the perimeter). Thus it is stated that preferably length of the separation is at least half a distance of a shortest point between the perimeter of the blocking body, and the centre of the blocking body, (ie is preferably at least half this distance). Even in such an example, preferably length of the separation is at least half the distance of a longest point between the perimeter and the centre of the blocking body. (As stated, the separation may, or may not, travel exactly towards the centre of the blocking body).

In the example embodiment, (provided by way of example only), the separation is (and thus comprises) a slit. (A slit is particularly useful, in allowing the back blocking element to (easily) reform to its original shape, (as seen in the example of FIG. 2, for example), to thus effectively block the hole in the wall, behind the hole in the wall). However, it should be stated, the example of a separation, (eg as shown in FIG. 2), is shown by way of example only, and the separation may, in other embodiments, for example, be different in shape, for example, (eg curved and/or zigzagged, etc). (A slit(s) is not limited to being straight, (the example(s) in the Figures being provided by way of example only), and any shape and/or design of slit(s) may be provided). Unusual embodiments of a separation are feasibly possible. For example, (rather than what is shown in the example of FIG. 2, for example), there could be an overlap at the separation, where one of the sides, at one side of the separation, (or just a portion(s) of it), overlaps the other side, at the other side of the separation, (and/or vice versa). Thus various options and/or embodiments are possible. (Note: The example slit, (in the Figures), is simply an example of a separation in the back blocking element that runs from the perimeter of the back blocking element, (inwards). Any feature(s)/disclosure afforded to the (or any) slit(s), in the present application, may be broadly afforded to any separation that runs from the perimeter of the back blocking element. The example is provided by way of example only).

Figure 12:
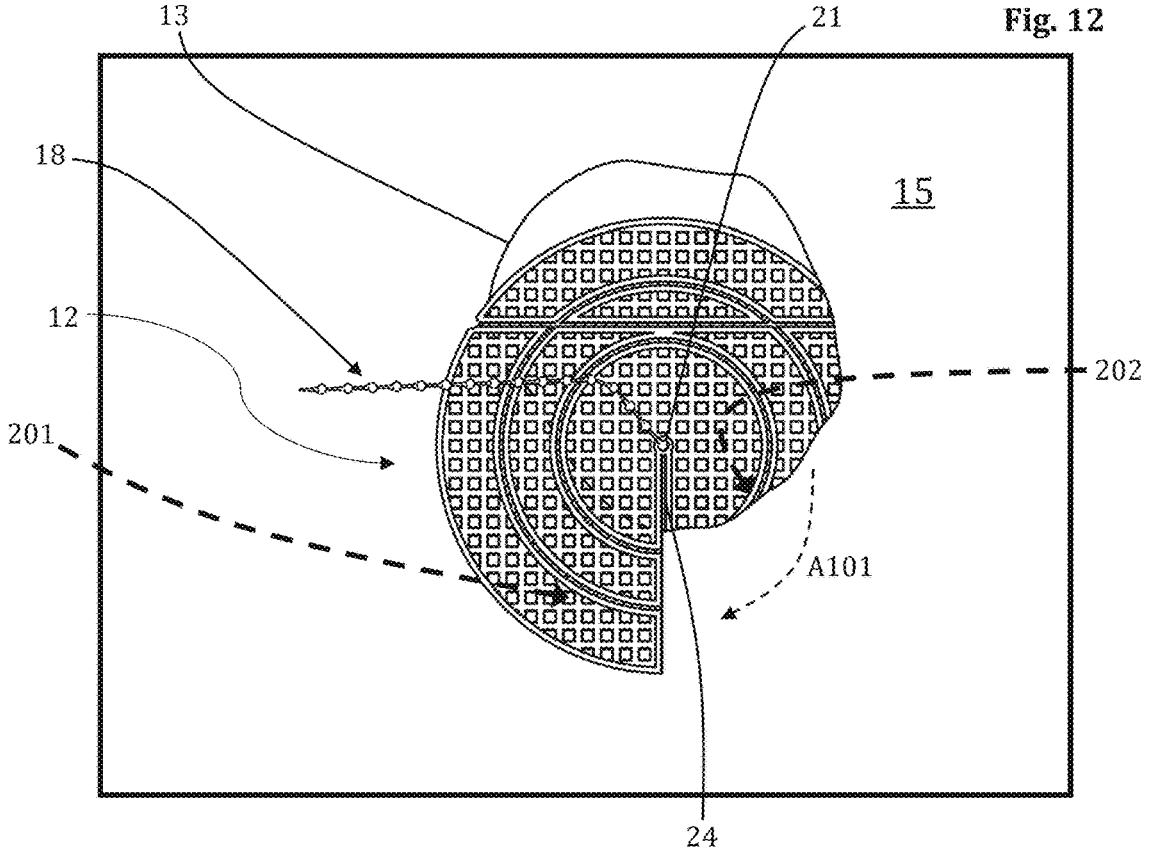
FIG. 12 is a front perspective view, showing how a separation in the back blocking element can be used, to facilitate rotating the back blocking element through the hole in the wall, to behind the hole in the wall, (black outline around the Figure simply denoting confines of the view shown)

Referring to FIG. 12, an example back blocking element is shown. On one side of the example separation, (which, in the example, is (and thus comprises) a slit 24), a portion 201 of the back blocking element is at a front side of the wall, (generally pointed to, in FIG. 12, with a large dashed arrow). On the other side of the example separation, a portion 202 of the back blocking element is going through the hole in the wall, (generally pointed to, in FIG. 12, with a large dashed arrow). The example back blocking element can now be rotated, (arrow A101 denotes how it can be rotated), which, in the example embodiment, leads to the back blocking element travelling through the hole in the wall. It can then assume its position, blocking the hole in the wall, behind the hole in the wall. (An example connecting element 18 is also shown in FIG. 12. (Note: The connecting element is shown as if pulled aside by a user's hand, as the user, whilst carrying out what is shown in FIG. 12, may pull aside the connecting element. It is shown as it is simply by way of example only)). (Note: Looking at the example of FIG. 12, for example, it is possible (without the specific aperture 21), that the connecting element could go through the back blocking element, simply via use of the example separation, (ie the example slit, in the example). (ie The connecting element could simply go through the slit, without need for example aperture 21. However, this may lead to the connecting element not staying in position, which could be cumbersome, (and even problematic). Therefore what is shown in FIG. 12, for example, is preferred, where the connecting element goes through aperture 21. (It can clearly be seen, in FIG. 12, that example aperture 21 limits movement of the example connecting element). (It should also be stated that, whilst in the example of FIG. 12, the example aperture 21 cannot be accessed via the example separation (ie the example slit 24), in other examples, it is feasible aperture 21 could be accessible via the example separation (ie the example slit 24). Thus, in such embodiments, it is feasible the connecting element could be threaded through the separation, to get it through aperture 21. If the entrance to aperture 21 from the separation is resiliently flexible (such that it then 'reforms' once the connecting element goes through the entrance), movement of the connecting element could still be limited by the aperture 21, in such an embodiment)).

Preferably one or more portions 26 of the back blocking element are removable from the back blocking arrangement. (This is the case in the example embodiment(s), where one or more portions 26 of the back blocking element are removable). (In the example, this is achieved via a breaking arrangement(s) 31, (which allow portion(s) of the back blocking element to be broken off). Thus, preferably the back blocking element comprises: a blocking body, (for blocking the hole in the wall), wherein the blocking body comprises a break arrangement 31, configured for breaking, to facilitate breaking off a portion 26 of the blocking body, the portion being of a pre-determined shape, determined by shape and position of the break arrangement. (An example of this is shown in all the drawings that show a back blocking element, and this is best shown in FIG. 2, (and FIGS. 13 and 14)).

(All the example break arrangements, in the example of FIG. 2, are given the number '31'. Each of the break arrangements is also given a suffix, (which is here a letter—eg 'a' or 'b'), relating to the shape/type of portion of the blocking body that is removable, via breaking of the break arrangement. This will be explained and become apparent. If there are two of the same type of break arrangement, (eg two break arrangements given the suffix 'a', for example, then a further number is added, (eg 'a1' and 'a2', etc). This will be explained and become apparent. (Similar numbering, (ie adding of a letter suffix, (and adding of a further number, after the suffix, if there are two such portions)), is provided for any portion(s) 26 that are removable, via breaking of a break arrangement)).

Figure 13:
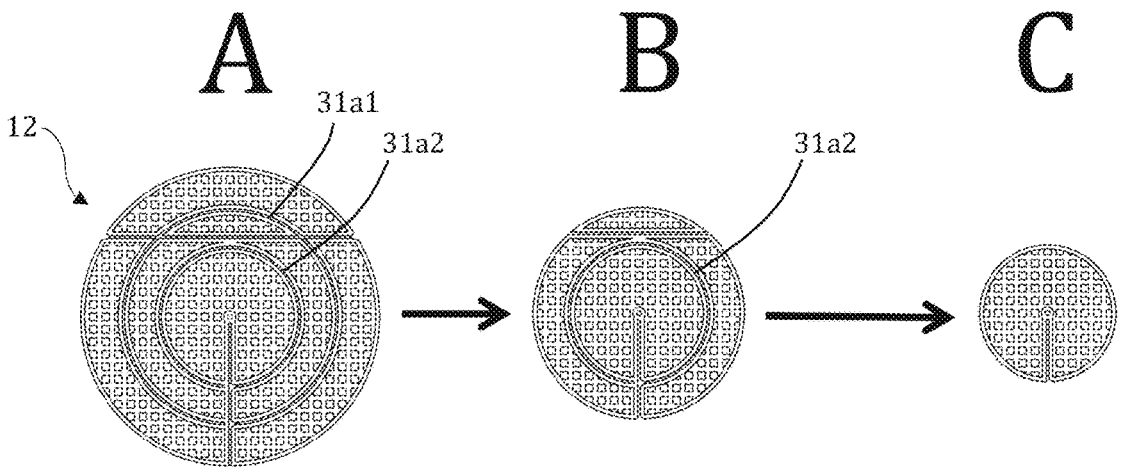
FIG. 13 is a front view of an example same/similar to the example back blocking element of FIG. 2, showing various options, in terms of the options example break arrangements provide, showing an example of how the back blocking element can be made smaller, by virtue of use of a break arrangement(s)

The removable portion 26, (removable via breaking of the break arrangement), may comprise a whole of a perimeter of the blocking body. (For such examples, (where the break arrangement facilitates breaking off a portion that comprises a whole perimeter of the blocking body, the break arrangement 31 is given the suffix 'a'—for example, see example break arrangements 31*a*1 and 31*a*2 in FIG. 2), (and the removable portion 26 is given the suffix 'a'—for example, see example portions 26*a*1 and 26*a*2 in FIG. 2, (and which together form example portion 26*a*, which, it will be clear, comprises the whole perimeter of the blocking body)). (For example, example portion 26*a*1 outside of example break arrangement 31*a*1 comprises a whole perimeter of the blocking body. Thus, if break arrangement 31*a*1 is used, (ie broken), the example portion 26*a*1 outside of the break arrangement that is removed comprises the whole perimeter of the blocking body. (Note: Whilst example portion 26*a*2, (looking at FIG. 2 as shown in FIG. 2), does not comprise a whole of a perimeter of the blocking body, because, in the example of FIG. 2, it comprises a whole perimeter of 'that which remains' of the blocking body when example portion 26*a*1 is removed, (see option/mode 'B' in FIG. 13, where example portion 26*a*1 has been removed), it is afforded the suffix 'a'). Removing of such a portion, (ie a portion that comprises a whole of a perimeter of the blocking body, (or a whole perimeter of 'that which remains' of the blocking body—eg example portion 26*a*2 if example portion 26*a*1 has already been removed, in the example of FIG. 2)), can be useful/important, to change size of the back blocking element, for repairing different sized holes in the wall. For example, for a relatively large hole, (eg slightly smaller than the size of the back blocking element as it is shown in FIG. 2), the back blocking element as it is shown in FIG. 2 may be used. However, if the hole is smaller, such that the size of the back blocking element as it is shown in FIG. 2 is problematic, (eg in terms of actually getting the back blocking element through the hole in the wall, to behind the hole in the wall), example portion 26*a*1, for example, may be removed, (via use of example break arrangement 31*a*1, (ie by breaking example break arrangement 31*a*1). The example embodiment can otherwise function similarly. (Use of example break arrangement 31*a*1 is clearly shown/denoted in FIG. 13, showing the change between option/mode 'A' in FIG. 13, and option/mode 'B', where the change in size, (with example portion 26*a*1, (which comprises a whole perimeter of the blocking body)), removed, is apparent). Now looking at example break arrangement 31*a*2, (with reference to FIG. 2), it will be apparent, (looking at FIG. 2 as FIG. 2 is shown), that if break arrangement 31*a*2 is used, (ie broken), example portion 26*a* will be broken off, (and is thus removable, via breaking example break arrangement 31*a*2). Thus, again, example break arrangement 31*a*2 is an example of a break arrangement that facilitates removing a portion that comprises a whole of a perimeter of the blocking body. Again, it will be apparent that this can be useful/important, in terms of changing size of the back blocking element. (And, of course, in the example if example break arrangement 31*a*1 has already been used, (ie broken), (and if the hole in the wall is even smaller), example portion 26*a*2 can be removed, (via use of example break arrangement 31*a*2), thus making the back blocking element even smaller. (Again, the example embodiment can otherwise function similarly). Thus both break arrangements 31*a* (ie break arrangement 31*a*1 and break arrangement 31*a*2), are examples of wherein the removable portion, (removable via breaking of the break arrangement), comprises a whole of a perimeter of the blocking body, (and it should be said, if example break arrangement 31*a*1 has already been used, (ie broken), and portion 26*a*1 removed, when example break arrangement 31*a*2 is used, (ie broken), portion 26*a*2 that is removed comprises a whole of a perimeter of 'that which remains' of the blocking body. (This is clearly shown/denoted in the change from option/mode 'B' to option/mode 'C' in FIG. 13). However, since example break arrangement 31*a*2, (as shown in FIG. 2, how FIG. 2 is shown), is usable to remove a portion, (example portion 26*a*), that comprises a whole perimeter of the blocking body, it is considered to be an example of a break arrangement that facilitates breaking off a portion that comprises a whole perimeter of the blocking body. (Example portion 26*a*, in FIG. 2, includes both example portions 26*a*1 and 26*a*2, (which could be considered to be 'sub-portions' of portion 26*a*)). As the example embodiment of FIG. 2 clearly shows, preferably there is provided a first break arrangement, (eg example break arrangement 31*a*1, in FIG. 2), configured for breaking, to facilitate breaking off a first portion of the blocking body, (eg example portion 26*a*1, in FIG. 2), the first portion being of a pre-determined shape, determined by shape and position of the first break arrangement, wherein the first portion comprises a whole of a perimeter of the blocking body; and a second break arrangement, (eg example break arrangement 31*a*2, in FIG. 2), configured for breaking, to facilitate breaking off a second portion of the blocking body, (eg example portion 26*a*, in FIG. 2), the second portion being of a pre-determined shape, determined by shape and position of the second break arrangement, wherein the second portion comprises the first portion, and, with the first portion having been removed, what remains of the second portion comprises a whole perimeter of that which remains of the blocking body. (Therefore, irrespective of any other definition, the example back blocking element is an example of wherein there is a second break arrangement, (eg example break arrangement 31*a*2 in FIG. 2), configured for breaking, to facilitate breaking off a second portion of the blocking body, (eg example portion 26*a* in FIG. 2), wherein the second portion comprises the first portion, (eg example portion 26*a*1 in FIG. 2). (It is clear that example portion 26*a*1, in the example of FIG. 2, is removable via breaking example break arrangement 31*a*1). (It can be clearly seen, in FIG. 2, that the example second portion, (eg example portion 26*a* in FIG. 2), is larger than the example first portion (eg example portion 26*a*1 in FIG. 2), and comprises the example first portion). (In the example embodiment, when the first portion is removed, the second portion comprises a whole perimeter of that which remains of the blocking body. However, it will be apparent that various options and/or embodiments are possible. For example, looking at FIG. 2, and looking at example portion 26*a*2, example portion 26*a*2, if example portion 26*a*1 is removed, (eg, looking at FIG. 2, if example portion 26*a*1 is removed via breaking example break arrangement 31*a*1), comprises a whole of a perimeter of that which remains of the blocking body. For example, looking at FIG. 2, and looking at example portion 26*a*2, example portion 26*a*2, if example portion 26*a*1 is removed, comprises a whole of a perimeter of that which remains of the blocking body. However, rather than this being the case, an embodiment could be provided wherein, if example portion 26*a*1 is removed, that which remains of the blocking body comprises a break arrangement that facilitates breaking off a portion of the blocking body, wherein the portion comprises a portion, rather than a whole, of the perimeter of that which remains of the blocking body. (For example, such a portion could comprise 'most' (but not all) of the perimeter of that which remains of the blocking body, for example). Thus, broadly speaking, what is shown is an example of wherein the blocking body comprises a break arrangement (eg example break arrangement 31*a*1) that facilitates breaking off a portion of the blocking body that comprises a whole perimeter of the blocking body, and wherein, with the portion that comprises a whole perimeter of the blocking body removed, that which remains of the blocking body comprises a break arrangement, (eg example break arrangement 31*a*2), to facilitate breaking off a portion of that which remains. The portion of that which remains may comprise a whole perimeter of that which remains. (FIG. 2 is an example of this, (example portion 26*a*2, (with example portion 26*a*1 having been removed), being an example of a portion that comprises a whole perimeter of that which remains of the blocking body). However, in other embodiments, the portion may comprise a portion, (but not a whole), of the perimeter of that which remains. (For example, it may comprise most, (ie more than half), of the perimeter, (but not a whole of the perimeter), for example). (The example shown shows an example of wherein there is a first break arrangement (eg example break arrangement 31*a*1), configured for breaking, to facilitate breaking off a first portion of the blocking body, wherein the first portion comprises a whole of a perimeter of the blocking body, (eg example portion 26*a*1), (the portion being of a pre-determined shape, determined by shape and position of the first break arrangement), and the blocking body comprise a second break arrangement (eg example break arrangement 31*a*2, for example), configured for breaking, to facilitate breaking off a second portion of the blocking body, (eg example portion 26*a*), the second portion being of a pre-determined shape, determined by shape and position of the second break arrangement, wherein the second portion is larger than the first portion, and comprises the first portion.

(Such an embodiment may, for example, otherwise comprise any or all feature(s) shown and/or disclosed in the present application)). Thus, looking at the example of FIG. 2, if example break arrangement 31*a*1 has not be used, example break arrangement 31*a*2 is usable, to remove portion 26*a*, (including portions 26*a*1 and 26*a*2). If example break arrangement 31*a*1 has already been used, (example portion 26*a*1 having already been removed), example break arrangement 31*a*2 is usable to remove example portion 26*a*2, (either option leading to what is shown as option/mode 'C' in FIG. 13). (Note: In the example embodiments, example break arrangements 31*a*1 and 31*a*2 are circular. However, the embodiment is provided by way of example only. In other embodiments, example break arrangement 31*a*1 may, or may not, be circular. In other embodiments, example break arrangement 31*a*2 may, or may not, be circular. (Similarly, in the example embodiment, the blocking body is circular. However, the embodiment is provided by way of example only. In other embodiments, the blocking body may, or may not, be circular). (Preferably the back blocking element comprises a break arrangement(s) that substantially matches shape of the blocking body. (An example of this is clearly shown in the example embodiment of FIG. 2, where there is a break arrangement that substantially matches shape of the blocking body, (and, in fact, there is more than one break arrangement (break arrangements 31*a*1 and 31*a*2) that substantially match shape of the blocking body). (In the example, the blocking body is circular, and example break arrangements 31*a*1 and 31*a*2 are clearly circular, substantially matching shape of the blocking body). The (or any) break arrangement(s) substantially matching the blocking body in shape means that, if the break arrangement is used, the blocking body stays noticeably the same shape, but just becomes smaller. (Please see FIG. 13 for a good and clear example of this). Thus, FIG. 2 is an example of this, since, if break arrangement 31*a*1 and/or break arrangement 31*a*2 is used, the blocking body remains noticeably the same shape, (ie round/circular), but just becomes smaller. (Even in embodiments where the blocking body is a shape other than circular, it is feasible there may be a break arrangement(s) that substantially matches shape of the blocking body—eg if the blocking body is generally square, and if there was a break arrangement 31*a* that was also similarly generally square in shape, that would also be an example of where the/a break arrangement(s) 31*a* substantially match shape of the blocking body). (It should also be stated that a break arrangement(s) that facilitate breaking off a portion of the blocking body that comprises a whole of a perimeter of the blocking body may, or may not, substantially match shape of the blocking body)))).

(An example portion 501 can be seen in FIG. 2. (Example portion 501, in FIG. 2, is that which remains of the blocking body, if example break arrangement 31*a*2 is used)).

To again explain the example break arrangements 31*a* clearly, (and in particular, example break arrangement 31*a*2), (in the example of FIG. 2, which shows this most clearly), either example break arrangement 31*a*2 can be used to remove example portion 26*a*, (including both example portion 26*a*1 and example portion 26*a*2, in the example, ('together')), or, if example removable portion 26*a*1 that comprises the whole perimeter of the blocking body is removed, (via use of example break arrangement 31*a*1), example break arrangement 31*a*2 can be used, (ie broken), in FIG. 2), to remove example portion 26*a*2, that comprises a whole perimeter of that which remains of the blocking body. (As stated, example break arrangement 31*a*2 could be used (ie broken), without example break arrangement 31*a*1 being used (ie broken), (thus resulting in the same result as if example break arrangement 31*a*1 was used (ie broken) first, and then example break arrangement 31*a*2 was used (ie broken) afterward)). (It should also be stated that, whilst the example embodiment shows two example break arrangements 31*a*, there could be more than two such break arrangements 31*a*, (ie that facilitate breaking off a portion that comprises a whole perimeter of the blocking body of the back blocking element. (It is feasible, for example, (mentioned simply by way of example only), that there could, for example, be a third such break arrangement 31*a*, for example, allowing for four (or more) different size 'modes', (rather than just the three different size modes shown in FIG. 13, for example. (This example is provided simply by way of example only))))).

Preferably, (rather than simply being defined as comprising 'a', (ie at least one) break arrangement), the blocking body preferably comprises a second break arrangement, configured for breaking, to facilitate breaking off a second portion of the blocking body, the second portion being of a predetermined shape, determined by shape and position of the second break arrangement. (ie Preferably the blocking body comprises more than one break arrangement). The example embodiment(s) in the Figures are examples of this, and FIG. 2 is clearly an example of wherein there is not simply only one break arrangement, (to facilitate breaking off a portion of the blocking body, the portion being of a pre-determined shape, determined by shape and position of the break arrangement), but there is more than one break arrangement, to facilitate breaking off different portions of the blocking body of a predetermined shape, determined by shape and position of the break arrangements. (Thus it can be stated that the example of FIG. 2 is an example of a back blocking element that comprises a first break arrangement, (configured for breaking, to facilitate breaking off a first portion of the blocking body the first portion being of a pre-determined shape, determined by shape and position of the first break arrangement); and a second break arrangement, (configured for breaking, to facilitate breaking off a second portion of the blocking body, the second portion being of a pre-determined shape, determined by shape and position of the second break arrangement). (Note: Use of the terms 'first' and 'second', (here used with reference to break arrangements), in no way means there cannot be a 'third' (or more). Therefore, stating that there is a 'first' break arrangement, and a 'second' break arrangement in no way limits that there can be only two break arrangements, and thus in no way means there cannot be three break arrangements, or four break arrangements, (or more)).

(Note: It should be stated, the terms 'first' (eg first break arrangement, for example) and 'second' (eg second break arrangement, for example) are used broadly, and are tantamount to saying 'one' (eg one break arrangement) and 'another/the other' (eg another break arrangement). Thus if the apparatus comprises more than one break arrangement, any of the break arrangements may be considered to be the/a 'first' (break arrangement) and any other of the break arrangements may be considered to be the/a 'second' (break arrangement). Therefore the terms 'first' and 'second' are used broadly, and no undue limitation should be read on such terms, (especially when used in a claim(s)). (So the same is the case for the term 'third', etc). (Note: This is the case when such terms are used to describe any feature, (eg portions 26, for example, (eg 'first' portion, 'second' portion, etc)), not limited to 'break arrangements', (which is used here simply by way of example))).

(It should also be stated, of course, (as has been stated), that example breaking arrangement 31*a*2 could be used (ie broken), thus removing both portions 26*a*1 and 26*a*2, in just one go).

Preferably, the blocking body comprises a third break arrangement, configured for breaking, to facilitate breaking off a third portion of the blocking body, the third portion being of a predetermined shape, determined by shape and position of the third break arrangement. (ie Preferably the blocking body comprises three (ie at least three) break arrangements). The example embodiment(s) in the Figures are examples of this, and FIG. 2 is clearly an example of wherein there are not just one, or two, break arrangements, but there is a third break arrangement, to facilitate breaking off a further (another) different portion, (a 'third' portion), of the blocking body of a predetermined shape, determined by shape and position of the third break arrangement. (In the example embodiment of FIG. 2, the example blocking body comprises; break arrangement 31*a*1; break arrangement 31*a*2; and break arrangement 31*b*. (In the example of FIG. 2, (as shown), breaking of example break arrangement 31*a*1 facilitates breaking off of example portion 26*a*1. In the example of FIG. 2, (as shown), breaking of example break arrangement 31*a*2 facilitates breaking off of example portion 26*a*. (If, (looking at FIG. 2 as shown in FIG. 2), example portion 26*a*1 has already been removed, (via breaking of example break arrangement 31*a*1), breaking of example break arrangement 31*a*2 would only break off example portion 26*a*2). In the example of FIG. 2, (as shown), breaking of example break arrangement 31*b* facilitates breaking off of example portion 26*b*. (All the example break arrangements are numbered '31', and all the example removable portions are numbered '26'. (Therefore, there are shown break arrangements 31, and removable portions 26). (As has been stated, if example portion 26*a*1 has already been removed, (via breaking of example breaking arrangement 31*a*1), breaking of example break arrangement 31*a*2, (with all else the same as shown in FIG. 2), results only in removing of example portion 26*a*2. Similarly, it should be said that, if break arrangement 31*a*1 has already been used, (to remove portion 26*a*1), then if example break arrangement 31*b* is used, then rather than it resulting in removing of the whole of example portion 26*b*, it will result only, in the example, in removing pf example portion 26*bx*, (because the rest of example portion 26*b* will have been removed, by virtue of example portion 26*a*1 having been removed. (Similarly, if example break arrangement 31*b* is used initially, (to remove example portion 26*b*), then some of example portion 26*a*1, (and some of example portion 26*a*2), will already have been removed, thus affecting how much of example portion 26*a*1 (and example portion 26*a*2) will be removed, by actual use of break arrangement 31*a*1 and break arrangement 31*a*2. Therefore various 'overlapping' (of removable portions) may occur))).

(It should be stated, (in no way limited to the example provided), that various break arrangements, (and thus various portions that can be removed) may, or may not, overlap). (For example, it is clear, (looking at FIG. 2), that example break arrangement 31*a*1 and example break arrangement 31*b* overlap). (It can be seen, however, in the example, that example break arrangements 31*a*1 and 31*a*2 do not overlap)). (Note: With reference to portions 26, use of terms such as 'first' portion, and 'second' portion, and 'third' portion, (etc), or terms such as 'different portion', does not, (in and of itself), preclude the portions from overlapping. For example, looking at FIG. 2, for example, it will be apparent that example portion 26*a*1, for example, and example portion 26*b*, for example, overlap. Nevertheless, for the sake of the present application, they are considered 'different portions', (and, in a claim, for example, one of the portions could be referred to/defined as a 'first' portion, and the other as a 'second' portion, (even though they overlap). That said, in other cases, portions may not overlap. (For example, (taken by way of example only), example portion 26*a*1 and example portion 26*a*2 do not overlap each other. They, too, are considered to be 'different portions', (and, in a claim, for example, could be referred to/defined as a 'first' portion, and a 'second' portion, for example). (Note, also, that in the example of FIG. 2, example portion 26*a* 'includes' example portion 26*a*1, (and therefore could be said to 'comprise' example portion 26*a*1). (Example portion 26*a* also 'includes' example portion 26*a*2), Even though example break arrangements 31*a*1 and 31*a*2 do not overlap, it could thus be considered that example portion 26*a*1 'overlaps' example portion 26*a*, (since example portion 26*a* includes within it the whole of example portion 26*a*1). Nevertheless, (and as stated), example portion 26*a* and example portion 26*a*1, for the sake of the present application, are considered 'different portions', (and, in a claim, for example, one of the portions could be referred to/defined as a 'first' portion, and the other as a 'second' portion))).

The/a removable portion 26 may be a portion of the blocking body that comprises a portion, (but not a whole), of a perimeter of the blocking body. (An example of this is shown most clearly in FIG. 2, example removable portion 26*b* being an example of a portion of the blocking body that comprises a portion, (but not a whole), of a perimeter of the blocking body. (Note: A portion of the blocking body that comprises a portion, (but not a whole), of a perimeter of the blocking body is not limited to the shape (or size) of the example shown. It will be apparent that a portion of the blocking body that comprises a portion, (but not a whole), of a perimeter of the blocking body may be of a significantly different shape and/or size to that of the example shown). This portion, (ie example portion 26*b*), in the example, can be removed via use of (ie breaking of) example break arrangement 31*b*. (Thus break arrangement 31*b* is an example, (provided by way of example only), of a break arrangement, configured for breaking, to facilitate breaking off a portion of the blocking body, wherein the portion, (ie example portion 26*b*, in the example), comprises a portion but not a whole of a perimeter of the blocking body). This removable portion comprises a portion of the perimeter of the blocking body, (as shown), but not the whole of the perimeter of the blocking body. (Removal of the (or any) portion(s) 26*b* can be useful for when the hole in the wall is in certain problematic positions, (eg when a wall stud would otherwise get in the way of the back blocking element being able to be positioned appropriately/successfully, to block the hole in the wall, behind the hole in the wall. (This situation could occur if the hole in the wall is very near to the side of the wall, or any place/position on the wall close to a wall stud). Removable portion(s) 26*b* can be removed, in such situations, to facilitate better positioning of the back blocking element, (to block the hole in the wall). This may be incredibly important, because, otherwise, in such situations, it may not be possible for the back blocking element to get into a position to appropriately/successfully block the hole, (and thus to stop filler agent being lost out of the back of the hole). (In the example, example break arrangement 31*b* is linear in shape, (ie a straight line). However, it is feasible, in other embodiments, the (or any such) break arrangement(s) may not be straight in shape). (Example portion 26*b* is an example of a side portion. Any removable portion 26 that comprises a portion, (but not a whole) of a perimeter may be referred to as a 'side portion', (even if it comprises (significantly) more of the perimeter of the blocking body, or comprises less of the perimeter of the blocking body, than in the example shown)).

(It has been stated that a portion of the blocking body that comprises a portion but not a whole of a perimeter of the blocking body is not limited to the shape (nor to the size) of the example shown, and it is also stated, in the present application, that the back blocking element is not limited to the shape (nor to the size) of the example shown. Thus, to make clear, (simply taking an example by way of example only), if a back blocking element were provided that was cubic in shape, (eg square, for example), and if there was a break arrangement provided, to facilitate breaking off just a corner of the blocking body, for example, this would also be an example of (and thus within a scope of) wherein the portion that the break arrangement facilitates breaking off comprises a portion but not a whole of a perimeter of the blocking body).

(Note: it is feasible the back blocking element comprises more than one break arrangement 31*b*, (ie that, via use of the break arrangement, facilitates removing a portion of the blocking body that comprises a portion (but not a whole) of the perimeter of the blocking body. Thus there may be more than one such portion 26*b*).

Preferably the blocking body comprises a first break arrangement, configured for breaking, to facilitate breaking off a first portion of the blocking body, wherein the first portion comprises a whole of a perimeter of the blocking body, and also comprises a second break arrangement, configured for breaking, to facilitate breaking off a second portion of the blocking body, wherein the second portion comprises a portion but not a whole of the perimeter of the blocking body. (All of the Figures that show the example back blocking element show this, and an example of this is most clearly shown in FIG. 2, (and FIGS. 13 and 14), (by virtue of example break arrangement 31*a*1 (or 31*a*2), and example break arrangement 31*b*). Most preferably, preferably the blocking body comprises: a first break arrangement, (eg example break arrangement 31*a*1, in FIG. 2), configured for breaking, to facilitate breaking off a first portion of the blocking body the first portion being of a pre-determined shape, determined by shape and position of the first break arrangement, wherein the first portion comprises a whole of a perimeter of the blocking body, (eg example portion 26*a*1, in FIG. 2); a second break arrangement, (eg example break arrangement 31*a*2, in FIG. 2), configured for breaking, to facilitate breaking off a second portion of the blocking body, (eg example portion 26*a*, in FIG. 2), the second portion being of a pre-determined shape, determined by shape and position of the second break arrangement, wherein the second portion comprises the first portion, and, with the first portion having been removed, (eg, looking at FIG. 2, with example portion 26*a*1 having been removed via breaking example break arrangement 31*a*1), what remains of the second portion comprises a whole perimeter of that which remains of the blocking body; and a third break arrangement, (eg example break arrangement 31*b*, in FIG. 2), configured for breaking, to facilitate breaking off a third portion of the blocking body, the third portion being of a pre-determined shape, determined by shape and position of the third break arrangement, wherein the third portion comprises a portion but not a whole of the perimeter of the blocking body, (eg example portion 26*b*, in FIG. 2). (An example of this is most clearly shown in FIG. 2).

Preferably the back blocking element is circular. In other embodiments, of course, the back blocking element may be a different shape.

(Note: In the example embodiment, (because of the example slit 24, and example removable side portion 26*b*), the example portion 26*a*1 (which is a portion that comprises a whole of the perimeter of the blocking body), itself comprises a plurality of 'sub-portions'. (Three 'sub-portions', in the example). (Example portion 26*a*2 also comprises sub-portions). However, in other embodiments, this may not be the case. For example, in an embodiment the same as what is shown in FIG. 2, but without break arrangement 31*b*, (there being no removable portion 26*b* that comprises a portion, but not a whole, of the perimeter of the blocking body), portion 26*a*1 would not have sub-portions, (although it would still be a portion that is separated at the example separation 69). (And so is the same, in the example, for portion 26*a*2). If a back blocking element were provided, similar or same to the example of FIG. 2, for example, but without a separation (eg without example slit 24 as shown in FIG. 2), and without a break arrangement 31*b*, (there being no removable portion that comprises a portion, but not a whole, of the perimeter of the blocking body), then portion 26*a*1 would not, in the example, have sub-portions, and would not be separated by any separation 69 at any point. (And so is the same, in the example, for portion 26*a*2). Thus it is shown that removable portion(s) 26 may be provided that comprise sub-portions, but that embodiments can be provided where a removable portion 26 does not have any sub-portions. (Similarly, example removable portion 26*b*, in the example of FIG. 2, comprises sub-portions, (there being two sub-portions, in the example, clearly shown in FIG. 2). However, embodiments may be provided wherein a portion 26*b*, (ie that comprises a portion but not a whole of a perimeter of the blocking body), does not have sub-portions. (This may be the case either due to lack of any break arrangements 31*a*, or due to positioning of break arrangement(s) 31*b*, (ie if the break arrangement 31*b* is 'outside' of any break arrangement 31*a*, with there being no 'overlapping' with any break arrangement 31*a*)). Thus various options and/or embodiments are possible).

Preferably the blocking body comprises a break arrangement, configured for breaking, to facilitate breaking off a portion of the blocking body that comprises a whole of a perimeter of the blocking body, (the number apportioned to such break arrangement(s), (where the break arrangement facilitates breaking off a portion that comprises a whole perimeter of the blocking body, in FIG. 2, being '31*a*'); and a break arrangement, configured for breaking, to facilitate breaking off a portion of the blocking body that comprises a portion, but not a whole, of the perimeter of the blocking body, (the number apportioned to such break arrangement(s), in FIG. 2, being '31*b*'). An example(s) of this is most clearly shown in FIG. 2, (and FIGS. 13 and 14)).

Figure 14:
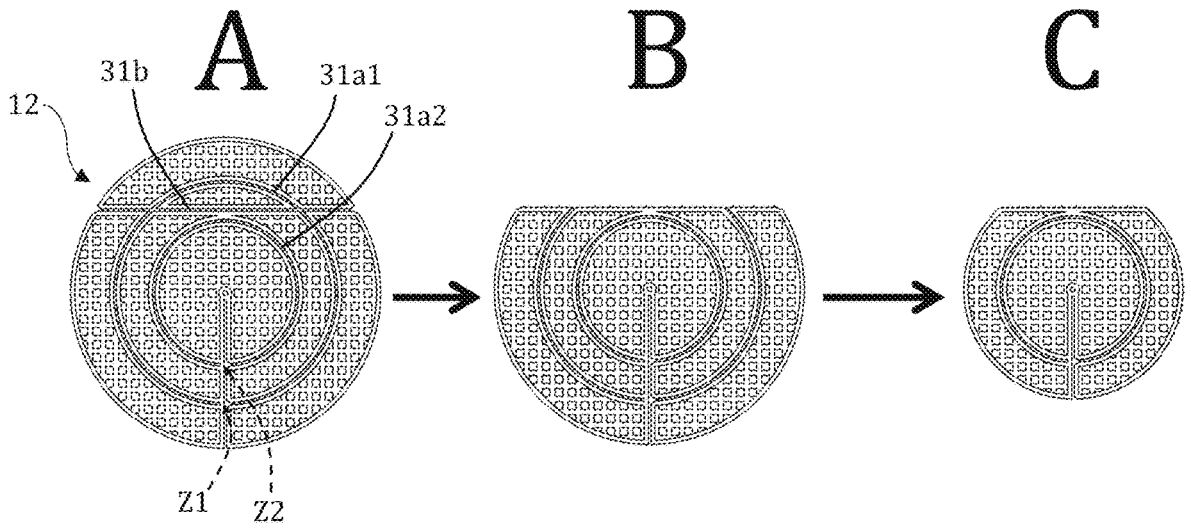
FIG. 14 is a front view of the same embodiment of FIG. 13, now showing various options a break arrangement(s) can provide, and particularly with reference to removing a portion of a blocking body of the blocking element that comprises a portion but not a whole of a perimeter of the blocking body.

(The example break arrangements, (provided simply by way of example only), can also be seen in FIG. 12, (and clearly in FIGS. 13 and 14). It can be seen, in the example embodiment, that the example break arrangements are breakable areas. (Thus, in the example embodiment, each example break arrangement is a breakable area). The breakable areas can be seen being of a particular shape and position. The break arrangements, in the example embodiment, are areas that are weaker (than other areas of the back blocking element), thus facilitating them being broken. It will be apparent that the example break arrangements are provided simply by way of example only, and various options and/or embodiments are possible. (In the example embodiment, the back blocking element is made of plastic(s), but in other embodiments, it may be made out of any relevant/appropriate material(s). Thus the example is an example wherein the back blocking element is made partially or wholly of plastic, (the particular example being made wholly of plastic). In other embodiments, it is feasible the back blocking element may, for example, be made partially or wholly of cardboard, for example, (and/or any relevant/appropriate material(s)). Thus, as stated, various options and/or embodiments are possible). (Note: For the sake of the present application, if a feature, (eg the back blocking element, here), is defined, (eg in a claim), as being made of a particular material, (eg plastic, for example), that includes within its scope the feature, (eg the back blocking element, here), being made out of multiple different types of the particular material, (eg multiple different types of plastic). Thus, if the back blocking element is defined, (eg in a claim), as being made of plastic, that includes within its scope the back blocking element being made out of just one type of plastic, and also includes within its scope being made out of multiple different types of plastic)).

Looking closer at the example break arrangements, in the example, (as an example break arrangement is labelled/numbered in FIG. 2), there is shown an example breakable area 97. In the example embodiment, there is shown example areas 96, (either side of the example breakable area). (In the example, these areas are 'stronger areas'. ('Stronger' here refers simply to them being stronger than the breakable area)). (This example is shown simply by way of example only). (More generally put, focus is drawn to an area at each side of the example breakable area). Thus this is an example, broadly speaking, of there being a breakable area. In the example embodiment, the blocking body being stronger on each side of the breakable area helps make sure the blocking body breaks exactly as expected/desired, when the break arrangement is used, (ie broken). (In the example, the example areas 96 are even stronger than other areas of the blocking body (ie areas that are not involved with the (or any) break arrangement(s)). However, this may not be the case in all embodiments, and the example is provided by way of example only. (For example, the rest of the blocking body, in other embodiments, may be as strong as the example stronger area, (or the stronger areas may be 'no stronger' than the rest of the blocking body (that is not involved with the (or any) break arrangement(s))). (Thus, another way of looking at it/stating it is that, (in other embodiments), there may be no difference in 'strength' between the areas either side of the breakable area, and the rest of the blocking body that is not involved with the (or any) any break arrangement(s). Thus, in various embodiments, there could be a breakable area 97, without there being areas of particular 'added' strength each side, (compared to the rest of the blocking body that is not involved with the (or any) break arrangement(s), for example). However, in the example embodiment, the example areas 96 are even stronger than other areas of the blocking body (ie areas that are not involved with the (or any) break arrangement(s)), and thus they are of particular 'added' strength, (in the example), (compared to the rest of the blocking body that is not involved with the (or any) break arrangement(s)). (In the example embodiment, example areas 96 are stronger than a portion or a whole of the rest of the blocking body (that is not involved with the (or any) break arrangement(s)))). (In the example embodiment, the example areas 96 are areas of added strength)). (To give another example embodiment, there could be a cardboard embodiment, (ie where the blocking body is made (partially, or wholly) of cardboard), and the break arrangement(s), for example, could comprise/be weakened area(s), (eg area(s) where the cardboard has been 'punched' and/or perforated, for example, to form (and thus provide) a break arrangement of a particular shape and position), to facilitate breaking the cardboard, (the area(s) thus being breakable area(s)). In another embodiment, (to give another example), the blocking body could even be made (partially or wholly) out of metal, (eg sheet metal, for example). The break arrangement(s) could, for example, be created by way of (or at least including the method of, for example) the (preferably sheet) metal being 'pressed', (eg machine pressed), to thin the metal, to facilitate it being broken. Thus it could feasibly be pressed, to weaken it. (This is just one way a material, (not limited to metal), could be weakened, to facilitate creating a break arrangement). (This method/technique, (ie 'pressing', could even be used for other material(s), other than metal, to facilitate creating the (or any) break arrangement(s)). Thus various options and/or embodiments are possible). Within the breakable area, (in the example embodiment), the blocking body is attached together with example attaching portions 98, (only several of which are numbered in FIG. 2). (Thus this is an example of wherein the break arrangement comprises attaching portions). (In the example, the example attaching portions are small). (In the example, the attaching portions are made of plastic, but in other embodiments, they could be made of any relevant/appropriate material(s)). In the example embodiment, there are example gaps 93 between the example attaching portions 98. (Therefore, in the example embodiment, (provided by way of example only), there are alternating gaps 93 and attaching portions 98). The break arrangement may, or may not, comprise gap(s) 93. (In other embodiments, there need not be a plurality of attaching portions, and it is feasible, for example, that the blocking body is attached continuously, at the break arrangement. Thus there may, for example, be only one attaching portion, (rather than a plurality). Thus there could be just one attaching portion, (and no gaps). However, it is preferred, (as seen in the example of FIG. 2, for example), that there are a plurality of gaps 93, because this can help make the break arrangement easier to break. Thus the example is provided by way of example only)). (In any embodiment, (whether it be plastic and/or cardboard and/or metal, etc, (or any other material(s)), there may, or may not, be gap(s) 93). In the example, the blocking element is configured so the plurality of attaching portions are relatively easy to break. Thus the break arrangement facilitates breaking the blocking body, in a predictable manner. (It will be apparent that the example embodiment is provided by way of example only, and various options and/or embodiments are possible, (to facilitate the blocking body being breakable in a predictable manner). Therefore there are various different possibilities for how the (or any) break arrangement(s) may be provided. (Embodiments may feasibly be provided where there is an area of added strength, (the example area 96 numbered in FIG. 2 being an example embodiment, (provided by way of example only), of an area of added strength), only on one side, (eg on an 'inner' side, or on an 'outer' side) of the breakable area. (It has been stated that the example areas 96, in the example embodiment of FIG. 2, for example, are 'stronger than other areas of the blocking body (ie areas that are not involved with the (or any) break arrangement(s))'. Note: To make clear, in the example embodiment, it is here stated that, in the example, example areas 96 are stronger than 'an area' (ie 'at least one area) of the blocking body that is not involved with the (or any) break arrangement(s). (This is stated since it is feasible, for example, that there may be another area(s) of the blocking body that, (for whatever reason), (and even if there is 'an area' that is not as strong as example areas 96), may be as strong as (or stronger than) areas 96). Thus, if there is even one area of the blocking body (not involved with the (or any) break arrangement(s)) that example area 96 are stronger than, then that is within a scope of the areas 96 being 'stronger than an area of the blocking body that is not involved with the (or any) break arrangement(s)', (even if there are other area(s) of the blocking body that are not involved with the (or any) break arrangement(s) that are, in fact, as strong as, (or stronger than) areas 96). (Another way of saying this, (ie rather than saying stronger than 'an area' that is not involved with the (or any) break arrangement(s), is to say stronger than 'a portion or a whole' of the rest of the blocking body, that is not involved with the (or any) break arrangement(s). Thus the terminology 'a portion or a whole' may be used, (rather than using the terminology of 'an area'). Thus that is clarified here). (In the example embodiment, (provided by way of example only, example areas 96 may be described as 'walls'. Thus, in the example embodiment, (provided by way of example only), the example break arrangement(s) comprise a breakable area, and a wall on each side of the breakable area. The example wall(s) are provided by way of example only. (In other embodiments, they may be of different size and/or shape and/or girth, etc). The walls, (as will be apparent on viewing the example embodiment, (eg in FIG. 2), play a role in the blocking body breaking in a predictable manner, (at the break arrangement(s)). Thus they can play a role in greatly increasing, (or even ensuring), that the break arrangement(s) break, as desired). (In other embodiments, the (or any) wall(s) may not be continuous. (The examples shown run continuously, along the breakable area, (except, (in the example embodiments), for where they intersect with another break arrangement or a separation 69, (which can be clearly seen in FIG. 2)). But in other embodiments, the wall(s) may be broken up into parts, (rather than running continuously). Thus it may run non-continuously. Thus there may be an area(s) of added strength, at a side(s) of the breakable area, but which does not run continuously along the breakable area. (Preferably, (if non-continuous), an area of added strength runs along at least one quarter of the breakable area, in total, (ie tallying up the total distance of the different 'parts'). Preferably, (if non-continuous), an area of added strength runs along at least one third of the breakable area, in total. Preferably, (if non-continuous), an area of added strength runs along at least one half of the breakable area, in total. Preferably, (if non-continuous), an area of added strength runs along more than half of the breakable area, in total. Preferably, (if non-continuous), an area of added strength runs along at least three quarters of the breakable area, in total)).

Thus disclosure has been provided, relating to there being an area of added strength on one side, (or both sides), of the breakable area. As stated, the area of added strength may run continuously, (along the breakable area), or may not. Thus significant disclosure has been provided, relating to this.

Thus disclosure has been provided of an area on each side of the example breakable area. The example embodiment, (provided by way of example only), is an example of wherein a portion or a whole of one of the areas, (ie on one side of the breakable area), or a portion or a whole of both areas, (ie on both sides of the breakable area), is of added strength, (compared to a portion or a whole of the rest of the blocking body, that is not involved with the (or any) break arrangement(s)). (The embodiment of FIG. 2 is clearly an embodiment of this, (provided by way of example only). The example embodiment, (provided by way of example only), is an example of wherein a portion or a whole of one of the areas, (ie on one side of the breakable area), or a portion or a whole of both areas, (ie on both sides of the breakable area), is of stronger, (compared to a portion or a whole of the rest of the blocking body, that is not involved with the (or any) break arrangement(s)). (Thus this is an example of wherein a portion or a whole of one or both sides, (ie on one, (or both), side(s) of the breakable area), is of added strength. Thus this is an example of wherein a portion or a whole of one or both sides, (ie on one, (or both), side(s) of the breakable area), is stronger). There are various options and/or embodiments for how a portion or a whole of one (or both) side(s) may be of greater (comparative) strength. In the example embodiment of FIG. 2, for example, example areas 96 are thicker, (compared to a portion or a whole of the rest of the blocking body, that is not involved with the (or any) break arrangement(s)). (They are of added thickness, in the embodiment of FIG. 2). (Thus the blocking body is thicker, at example areas 96, (compared to a portion or a whole of the rest of the blocking body, that is not involved with the (or any) break arrangement(s)). (Whilst the example embodiment is made of plastic, it is feasible this option, (ie 'thickness'), may be provide/used, for any other embodiment(s), (and not limited to plastic)). Thus the example embodiment is an example of wherein a portion or a whole of one (or both) side(s) is thicker. (Thus the example embodiment is an example of wherein a portion or a whole of one (or both) side(s) is of added thickness). The example embodiment is an example of wherein, in the example, most, (or a whole), of both sides is thicker. (The example embodiment is an example of wherein, in the example, most, (or a whole), of both sides is of added thickness). (Note: In the example embodiment, there are intersection(s). For example, there are place(s) where two break arrangements 'intersect' in FIG. 2. Due to this, there are places, in the example embodiment, where, where there would otherwise be an area(s) 96, (eg a wall(s), in the example), at each side of the example break arrangement(s), there is in fact no area(s) 96, because the break arrangement is intersecting with another break arrangement. (Instead, there are point(s) where, to a side(s) of the breakable area, there is simply a different breakable area. An example of this, (just to take one example, for example), is towards a top left of the example embodiment of FIG. 2, (at point X1), where example break arrangement 31*a*1 and example break arrangement 31*b* intersect. It can be seen, where they intersect, that the example areas 96 of each are 'not present' for a (small) distance. Thus, with reference to the example embodiment, it can be stated that, in the example, 'a whole of both sides is thicker', and 'a whole of both sides is of added thickness', with the exception of the example intersection(s). (Note: It should be stated it is feasible there in fact could be an area(s) 96 at an intersection. However, this may make one (or both) of the breakable areas that intersect (slightly) less easy to break. Thus various options and/or embodiments are possible). (Of course, in some embodiments, depending on the nature of the break arrangements, (ie their shape and position), (and whether there are even a plurality of them), there may not be any intersection(s). Thus, in such a case, it is feasible that, truly, embodiments may be provided where statements such as 'a whole of one, (or both) side(s) may be thicker', and 'a whole of one, (or both) side(s) is of added thickness' are appropriate, (and are possible). (It should also be stated, in the example embodiment, there are also place(s) where a break arrangement(s) intersects with an example separation 69. However, looking at the example embodiment of FIG. 2, it will be apparent that, if an embodiment is provided where there are no separations 69, there would be no intersection(s) with any separation 69. Looking at FIG. 2, (and imagining there was no separation 69, it would be apparent the example break arrangement 31*a*2, (taken simply by way of example only), would be an example of a break arrangement where there are no intersections. It would be an example of a break arrangement that is continuous, (with no intersections). This is just one example of how a break arrangement(s) may be provided, without intersections. This is just one example, (and is an example of how a break arrangement that facilitates removing a portion of the blocking body that comprises a whole of a perimeter of the blocking body would be continuous. However, it should also be stated that a break arrangement that facilitates removing a portion of the blocking body that comprises a portion (but nor a whole) of the perimeter of the blocking body could also have no intersections. For example, looking at FIG. 2, is example break arrangement 31*a*1 was not present, example break arrangement 31*b* would be an example of a break arrangement where there are no intersections. Thus various options and/or embodiments are possible). What is shown is an embodiment wherein a portion or a whole of one (or both) side(s) is thicker than a portion or a whole of the example breakable area. (The example embodiment is an embodiment wherein one (or both) is thicker). (Note: Where relevant, in the present application, use of the term 'a portion or a whole' supports definition, (eg in a claim), of 'at least half', and supports definition, (eg in a claim), of 'most'. (It should also be stated, where relevant, in the present application, use of the term 'a portion or a whole' supports definition, (eg in a claim), of 'at least one quarter', and 'at least one third', and 'at least two thirds', and 'at least three quarters). What is shown is an embodiment wherein a portion or a whole of one (or both) side(s) is thicker than a portion or a whole of the rest of the blocking body. What is shown is an embodiment wherein a portion or a whole of one (or both) side(s) is thicker than a portion or a whole of that of the rest of the blocking body, that is not involved with any break arrangement(s)).

However, thickness is only one option/possibility, in terms of 'strength'. Another option, for example, is for a portion or a whole of one (or both) side(s) to be made of a stronger material(s). Thus, for example, looking at the example of FIG. 2, if a portion or a whole of one (or both) example area(s) 96 was made of a stronger type(s) of plastic, (or any (relevant) stronger material(s), not limited to plastic), then this would also be a way to provide added strength. (The example of plastic is provided by way of example only, and use of stronger material(s) is in no way limited to embodiments of blocking bodies that are plastic, and is in no way limited to plastic). Thus a portion or a whole of one (or both) side(s) may be of stronger material(s), (eg stronger plastic, for example), to provide strength). Thus a portion or a whole of an area(s), (on one, (or both), side(s) of the breakable area), may be of stronger material(s) (eg stronger plastic, for example, (provided by way of example only)), than a portion or a whole of rest of the blocking body. Thus a portion or a whole of one (or both) side(s) may be made of a stronger material(s) than a portion or a whole of the rest of the blocking body. (An embodiment wherein a portion or a whole of one (or both) side(s) is made of a stronger material(s) than a portion or a whole of the rest of the blocking body not involved with any break arrangement(s) would be an example of this. (An embodiment wherein a portion or a whole of one (or both) side(s) is made of a stronger material(s) than a portion or a whole of the breakable area would be an example of this)). FIG. 2 is an example embodiment of wherein a portion or a whole of one (or both) side(s) is stronger than a portion or a whole of rest of the blocking body that is not involved with The (or any) break arrangement(s). FIG. 2 is an example embodiment of wherein a portion or a whole of one (or both) side(s) is of added strength than a portion or a whole of rest of the blocking body that is not involved with the (or any) break arrangement(s). (It should also be stated, a combination of thickness, and use of stronger material(s), is possible. Thus various options and/or embodiments are possible. (Thus there are various options and/or embodiments for how strength may be provided to a portion or a whole of on one, (or both), side(s)). (Note: When the term 'added' is used in phrases such as 'added strength' and 'added thickness', the word/term 'greater' may be used, instead). (Thus, it is shown, in the example embodiment(s), (provided by way of example only), with reference to the example break arrangement(s), that strength, at the border(s), (shown by way of example only), can be particularly beneficial).

(In the example embodiment(s), (labelled/numbered in FIG. 2), there is provided a feature(s), to help start breaking the example break arrangement. In the example embodiment, the feature(s) is (and thus comprises) a void 77. (There are four such voids shown in the embodiment of FIG. 2, which are numbered 77*a*, 77*b*, 77*c*, and 77*d*). The void(s) can be seen at a start of the example break arrangement(s). This feature(s) makes it easier to start breaking the breakable area. (Note: A break arrangement may feasibly have more than one 'start' point, (eg see example break arrangement 31*b*, where breaking can be started both at a left side, (in the view of FIG. 2), and also at a right side. Thus it may be stated that there may be feature(s), to help start breaking the breakable area, at an end(s) of the break arrangement. (Example break arrangement 31*b* is an example where there is an example void 77, to help start breaking, at both ends). (The examples shown in FIG. 2 are an example of wherein there is a void 77 at an end(s), (ie one, ore more than one, end), of the break arrangement. In the example embodiment, the void is pointed in shape. (It comprises a point, in terms of its shape). This is thought to be particularly helpful, for starting the breaking process. However, the (or any) void(s) is not at all limited to this shape. The void(s) may feasibly be of a different shape and/or design, and it is not limited to being triangular and/or pointed. Thus various shapes and/or designs are possible).

Looking at FIG. 13, the options that example break arrangement 31*a*1 and example break arrangement 31*a*2 provide is shown. (Note: The example 'options' shown in FIGS. 13 and 14 may also be referred to as 'modes'). Option/mode 'A', (denoted with a large 'A' above the example back blocking element), shows the back blocking element, with neither break arrangement 31*a*1 nor example break arrangement 31*a*2 having been used, (ie not having been broken). Option/mode 'B' then shows the back blocking element with example break arrangement 31*a*1 having been used, (ie broken), (and portion 26*a*1, (as it is labelled/numbered in FIG. 2), having been removed). Option/mode 'C' then shows the back blocking element with example break arrangement 31*a*2 having been used, (with portion 26*a*, (as it is labelled/numbered in FIG. 2), (ie portions 26*a*1 and 26*a*2), having been removed). Thus it is clearly shown how the break arrangements can be used, (and how this can be particularly useful for using the back blocking element with different sized holes). (As stated multiple times in the present application. Mode 'C' can be achieved, in the example embodiment, without using, (ie breaking), example break arrangement 31*a*1, and simply by only using, (ie breaking), example break arrangement 31*a*2).

Looking at FIG. 14, the options/modes that example break arrangement 31*b* provides is shown. Option/mode 'A', (denoted with a large 'A' above the example back blocking element), shows the back blocking element, without break arrangement 31*b* having been used, (ie without it having been broken). Option/mode 'B' then shows the back blocking element with example break arrangement 31*b* having been used, (ie broken), (and portion 26*b*, (as it is labelled/numbered in FIG. 2), having been removed). Option/mode 'C' then shows the back blocking element with example break arrangement 31*b* having been used, (ie broken), and example break arrangement 31*a*1 having been used, (the example blocking body therefore being of an even smaller size than option 'B'.

(Note: The back blocking element embodiment shown in FIGS. 13 and 14 is the same as the embodiment of FIG. 2, except for a very slight difference at points Z1 and Z2).

(Note: As will be apparent, in light of the disclosure of the present application, (including the drawings), the front blocking element and the back blocking element may be provided in a variety of shapes and/or sizes and/or designs, not at all limited to the example shown. Thus various options and/or embodiments are possible).

Preferably, a portion or a whole of the front blocking element is transparent. This may be important, to be able to see the filler agent, as it starts to fill the hole in the wall. Preferably, at least half, (or more than half, or a whole), of the front blocking element is transparent. (The example embodiment in FIG. 4 is an example within the scope of wherein at least half, (or even a whole), of the front blocking element is transparent).

Figure 3:
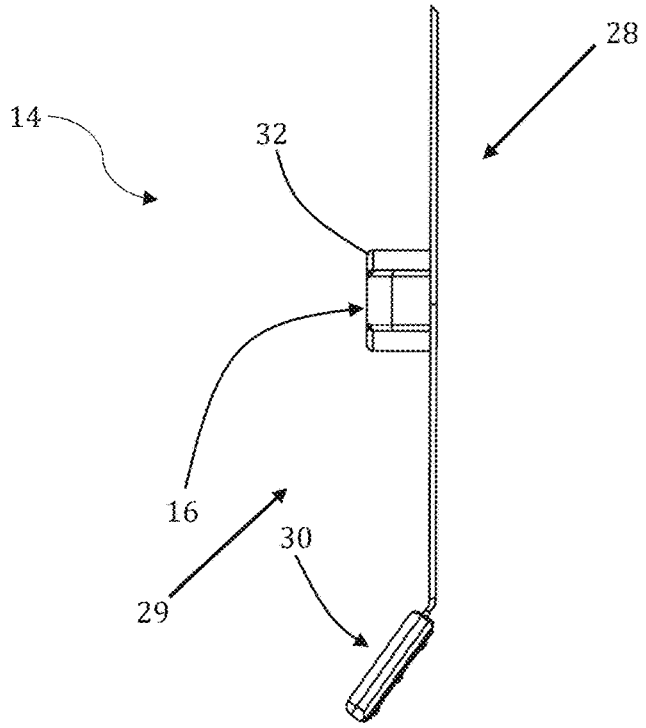
FIG. 3 is a side view of the example front blocking element.

Preferably at least half, (or more than half, or all), surface area of a wall-facing side 28 of the front blocking element is flat. (This is the case in the example embodiments shown). Examples of this are clear in many of the Figures, and this is particularly apparent in FIG. 3, for example. In FIG. 3, it is clear that at least half, (or more than half, or all), of the wall-facing side of the front blocking element is flat. Thus this is an example of wherein at least half, (or more than half, or all), of a wall-facing side of the front blocking element is flat. (It is clear that the example front blocking element of FIG. 3 engages flat against the wall). Preferably, at least ninety percent of the wall-facing side of the front blocking element is flat. This can be useful for various reasons. Firstly, it may help the filler dry substantially flat to the wall surface. Secondly, it may facilitate using the front blocking element as a smoother. Thus, after the wall repair kit has been used, for example, some more filler, (of the same type, or different—any appropriate filler agent to smooth the surface of the repair to the wall)), may be used, and the front blocking element may thus be used, for smoothing, (to smooth the finish on the wall). (It should also be noted, if the filler agent is left for an appropriate time, (eg for quick-drying filler agent, perhaps 20-30 minutes, for example), the filler agent may have dried into a solid state, (such that the front blocking element can be removed and the filler agent retains its shape, filling the hole), but may not be absolutely 100% solid, such that it can be smoothed, (eg by the front blocking element). (It may be possible to carry out smoothing, (whether it is done using the front blocking element, or not), without any more (ie 'extra') filler agent being used). ('Smoothing' is a step that is not limited to using the front blocking element). In such case, it may be possible to smooth the filler agent, (without using any more filler agent). Thus it may be possible to smooth over any hole (eg left by the connecting element), and/or any other imperfections in the surface. (Note: For the sake of the present application, the filler agent is considered to have dried (from a non-solid to a solid state), in such a situation, (ie where the front blocking element can be removed, and the filler agent is in a solid enough state that it retains its shape, filling the hole). Thus, even if it is not 100% solid, and can therefore be 'smoothed', this is still considered to be an example of wherein the filler agent has dried from a non-solid state, to a solid state). If the filler agent is left to become absolutely 100% solid, (such that it cannot be 'smoothed'), in some cases, imperfections in the surface may need to be removed. This could be done, for example, by sanding the dried filler agent surface, (or via any other way of improving the surface). ('Sanding' is one example of removing imperfections in the repair, to create a flatter finish). Thus flattening of the surface may be undertaken. Whether smoothing of the filler agent used to fill the hole in the wall is possible or not, more filler agent, (eg of the same type, or different—any appropriate filler agent to smooth the surface of the repair to the wall) may be used. Thus, for example, any hole left by any connecting element may be covered with the filler agent used for filling the hole in the wall, or with more filler agent, (eg of the same type, or different—any appropriate filler agent to complete the surface of the repair to the wall may be used).

(Note: In wall repairing, the term 'spatula' is often used for an apparatus/device that is used to smooth over a wall hole repair. Thus, in the example embodiment, the front blocking element may be used as a 'spatula').

Preferably the front blocking element comprises a raised portion 30. In the example, there is a gap between the wall and a portion or a whole of the raised portion 30, in use). (An example of this is best shown in the side view of FIG. 3). (It can be seen, (in FIG. 3) that a portion of a whole of the raised portion 30 is angled away from the wall, (or at least would be, when the front blocking element is blocking the hole in the wall). In the example, the raised portion is at an approximately 45 degree angle, (with reference to the wall, (and with reference to a face of the front blocking element that engages the wall). However, in other embodiments, a portion or a whole of the raised portion may be at a different angle, (eg 90 degrees, (with reference to the wall, (and with reference to a face of the front blocking element that engages the wall), for example, (or any relevant/appropriate angle)). Thus various options and/or embodiments are possible. (What is shown (ie feature 30) is thus an example of an outwardly protruding portion. It will be apparent that an outwardly protruding portion can be useful in helping to remove the front blocking element from the wall).

Preferably the front blocking element comprises a handle 32. (An example(s) of this is best shown in FIG. 1). The example is shown by way of example only, and it will be apparent that a wide array of sizes and/or shapes and/or designs are possible, for the or any handle. Furthermore, positioning of the handle is shown by way of example only, and it will be apparent that the or any handle, in other embodiments, may be located in a different position.

The example handle is an example of wherein a portion or a whole of the handle is provided within a perimeter of the blocking body of the front blocking element. (In the example(s) in the drawings, a whole of the example handle is provided within the perimeter of the blocking body of the front blocking element). (An example(s) of this is best shown in FIG. 1, (and also best shown in FIGS. 3, 4 and 6)).

However, it should be stated, in other embodiments, it is feasible a portion or a whole of the/a handle, (from a front view), could be (eg extend out, for example), outside of a perimeter of the front blocking element. Thus various options and/or embodiments are possible, and the example(s) shown are provided by way of example only. (The example is an example of a handle that protrudes from the outward-facing side of the front blocking element. It is an example of a protruding handle).

Preferably the wall repair kit further comprises a filling agent 36, for filling the hole in the wall. In the example embodiment, provided by way of example, in the sequence of FIGS. 7 to 9, the filler agent is a filler agent that is dryable from a non-solid state to a solid state. (Examples of a non-solid state include liquid, gel, etc). It will be apparent that drying into a solid state is extremely important, for repairing a hole in the wall. Preferably the filler agent is quick drying. (Preferably it dries into the solid state in approximately fifteen minutes, for example). (Note: As will be shown, the filler agent may be provided by way of a powder, for example, to which water can be added, to form the filler agent (of a non-solid state, which is dryable into a solid state). (Note: A 'powder' for example, is an example of what will be referred to as a 'filler base agent' (ie a 'base agent'), the term 'filler base agent' here defined, (for the sake of the present application), as any agent to which water can be added, to form a filler agent that is dryable from a non-solid state to a solid state. Therefore whether the 'filler base agent' is powder and/or, and/or in tablet form (ie tablet(s), for example, (or any relevant form), that is considered within the scope of being a 'filler base agent', (if, with the addition of water, it can be turned into a filler agent that is dryable from a non-solid state to a solid state). Furthermore, any 'filler base agent' is itself considered, (for the sake of the present application), to be a 'filler agent', (since it is an 'agent' which has a purpose of 'filling' the hole in the wall). Once water is added to such a filler agent, the result is a filler agent that is 'dryable from a non-solid state to a solid state'. Thus any 'filler base agent', (which is a term used for any agent to which water is added, to form a filler agent that is dryable from a non-solid state to a solid state), is itself considered, for the sake of the present application, to be an example of a 'filler agent', (and thus to be within a scope of such a term). (The inherent benefits of providing a filler agent to which water must be added will be apparent, since the user can simply add water, (eg tap water, for example), to form the filler agent that is dryable from a non-solid state to a solid state). (FIGS. 7 to 9 show a sequence demonstrating (in FIGS. 8 and 9) use of a filler agent that is dryable from a non-solid state to a solid state, (to fill the hole in the wall). Note: Whether the filler agent is provided to the user already as a filler agent that is dryable from a non-solid state to a solid state, (ie without even needing water to be added by the user), (eg if a container was provided to the user already containing a filler agent that is dryable from a non-solid state to a solid state), or whether a filler base agent is provided which, with addition of water, becomes the filler agent that is dryable from a non-solid state to a solid state, this is an example of wherein, 'in use', the filler agent is dryable from a non-solid state to a solid stat). Therefore when using the term 'wherein, in use, the filler agent is dryable from a non-solid state to a solid state', this includes within its scope the filler agent that is dryable from a non-solid state to a solid state having been initially provided as a filler base agent, (to which water must be added by the user, to make the filler agent that is dryable from a non-solid state to a solid state), and also includes within its scope the filler agent that is dryable from a non-solid state to a solid state being provided to the user as a filler agent that is dryable from a non-solid state to a solid state, without even needing water to be added by the user).

Preferably there is provided a container 38 for the filling agent. (Any type of container may be provided. For example, the container may be a bottle, or a tube, or a bag, etc). In the example, the container is squeezable. (In the example embodiment(s) in the drawings, the container is a bag-type container. Thus, in the example, embodiments, the container comprises a bag body, (for containing the filler agent). This may be a particularly useful embodiment, to facilitate 'squeezing' the filler agent out of the container. (Preferably the bag body is transparent, (so the user can see how much filler agent is in the container). This may be helpful so the user can see if they are getting close to running out of filler agent). However, in other embodiments, (rather than a bag-type container, for example), the container may be a bottle-type container. (For example, it may be similar to a shampoo bottle, for example). (Again, preferably a portion or a whole of the container body, (whether it be a bag body, or not), is transparent). (An example of outputting filler agent out of the container, into the hole in the wall, is generally shown and/or denoted in the sequence of FIGS. 7 to 9, where, in the example, filler agent is shown being inputted (especially in FIG. 8, which shows part of the way through the process) into an example hole in an example wall, via outputting the filler agent from the example container). It will be apparent that squeezing the container is a very effective way for how to achieve this. (Broadly stated, then, filler agent is shown being inputted into the example hole in the wall, in FIG. 8). (Note: The container is not shown being greatly deformed (by the squeezing) in FIGS. 8 and 9. (However, it should be stated, (especially in bag-type containers, where the container comprises a bag body, for containing the filler agent), the container may be highly deformed in the process. However, it should be stated that, for 'bottle-type' containers, the container may, (like a shampoo bottle, for example), be of resilient shape, such that it may generally be similar or same in shape, even during (and after) use. A 'bag-type' container, however, may be heavily deformed, (just as a plastic shopping bag, for example, would be heavily deformed, if used for such a use, and if filler agent was 'squeezed' out of it, to be outputting into the hole in the wall. Thus various options and/or embodiments are possible).

In the example, (provided simply by way of example only), the container comprises two compartments 40. (These may broadly be defined simply as 'areas' 40. Thus, in the example embodiment, the container comprises two areas 40). In the example embodiment, in one compartment (compartment 40*a*), (ie area 40*a*), in the example, is a filler compound, (which is an example of a 'filler base agent', (ie a base agent to which water can be added, to create a filler agent that is dryable from a solid state, to a non-solid state)). (In the example, the filler base agent is a plaster compound, (and is thus an example of a filler base agent, wherein the filler base agent is a plaster base agent). (This is an example embodiment, in the example, of a powder, to facilitate creation of a filler agent that is dryable from a solid state to a non-solid state). In another compartment (compartment 40*b*), (ie area 40*b*), in the example, the compartment (ie area) is either empty, (and can be filled with water), or contains water. (Thus it could be provided to the user, (eg at point of purchase) already pre-filled with water, or water could be added by the user). In the example, (provided by way of example only), there is a membrane between the two areas 40*a* and 40*b*. The membrane is an example of a barrier. But any barrier(s) may be provided). In the example, the example barrier can be broken/breached, (thus allowing the water and the filler agent to mix, (to form a filler agent that is dryable from a solid state to a non-solid state). (Thus it is an example of a breakable barrier). In the example, the membrane can be burst, (or in any way broken/breached), thus mixing the filler compound, (which is an embodiment of a filler agent), and the water, forming a filler agent that is dryable from a solid state to a non-solid state. As will be shown, the resulting mix can then be used, (as the filler agent that is dryable from a solid state to a non-solid state), to fill the hole. (Note: The membrane is just one example of wherein there is a breakable barrier between the example two example areas. Any barrier(s) may be provided, not limited to the example of a membrane. Membranes tend to be fairly soft in nature, (eg made partially or wholly of soft plastic, for example). However, a harder barrier(s) (of a harder material(s)), may feasibly be provided. Thus any barrier(s) may be provided, not limited to the example(s) provided/given. The examples of breakable barrier(s) are provided by way of example only, and any breakable barrier(s) may be provided).

(Note: It is feasible, in other (similar) embodiments, that a similar/same result may be achieved, without there being two compartments (ie areas). For example, the container may contain a filler agent (that water can be added to, to create a filler agent that is dryable from a non-solid state to a solid state), (such as the/an example powder, as in the example embodiment shown), and the user may be able to add water to the filler agent, (to create a filler agent that is dryable from a non-solid state to a solid state), without there being another separate compartment (ie area) for the water. In such an example, the container may, for example, have an indicator(s) (eg a line, for example), (or any means to indicate to a user how much water to add), to denote how much water should ideally be added to the filler agent (that water can be added to, to create a filler agent that is dryable from a non-solid state to a solid state), to help the user add the right amount. Thus various options and/or embodiments are possible). (Note: Another example of a means to denote how much water should ideally be added to the filler agent could, for example, simply be a dent(s) in the container, for example, or a portion of the container where the container changes shape, (eg a portion where the container broadens or narrows, for example). Any indicating means may be provided).

(It should also be stated, it is also possible that the filler agent (that is dryable from a non-solid state to a solid state) may be provided in the container, without requiring any addition of water, (ie simply in a form that it can be used for inputting into the hole in the wall, without requiring addition of water, and then will dry, once inputted into the hole in the wall, (ie thus being dryable from a non-solid state, to a solid state). (Thus, for example, the container may contain a paste, for example, (a 'paste' is an example of a non-solid state), that can be inputted into the hole in the wall, and then will dry into a solid state, once inputted into the hole in the wall. Thus various options and/or embodiments are possible)).

Preferably the wall repair kit comprises a filler agent, to fill the hole in the wall; and a container, to contain the filler agent; wherein the container is removably attachable to the front blocking element. (The example embodiment(s) in the drawings is an example of this, and this is best shown/alluded to in FIGS. 6 to 9). Thus, in the example, the container is removably attachable to the front blocking element. (FIGS. 1 and 6 show the example container, not attached to the front blocking element. FIGS. 7 to 9 show the example container, attached to the front blocking element, (via an example attachment arrangement)). Most preferably, preferably the container is removably attachable to the front blocking element, into a filling position. This is most clearly shown by virtue of FIGS. 6 and 7, where it can clearly be seen that, in the example, the container is removably attachable to the front blocking element, into the filling position. (In FIG. 6, the container has not been attached to the front blocking element, (but the example feature(s) to facilitate this are clearly shown (and apparent) in the Figure), and in FIG. 7, the container has been attached to the front blocking element, and is clearly in the filling position). As shown by virtue of FIGS. 8 and 9, all that is required now, in the example embodiment, is to output filler agent from the container, into the example hole in the wall. (In the example embodiment, this is achieved via squeezing the container. However, in other embodiments, it is feasible this may be achieved in other way(s). (For example, (similar to some rigid toothpaste tubes, for example), the container could comprise a mechanism(s) to facilitate pushing the filler agent out of the container, thus outputting it. Thus various options and/or embodiments are possible). The elegance of such functionality will be apparent. Attaching the container to the front blocking element, into the filling position, is thus differentiated from mere attaching of the container to the front blocking element; for example, a container could be attached to the front blocking element, (but not into a filling position). This may be useful, for storage etc, but is not useful for actually facilitating the user in outputting the filler agent from the container, into the hole in the wall. The example shown most clearly in FIGS. 7 to 9, however, is a clear example of the container being attached to the front blocking element, into a filling position. This clearly is useful for actually facilitating the user in outputting the filler agent from the container, into the hole in the wall.

(Note: An example of the container being removably attachable to the front blocking element, but not 'into a 'filling position', for example, would be if the container could be clipped to the front blocking element, (or attached in any way, not limited to 'clipping'—eg magnetically, and/or via Velcro®, and/or any other way), but in a position that does not facilitate inputting of filler agent into then hole in the wall. As stated, this may be useful for storage reasons, for example, or for any other reason(s). However, the container being removably attachable to the front blocking element, into a filling position, has significant advantages, (as are clear, by virtue of the drawings).

(Note: Whilst examples are shown wherein the container is removably attachable into a filling position, the term 'filling position' is not limited to requiring 'removable attachability'. For example, if an embodiment such as that shown in FIG. 6 was provided, but wherein there were no features to facilitate the container being removably attachable, (eg wherein the example outputting portion of the container is simply received into the example input aperture, but the container is in no way removably attachable to the front blocking element, then the example outputting portion being received into the example input aperture would still be the container being in a 'filling position'—it would simply be an example of the container being in a filling position, but not being removably attachable to the front blocking element).

Note: In the example shown in the Figures, the example screw thread 44 of the container is also used to facilitate removing (and re-attaching, if required/desired) the top of the container 38, (ie the top that covers the example output aperture of the container). (This is shown clearly, in the example of FIG. 10, where an example container top 131 is shown, cross-sectionally). Thus this is an example of wherein the container comprises an attachment feature to facilitate the top of the container being removably attachable, wherein the attachment feature is usable to facilitate removably attaching the container to the front blocking element. (The container may feasibly comprise more than one attachment feature, (to facilitate the top of the container being removably attachable), that is usable to facilitate removably attaching the container to the front blocking element. If so, this would be within a scope of the container comprising an attachment feature to facilitate the top of the container being removably attachable, wherein the attachment feature is usable to facilitate removably attaching the container to the front blocking element). (Most specifically, in the example, the container comprises an attachment feature to facilitate the top of the container being removably attachable, wherein the attachment feature is usable to facilitate removably attaching an outputting portion of the container into the input aperture of the front blocking element. (The container may feasibly comprise more than one attachment feature, (to facilitate the top of the container being removably attachable), that is usable to facilitate removably attaching an outputting portion of the container into the input aperture of the front blocking element). Note: 'Screw' attachment is just one example of how to facilitate removable attachability, (of the container top and/or to the front blocking element). It is feasible that the container comprises an attachment feature to facilitate the top of the container being removably attachable, wherein the attachment feature is usable to facilitate removably attaching the container to the front blocking element, not limited to screw feature(s). For example, the top of the container may be removably attachable magnetically, and/or via a clip(s), etc, with the container comprising an attachment feature to facilitate this, wherein the attachment feature is usable to facilitate removably attaching the container to the front blocking element. Thus the example(s) provided are provided by way of example only. (The example shown/provided is an example of wherein the attachment arrangement, to facilitate removably attaching the top of the container, and the attachment arrangement to facilitate removably attaching the container to the front blocking element, are the same. (The example shown/provided is an example of wherein the attachment arrangement, to facilitate removably attaching the top of the container to the outputting portion of the container, and the attachment arrangement to facilitate removably attaching the outputting portion of the container into the input aperture of the front blocking element, are the same). (Note: The term 'the same', here, allows for slight variations. But it is clear, (looking at the example of FIG. 6, for example, that the example thread 42, within the example input aperture 16, in order to facilitate the example outputting portion 39 of the container being screwed in to the input aperture 16, will have to be extremely similar (or identical) to the thread within the top of the container, (that has been removed from the example outputting portion 39 of the container, in FIG. 6). For the sake of the present application, this is considered, (whether the thread 42 in the input aperture and the thread in the top of the container are 'identical' or merely 'extremely similar' to be an example of wherein the attachment arrangement to facilitate removably attaching the top of the container, and the attachment arrangement to facilitate removably attaching the container to the front blocking element, are the same, (and of wherein attachment arrangement, to facilitate removably attaching the top of the container to the outputting portion of the container, and the attachment arrangement to facilitate removably attaching the outputting portion of the container into the input aperture of the front blocking element, are the same)))).

(Note: It should be stated, whilst in the example, the container is immediately ready for filler agent to be outputted from the container, into the hole in the wall, it is feasible embodiments of the container being removably attachable to the front blocking element may be provided, wherein, when first attached to the front blocking element, the container is not immediately in position for inputting filler agent into the hole in the wall, but can be moved (eg via sliding, for example, eg with there being a sliding arrangement(s) to facilitate this), into the filling position. (For example, the container may be attachable to the front blocking element in a position to the side, (for example), of the input aperture 16 of the front blocking element, (or any relevant position), for example, and then may be slidable sideways (or in any relevant direction) into the filling position, for example). Even such an example, because it is removably attachable to the front blocking element in such a way that ultimately results in being attached in the filling position, is considered, (for the sake of the present application), to be an example of, (and therefore within a scope of), the container being removably attachable, 'into a filling position'. Similarly, it will be known that containers can be provided wherein an outputting portion of the container does not initially protrude, and can be made to protrude via pressure, (eg by a user squeezing the container, thus making the outputting portion of the container protrude). (In such embodiments, the protruding portion would tend to be of non-rigid material(s)/construction, although various embodiments are possible). Such an example could feasibly be removably attached to the front blocking element, (as will be explored, for example, via a clipping arrangement, for example, (which would be (and is) a type of attachment arrangement, (comprising at least one clip)), (or in any way, not limited to a clipping arrangement), and where the container could clip (and thus attach) to the front blocking element, but perhaps outside the perimeter of the example input aperture, for example. (It could attach, feasibly, at any point(s) that is not within the input aperture 16, for example). (This is provided simply by way of example only). In such an example, (taken by way of example only), the container could be attached in a very similar or same position as the example can be in FIG. 6, for example, but the outputting portion may not initially be protruding when attached, (and may not protrude into the input aperture 16 of the front blocking element). However, in such an example, squeezing the container, for example, would then result in the outputting portion protruding into the input aperture. Such an example, again, for the sake of the present application, is considered an example of, (and therefore to be within a scope of), the/a container being removably attachable to the front blocking element, into a filling position, (since it is removably attachable to the front blocking element in such a way that ultimately results in being attached in the filling position).

Note: The example attachment arrangement is shown by way of example only. It will be apparent there are a wide array of possibilities, for how to attach the container to the front blocking element. Thus various options and/or embodiments are possible, for the attachment arrangement, not limited to the examples shown.

Preferably, an output aperture of the container is received into the input aperture of the front blocking element, in the filling position. (Example embodiment(s) of this are best shown in FIG. 1 and FIGS. 6 to 9, with FIGS. 7 to 9 showing, in use, an example outputting portion 39, (that comprises an output aperture), of the container received into the input aperture of the front blocking element, in the filling position. (Note: For the sake of the present application, whether a portion of the outputting portion of the container is received into the input aperture, or a whole of the outputting portion is received into the input aperture, that is considered to be within a scope of 'the outputting portion of the container being received into the input aperture').

The example container is shown comprising an example outputting portion 39. The example outputting portion, in the example, comprises at least one aperture, (to output filler agent out of). In the example, (provided by way of example only), the outputting portion 39 of the container 38 of the filler agent is of a shape and size (ie dimension) so that it can fit into the input aperture 16 of the front blocking element, (whether or not there is an attachment arrangement, to facilitate attaching the container to the front blocking element). (This is shown, in FIGS. 6 to 8, (and is made clear, in light of the views of FIGS. 1 and 5)). This can be extremely useful, in helping filler agent be ejected from the container, into the hole in the wall. (Preferably shape and size of the outputting portion 39 and the input aperture 16 are substantially matched. This may be helpful to limit (and preferably prevent) drippage (and/or mess) from the container when filler agent is being outputted from the container into the hole). (An example of shape and size of the outputting portion 39 and the input aperture 16 being substantially matched is best/most clearly shown in FIG. 6, for example, (and also in FIG. 1). (In the example embodiment of FIGS. 7 to 9, shape and size of the outputting portion 39 and the input aperture 16 is also substantially matched, but is not visible, (due to the view shown)). (The shape and size of the outputting portion 39 and the input aperture 16 being substantially matched is a good way of trying to optimize the chances that absolutely all (or very nearly all) filler agent outputted from the container goes into the hole in the wall)).

(An example of filler agent (that is dryable from a non-solid state to a solid state) being outputted from an example container, into an example hole in a wall, is shown in the sequence of FIGS. 7 to 9. Thus, (especially in FIGS. 8 and 9), an example is shown of filler agent (that is dryable from a non-solid state to a solid state) being inputted into the example hole in the wall).

(It should be stated, a container could be in a filling position, without a portion (eg an outputting portion) of the container being received into the input aperture of the front blocking element. For example, a container could be removably attachable to the front blocking element in a position, for example, wherein an outputting portion of the container is 'flush' to the front of the input aperture 16. (This could be achieved, for example, (provided simply by way of example only), wherein the outputting portion magnetically engages the front blocking element, around a perimeter of the input aperture, for example, (or via any other attachment arrangement(s), (and not at all limited to a magnetic solution(s)), the example being provided simply by way of example only)). Thus, in such an example, filler agent would be outputted, into the hole in the wall, with the outputting portion of the container being flush to the front of the input aperture 16, but not being received into the input aperture). Nevertheless, this would be a filling position, in such an example. (However, it is highly preferred for an outputting portion of the container to be received into the input aperture of the front blocking element). (Note: Such an example as just described, (ie with the outputting portion of the container being flush to the front of the input aperture 16 of the front blocking element), could be achieved with the container being attached to the front blocking element in any way, (not limited to the example of the outputting portion of the container magnetically engaging the front blocking element, around a perimeter of the aperture, for example. Thus the example is provided by way of example only).

Preferably the wall repair kit comprises an attachment arrangement, to facilitate removably attaching the container to the front blocking element, the attachment arrangement being configured to facilitate screwing the container to the input aperture of the front blocking element. (Example(s) of this are shown in the embodiment(s) of FIGS. 1 and FIGS. 6 to 9, for example, with FIG. 6 showing an example of this particularly clearly). Most preferably, preferably the attachment arrangement is configured to facilitate screwing an outputting portion of the container into the input aperture of the front blocking element. (Again, example(s) of this are shown in the Figures, with FIG. 6 showing an example of this particularly clearly). (Whilst the example embodiment(s) shown show the attachment arrangement being configured to facilitate screwing an outputting portion of the container 'into' the input aperture of the front blocking element, it should be noted, the term screwing the container 'to' the aperture of the front blocking element is broader than screwing the container 'into' the aperture of the front blocking element. For example, in FIG. 6, for example, the attachment arrangement comprises a thread arrangement. The example input aperture 16 is shown comprising an example thread 42. The container is also shown comprising an example thread 44. In the example, this facilitates screwing the container into the input aperture of the front blocking element. In the example, there is shown an example thread, (to facilitate screwing), within the input aperture; and an example thread, on an outside of an outputting portion of the container). (Thus this is an example of the attachment arrangement being configured to facilitate screwing the portion of the container 'into' the input aperture of the front blocking element). However, it is technically feasible the attachment arrangement could be configured to facilitate screwing the container to the aperture of the front blocking element, but not limited to screwing an outputting portion of the container 'into' the input aperture. For example, it is feasible that there could be a thread that is not inside the aperture, (eg generally located in area 50, eg around an outside of the input aperture 16, for example). (Such an embodiment may not have handle feature(s) in the way the example of FIG. 6 does, or may have handle feature(s) in a different position(s) from the example of FIG. 6, to facilitate screwing the container to the input aperture). In such an embodiment, there could then be a corresponding thread arrangement on an inside of the outputting portion of the container, (rather than the outside of the outputting portion). Thus a portion of the container (ie the outputting portion) could be screwed to the input aperture, around the outside of the input aperture, in such an example. Thus this would be an example of wherein the attachment arrangement is configured to facilitate screwing the container to the input aperture of the front blocking element, but would not be an example of wherein the attachment arrangement is configured to facilitate screwing a portion of the container 'into' the input aperture of the front blocking element. However, for various reasons, this may not be as clean and/or effective and/or desirable. Thus, preferably the attachment arrangement is configured to facilitate screwing an outputting portion of the container into the aperture of the front blocking element. (Thus, it will be apparent that, in the example embodiment(s) in the Figures, screwing the container to the input aperture of the front blocking element is achieved by virtue of a thread arrangement, wherein the input aperture comprises a thread, (to facilitate screwing), and the container comprises a thread, (to facilitate screwing). The example(s) provided is provided by way of example only).

Preferably there is an attachment arrangement, (to facilitate removably attaching the container to the front blocking element), that comprises at least one attachment feature within the input aperture of the front blocking element. (This, then, would be an example of wherein at least a portion of the attachment arrangement, (to facilitate attaching the container, removably attachably, to the front blocking element), is within the input aperture 16 of the front blocking element. (An example(s) of this is shown in the embodiment(s) shown in the drawings, (and this is best shown in the close-up view of FIG. 6). In the example, the attachment arrangement comprises a thread arrangement. The input aperture 16 is shown comprising an example thread 42. (Thus this is an example of wherein the attachment arrangement comprises at least one attachment feature within the input aperture 16. (And it is thus an example of wherein at least a portion of the attachment arrangement is within the input aperture 16). The container is also shown comprising an example thread 44. In the example embodiment, the attachment arrangement comprises a thread arrangement, the thread arrangement comprising: a thread within the input aperture of the front blocking element; and a thread on an outside of an outputting portion of the container of the filler agent. (This thus facilitates the outputting portion 39 of the container being screwed into the input aperture 16 of the front blocking element). (It should be stated, a thread arrangement is just one way, (albeit an extremely good way), of attaching the container to the front blocking element, (and just one embodiment of an attachment arrangement, (to facilitate attaching the container, removably attachably, to the front blocking element). Various options and/or embodiments are possible. For example, rather than comprising a thread arrangement, the attachment arrangement may comprise a clip arrangement, for example. (Thus the container and the front blocking element may be clipped together). (Thus, for example, the outputting portion of the/a container may be removably attachably clipped into the input aperture 16, for example). This, (ie a clipping arrangement), again, is just one example of an attachment arrangement. In another example, the attachment arrangement may comprise a magnetic solution, for example, (to facilitate attaching the container to the front blocking element). (Thus, for example, the outputting portion of the/a container may be attached into the input aperture 16, via a magnetic solution, for example). Thus various options and/or embodiments are possible, for the or any attachment arrangement.

Similarly, it should also be stated, whilst the example shown shows at least one attachment feature of the attachment arrangement being within the aperture, (and thus shows an example of at least a portion of the attachment arrangement being within the input aperture arrangement 16), it should be stated that examples may be provided wherein no features of the attachment arrangement are within the input aperture. For example, looking at FIG. 6, another embodiment may be provided wherein there is a clipping arrangement, (which would be (and is) a type of attachment arrangement, (comprising at least one clip)), and where the container could clip (and thus attach) to the front blocking element, but perhaps outside the perimeter of the example input aperture, for example. (It could attach, feasibly, at any position(s)/point(s) of the front blocking element that is not within the input aperture 16, (eg anywhere, about blocking body 34)). Thus embodiments could be provided, wherein there are no features of the attachment arrangement in the input aperture. In such an embodiment, the container may comprise clipping feature(s). (For example, the container may comprise clipping feature(s), (or any type of attachment feature(s)), (eg on the outputting portion, for example, (or even perhaps not on the outputting portion (eg perhaps behind (and outside of, (eg to a side(s) of)) the outputting portion. Even if this is the case, (ie if the container comprises a clipping feature(s), (or any type of attachment feature(s)), behind (and outside of, (eg to a side(s) of)) the outputting portion, (to facilitate attaching the container to the front blocking element), it is nevertheless possible, (dependent on shape of the input aperture and any outputting portion, for example), that the attachment arrangement could be configured in such a way that the outputting portion is received into the input aperture. (Similarly, it should be mentioned, the example(s) shown is an example of wherein the attachment arrangement is configured for the outputting portion of the container to be received into the input aperture of the front blocking element. In the example(s), this is achieved by virtue of the attachment arrangement comprising least one attachment feature within the input aperture, (which is thus an example of wherein at least a portion of the attachment arrangement is within the input aperture 16). However, as has been stated, the attachment arrangement is not limited to having to have at least one attachment feature within the input aperture 16, and it should be stated, even for embodiments where there are no attachment features of the attachment arrangement within the input aperture 16, the attachment arrangement may nevertheless be configured for the outputting portion of the container to be received into the input aperture of the front blocking element. For example, (as stated above, for example), the front blocking element could comprise attachment feature(s) that are not within the input aperture 16, (which facilitate the container being attached to the front blocking element). Nevertheless, the attachment arrangement may be configured for the outputting portion of the container to be received into the input aperture of the front blocking element. Thus, the outputting portion of the container may be received into the input aperture of the front blocking element, and the container may be attached to the front blocking element, at a point(s), (and by any feature(s)), outside of the input aperture 16). (Note: All such disclosure provided, (with reference to the attachment arrangement, wherein no features of the attachment arrangement are within the input aperture, (and yet the outputting portion of the container is received into the input aperture of the front blocking element)), may be afforded to the attachment arrangement wherein the output aperture of the container is 'flush' to the input aperture of the front blocking element, (in the filing position), (rather than being 'received into' the input aperture. Thus various options and/or embodiments are possible).

(In the example embodiment, the attachment arrangement facilitates attaching the example outputting portion of the container to the example input aperture of the front blocking element).

Referring to FIG. 4, (and relevant to various of the drawings), in the example, there is shown an example handle 32. In the example, there is shown an example blocking body 34. In the example, there is shown an example raised portion 30. In the example, the example handle, (provided by way of example only), is a separate part to the example blocking body. However, in other embodiments, a portion or a whole of the handle may be provided as one part with a portion or a whole of the blocking body, for example. (Similarly with the raised portion, in the example, at least a portion of the example raised portion is a separate part to the example blocking body. However, in various embodiments, a portion or a whole of the raised portion may be provided as one part with a portion or a whole of the blocking body, for example. (In other embodiments, a whole of the raised portion may be a separate part to the example blocking body).

In the example, (not visible due to the angle of the view shown in FIG. 4), a small portion of the example body that provides the example handle is received into example aperture 46. Because of this, in the example, a whole of the 'depth' of the input aperture 16 of the front blocking element is provided by way of the example body that provides the example handle. Thus the example shown is an example within a scope of wherein 'a portion or a whole of' the input aperture 16, (to facilitate inputting a filler agent into the hole in the wall, through the front blocking element), is provided by way of the example body that provides the example handle. However, it should be stated, (looking at the embodiment of FIG. 4, for example), an embodiment could be provided wherein, rather than the example body that provides the example handle being received into example aperture 46, the example body that provides the example handle is not received into example aperture 46, (but is 'lined up', for example, and is on top of the front blocking element, but not received into example aperture 46). Thus such an embodiment may be provided, wherein example aperture 46 provides a portion of the 'depth' of the input aperture 16 is provided by example aperture 46, and a portion of the 'depth' of the input aperture, (a far larger portion than that which is provided by example portion 46, in the example embodiment), is provided by way of the example body that provides the example handle. This would be an example of wherein a portion, (rather than a whole), of the 'depth' of the input aperture is provided by way of the example body that provides the example handle, (but nevertheless would be an example within a scope of wherein 'a portion or a whole of' the input aperture 16, is provided by way of the example body that provides the example handle). (In the embodiment shown, the example body that provides the example handle is separate to the blocking body of the front blocking element, (most clearly shown in FIG. 4). But in other embodiments, a portion or a whole of the handle may be provided as one part with a portion or a whole of the blocking body of the front blocking element). In the example embodiment, this results in the input aperture protruding. (This is shown most clearly in the views of FIG. 1 and FIG. 6, (where it can clearly be seen that the example input aperture is protruding, outwardly)). (However, it should be stated, the example is provided by way of example only, (and the handle is provided by way of example only, and it should be stated, embodiments of the/a front blocking element could be provided that comprise an input aperture, for example, more akin to the example aperture 46 as shown in FIG. 4, (ie not protruding, (and perhaps fairly simplistic in nature)), and this could would nevertheless be an example of an input aperture. Thus far more basic embodiments of an input aperture 16 may be provided, for example. Thus various options and/or embodiments are possible. (It should also be stated, the/an input aperture being protruding need in no way rely upon a handle (body), and a protruding input aperture may be provided, even in embodiments where there is not a handle. For example, looking at the example of FIG. 6, the portions of the handle body that extend upward and downward from where the input aperture is (in the view shown), (thus providing the handle), may feasibly not be there, (in another embodiment), (or may be separate from the portion that protrudes, forming the example protruding input aperture). Thus various options and/or embodiments are possible, and a protruding input aperture need not rely on (or be provided by way of) the/a handle. The example provided is thus provided simply by way of example only. Furthermore, an embodiment, for example, could be provided wherein the front blocking element (eg looking at the example blocking body of the front blocking element in the example of FIG. 4, for example), could be much thicker. This could lead to the input aperture being significantly 'deep', (and whether or not the input aperture is 'protruding', (and whether or not there is a handle). Thus 'depth' of the input aperture, (or any aperture), is not reliant on the (input) aperture 'protruding'). Thus various options and/or embodiments are possible. The examples embodiment(s) are provided by way of example only.

The input aperture being protruding has various benefits, including facilitating attachment of the container to the front blocking element, in the example embodiment, and/or increased functionality/aptitude in terms of receiving an outputting portion of the container, (both of which, as has been explained, can be very useful in facilitating elegant inputting of filler agent into the hole in the wall). As stated, there are many ways to provide a protruding input aperture, not limited to the examples shown and/or described. For example, another possibility would be for the front blocking element to be thicker, for example, (where the input aperture is). Thus various options and/or embodiments are possible.

Thus, in the example, a portion or a whole of the input aperture 16, (to facilitate inputting a filler agent into the hole in the wall, through the front blocking element), is provided by way of the example body that provides the example handle. (However, in other embodiments, this may, or may not, be the case). Thus, in the example embodiment, a portion of the input aperture 16 is provided by way of the example body that provides the example handle, and a portion of the input aperture is provided by way of the example blocking body of the front blocking element.

It should also be stated, any or all feature(s), (such any attachment arrangement feature(s), (eg thread, etc, and/or any other attachment arrangement feature(s), (and/or a holding arrangement, for holding the connecting element, (in a (desired) position), for example)), may feasibly be provided, in an embodiment(s) where there is not a handle, (or an embodiment(s) where the handle is not associated with such feature(s)). Thus feature(s) associated with the handle in the Figures, (eg such as a thread, for example), are not limited to being provided in such way, and may be provided in any embodiment, whether or not there is a handle, (or in an embodiment(s) where the handle may be provided in a very different way and/or place and/or shape, etc, for example). Thus it should also be stated, broadly speaking, that the handle is also provided by way of example only. Embodiments may be provided where it is differently shaped and/or positioned, and/or designed, for example.

(In FIG. 4, there is shown an example aperture(s) 49 in the example front blocking element 14. These are provided by way of example only, and are simply provided, in the example embodiment, to facilitate attachment of the example handle 32 to the example blocking body 34. In the example, the example handle 32 comprises a protruding portion(s), (not visible, from the angle shown), that fits partially or wholly through the example aperture(s) 49. Glue, in the example, is used, to sure up the attachment. (Thus, the aperture(s) 49, in the example embodiment, receive the protruding portion(s)). (It should also be stated, in another embodiment, feature(s) 49 may be recess(es), rather than aperture(s) which travel the whole way through the front blocking element, otherwise carrying out much the same function. (The broad term 'receiving portion(s)' may be used, which includes within its scope an aperture(s) that travels the whole way through the front blocking element, and also includes within its scope a recess(es) that does not travel the whole way through)). (Of course, in a similar embodiment, the male-female relationship may instead be female-male, with the blocking body comprising a protruding portion(s), and the handle comprising a receiving portion(s) (eg a recess(es)/aperture(s)). (The handle and blocking body may even each comprise a mixture of male/female feature(s), to facilitate attachment)). It will be apparent that this is simply one example of how attachment (of a handle and blocking body) may be achieved, and that there are a vast array of ways attachment may be achieved, not at all limited to the example shown. Thus a wide array of options and/or embodiments are possible).

Referring to the front blocking element, the front blocking element is shown in the Figures, in a particular shape and/or size and/or design, However, it will be apparent that, in various (differing) embodiments, the front blocking element may be provided in a variety of different shapes and/or sizes and/or designs. For example, the front blocking element may be circular. For example, the front blocking element may be oval. For example, the front blocking element may be square. For example, the front blocking element may be rectangular. (These are just several possibilities). (Thus various options and/or embodiments are possible). So the same is the case for the back blocking element. The back blocking element is shown in the Figures, in a particular shape and/or size and/or design, However, it will be apparent that, in various (differing) embodiments, the back blocking element may be provided in a variety of different shapes and/or sizes and/or designs. For example, the back blocking element may be oval, for example. For example, the back blocking element may be square, for example. For example, the back blocking element may be rectangular, for example. (These are just several possibilities). (Thus various options and/or embodiments are possible).

Figure 10:
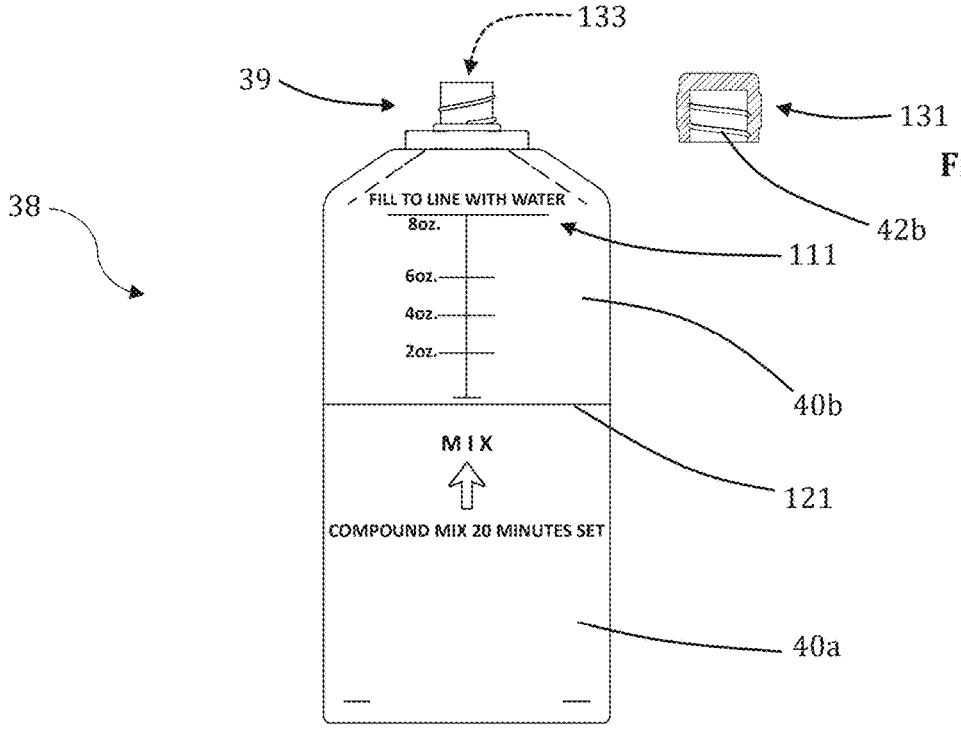
FIG. 10 is a frontal view of an example container, (for containing filler agent), showing various features, and showing an example container top, removed.

An embodiment of the container 38, (to contain filler agent), is shown in FIG. 10. In the embodiment, there is shown an area 40*b* for water; and an area 40*a* for a filler base agent. (The filler base agent is preferably a powder). (Preferably the area 40*a* for filler base agent is completely full with filler base agent, (which is why it is hard to see any base agent in FIG. 10, because, in the example, (provided by way of example only) the area 40*a* is completely full of powder). In the example, there is shown an annotation(s) 111 to denote to the user how much water to add to the area for water. (In other embodiments, as stated, it is feasible water may already be in the area for water, thus not requiring the user to add water. However, it is preferred that the user must add water, as that allows the container to be provided without water, and thus weighing less). The annotation(s) are thus a denoting means. There is also shown an example barrier 121. The barrier is breakable. It is intended that once the user has added water to the level denoted, the barrier is then broken, to that the water and the filler base agent can be mixed, to create the filler agent that is dryable from a non-solid state, to a solid state.

An example container top 131 is shown in FIG. 10, which is shown as a cross-sectional view. (The container top may be referred to as a 'cap', in the example). The cross-sectional view of the example container top 131 reveals attachment feature(s). (In the example, an example thread 42*b*, (to facilitate screwing the container top on, or off, the container), is shown. In the example, the example thread 42*b* is shown within the container top). (An example output aperture 133, (out of which filler agent is outputted from the example container), is also denoted).

Figure 11:
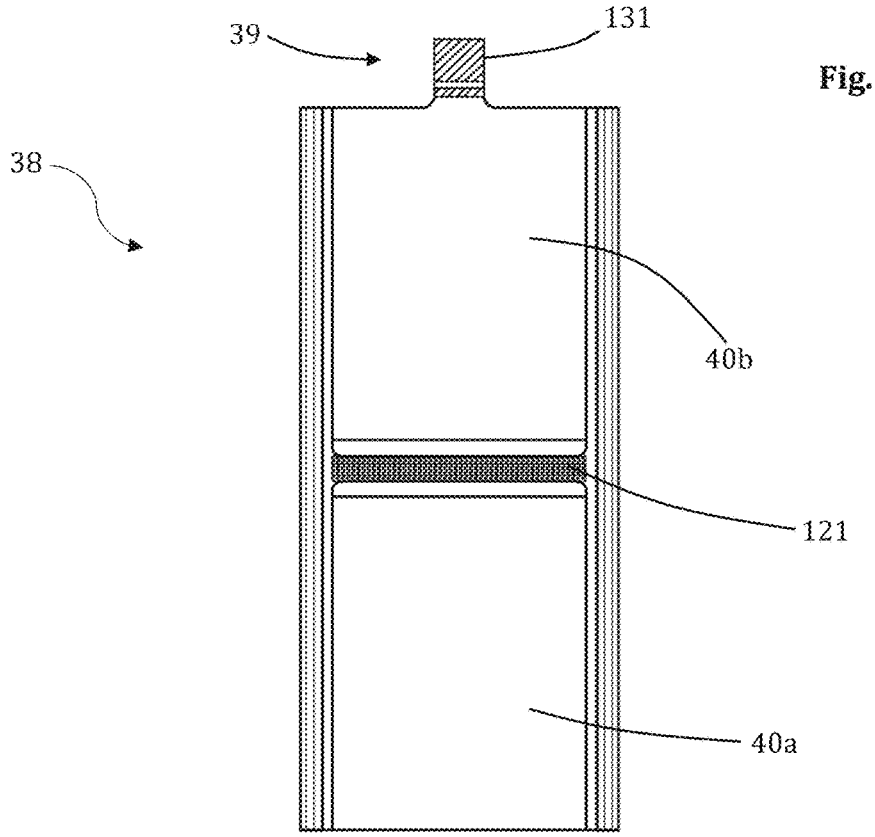
FIG. 11 is a view of an example embodiment of a container, (for containing filler agent), showing, showing clearly an example of a breakable barrier between an area for water and an area for a filler base agent.

In FIG. 11, an embodiment of the container is shown. (The embodiment is a 'bag-type' container). In both FIG. 10 and FIG. 11, the container comprises/is a bag. (The example comprises a bag body). (Preferably the bag (body) is made of thin plastic(s). However, it should be stated, feature(s) like the outputting portion 39, for example, (and container top, for example), may be made of other material(s) and/or may be of thicker (and/or stronger) plastic(s), since it may be useful for such feature(s) to be significantly rigid, whereas, (as stated previously in the present application), the body of the container that contains the filler agent, (ie the 'bag body' in the example embodiment), being 'squeezable' is significantly useful, so that it can be squeezed, to output filler agent from it. Thus, in the example embodiment, the container, (which comprises a bag, in the example, (and thus comprises a 'bag body', which is an example of a body for containing the filler agent), is deformable. Thus it is squeezable. The example embodiment can be deformed, (via squeezing), to help output filler agent from it.

In the example, the container comprises annotations. (These may be on the inside and/or outside of the container). In the example embodiment, (provided by way of example only), the annotation(s) comprise word(s). There may also be provided further instructions. For example, there may be further instructions, stating word(s) to the effect of "Remove top. Fill with water to water line mark. Close top. Squeeze and break separation between compound and water. Blend water and compound to the right mixture", (or the like). (This example of instructions is given simply by way of example only). In FIG. 11, an embodiment of a barrier 121, (between the example area 40*b* for water and the example area 40*a* for filler base agent), is shown. In the example, the barrier is formed via heat treating. This is done by using heat, to 'bond' the container to itself, to create the barrier. Thus the area for water and the area for filler base agent are separated, (by the barrier). Preferably filler base agent is provided in the area for filler base agent, (although it is technically feasible the user must add filler base agent). But preferably it is pre-provided. User can then add water to the water to the level required and/or denoted to the area for water. Then the example breakable barrier can be broken, to start mixing. (The example container/barrier is configured so that, if the user squeezes the container when the top is on the container, the barrier can be broken, (ie due to pressure). (This may be particularly easy to do if there is water in the water area. Thus, if water needs to be added to the water area, the user can add the water, (eg tap water), and then, replacing the top (which is a 'cap', in the example), they can squeeze the container, to 'burst' the barrier open). (Note: Even if the barrier is 'unbonded', (ie the barrier is removed by way of manipulating the container so that one side of the container is 'unbonded' from the other side of the container), in order to allow the water and the filler base agent to mix, this is still, for the sake of the present application deemed a 'barrier', and is still, for the sake of the present application, deemed to be an example of a barrier being 'broken', (and thus is an example of a breakable barrier). Thus a barrier does not have to be an 'extra feature', using 'extra material(s) from the rest of the container—it may be provided by way of heat treating, for example, (or any other method/means, 'bonding' one part of the container to another part of the container, (to thus separate the area for water and the area for filler base agent). In such situations, 'unbonding' that bonded area is considered to be 'breaking' the barrier). In the example, the barrier is an example of a 'crimped' barrier. (In the example, creation of the barrier includes 'pinching' the area where the barrier is created. In the example, this is done in combination with heat treating of that area. Thus this is an example wherein the barrier is created by heat treating, and/or pinching. (It should also be stated, for the sake of the present application, 'crimping' is considered an example of (and to be within a scope of) 'pinching'). (It will be apparent that there are many ways to provide/create a barrier, and the example of a barrier is provided simply by way of example only.

(For the sake of the present application, whether the connecting element travels partially through the aperture (ie part of the way through), or wholly through the aperture (ie the whole way through), that is considered within a scope of the connecting element travelling through the aperture. (Similarly, whether a portion of an outputting portion of the container is received into the aperture, or a whole of the outputting portion of the container is received into the aperture, that is considered within a scope of the outputting portion of the container being received into the aperture).

Note: It is stated at various points in the present application that, whilst examples are shown and/or disclosed comprising a particular feature, embodiments may be provided where there are a plurality of the particular feature. (Examples include there being a plurality of connecting elements and/or the front blocking element comprising a plurality of input apertures, (to facilitate inputting a filler agent into the hole in the wall, through the front blocking element), and/or the/a container comprising a plurality of output apertures, (for outputting filler agent out of). It should be stated, with regard to these (or any other) features, if a claim defines definition with regard to 'a' feature, (eg with regard to a connecting element, and/or an input aperture, and/or an output aperture), if an embodiment is provided wherein there are a plurality of such a feature, then if what is defined is the case for any one (or more than one) of the said feature, then it is within a scope of what is defined. For example, Whilst, in the example embodiment shown, the container (for containing filler agent) has only one output aperture, for outputting filler agent out of, it should be stated that the (or any) container, (for containing filler agent), may feasibly comprise more than one output aperture, for outputting filler agent out of (Of course, a container embodiment that comprises more than one output aperture would be within a scope of being a container that comprises 'an output aperture'). If there is more than one output aperture, the output apertures may be close to each other, or, for example, an embodiment could even be provided where they are not. (For example, a container could be provided with an output aperture at one end of the container, and an output aperture at another end of the container, for example). It should be stated, if a claim defines definition relating to 'an' output aperture, then, with regard to embodiments that comprise a plurality of output apertures, if what is claimed/defined is the case for any one (or more than one) of the apertures, then that is within a scope of the definition provided for 'the' output aperture. For example, if it is defined that 'the' output aperture of the container is received into 'the' input aperture of the front blocking element, then if the container comprises a plurality of output aperture (and/or the front blocking element comprises a plurality of input apertures), if any one (or more than one) output aperture of the container is received into one (or more than one) input aperture of the front blocking element, then that is within a scope of 'the' output aperture of the container being received into 'the' input aperture of the front blocking element. (So, similarly, if it is defined, for example, that a connecting element travels through an input aperture of the front blocking element, then if an embodiment is provided where there is a plurality of connecting elements (and/or input apertures), then if any one (or more than one) of the connecting elements travels through any one (or more than one) of the input apertures of the front blocking element, then that is within a scope of what is defined.

Figure 15:
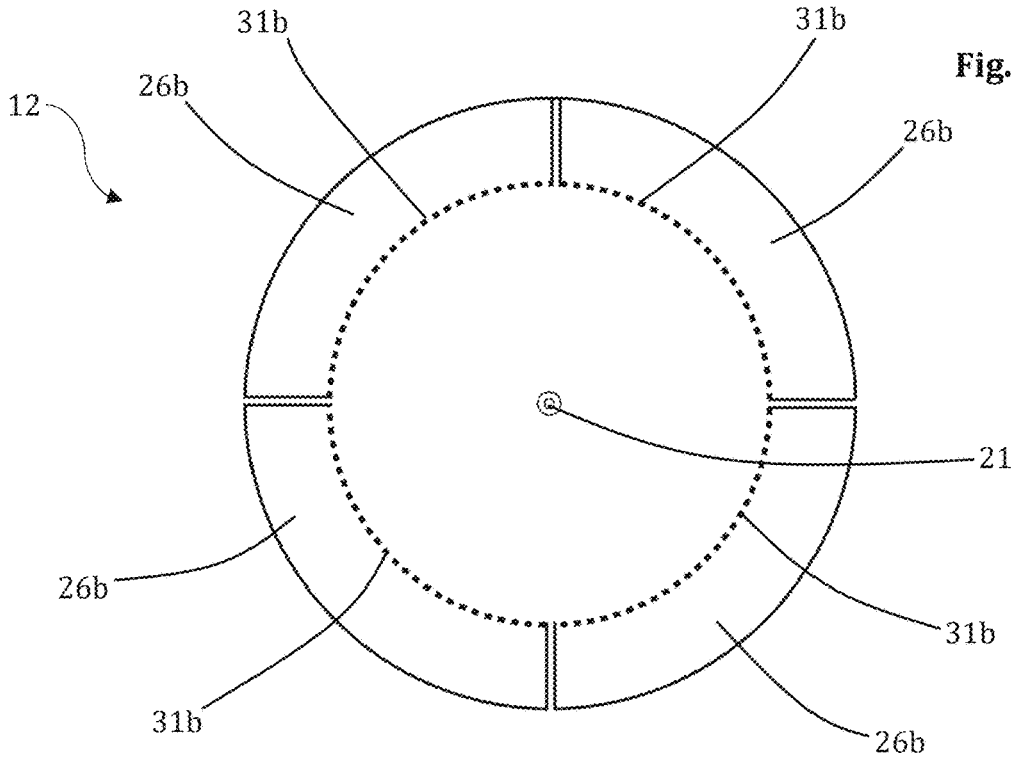
FIG. 15 is a front view of a basic depiction of another example back blocking element that comprises four break arrangements that each facilitate breaking off a portion of the blocking body that comprises a portion, but not a whole, of a perimeter of the blocking body.

The embodiment of FIG. 15 shows an embodiment that comprises more than one break arrangement. (The example break arrangements are denoted with dashed lines). In the example, (provided by way of example only), there are four break arrangements 31*b* that each facilitate breaking off a portion 26*b* of the blocking body that comprises a portion, (but not a whole), of the perimeter of the blocking body. But, in total, the portions, (together), comprise a whole of the perimeter of the blocking body. In the example, example portions 26*b* cannot be removed together, in one go. They are removable separately. A benefit of the embodiment of FIG. 2, for example, is that portion 26*a*1, in FIG. 2, (or portion 20*a*), can be removed, as one piece. In the embodiment of FIG. 15, however, example portions 26*b* are only removable separately—they cannot be removed together, (as one piece). However, when removed, they have much the same effect. Thus the example portions 26*b*, in FIG. 15, can be removed, for use on smaller holes. (As stated elsewhere in the present application, the blocking element being made smaller may be useful, for using the blocking element for the repairing of smaller holes). Both the embodiment of FIG. 15, and the embodiment of FIG. 2, for example, are examples of a blocking body, wherein the blocking body comprises one, or more than one, break arrangement that, in total, facilitate breaking off one, or more than one, portion of the BB, wherein the one, or more than one, portion, in total, comprise most (ie more than half) or a whole of a perimeter of the blocking body. Both are examples within a scope of wherein the blocking body comprises one, or more than one, break arrangement that, in total, facilitate breaking off one, or more than one, portion of the blocking body, wherein the one, or more than one, portion, in total, comprise a whole of a perimeter of the blocking body. Both are within a scope of wherein the blocking body comprises one, or more than one, break arrangement that, in total, facilitates breaking off an area that comprises a whole of the perimeter of the blocking body. (In the example of FIG. 15, the area comprises the example four portions 26*b*. ('Four' break arrangements 31*b* and portions 26*b* is provided simply by way of example only, and it will be apparent that various embodiments are possible, wherein there is more than one portion 31*b*, (not limited to 'more than one' being four).

Figure 16:
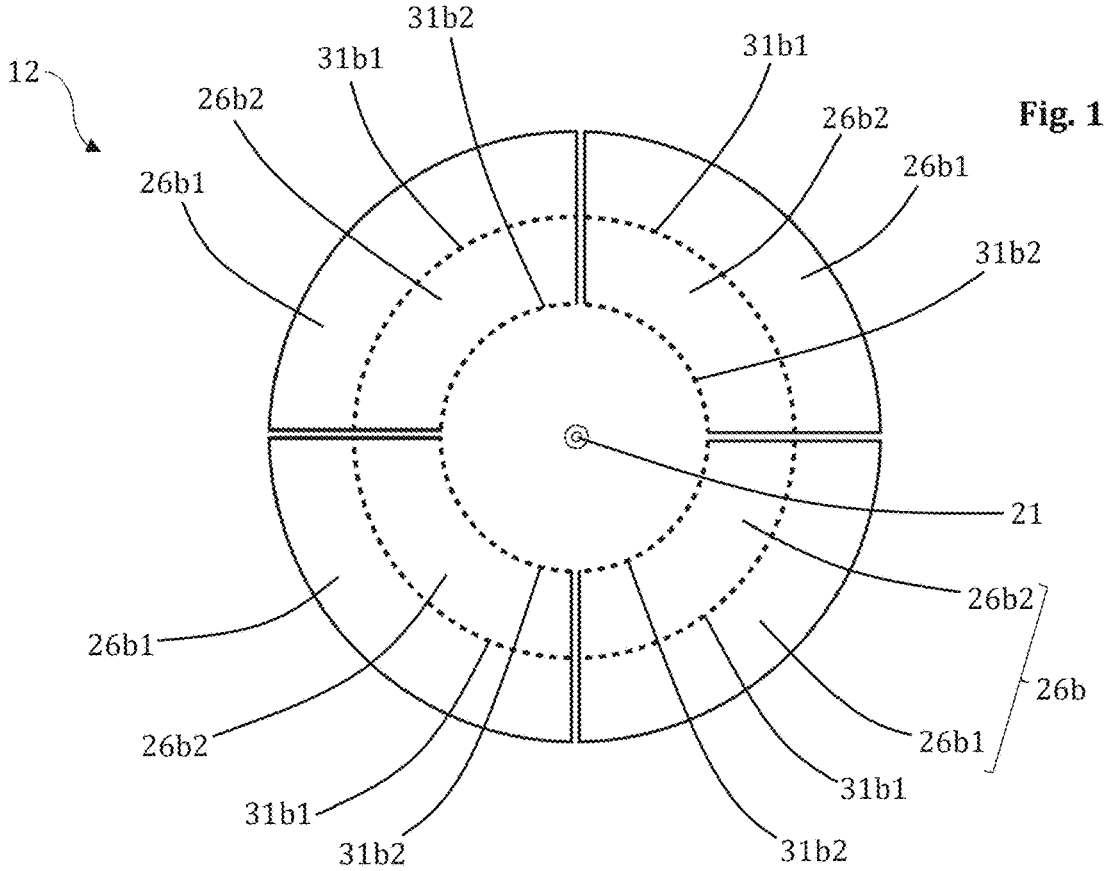
FIG. 16 is a front view of a basic depiction of another example back blocking element, similar in nature to the example embodiment of FIG. 15.

Now looking at FIG. 16, an embodiment similar in nature to the embodiment of FIG. 15 is shown, but perhaps slightly more advanced, (compared to FIG. 15). In FIG. 16, when the four example portions 26*b*1 (an area that comprises a whole perimeter of the blocking body) are removed, an area that comprises a whole perimeter of that which remains of the blocking body is removable, (by removing example portions 26*b*2). Again, unlike the embodiment of FIG. 2, (ie example portion 26*a*2 of FIG. 2), in FIG. 15, example portions 26*b*2 are only removable separately—they cannot be removed together, in one go. The example portions **26*b*2, in the example, together, comprise a whole perimeter of that which remains of the blocking body, (when example portions 26*b*1 are removed). Thus the embodiment again bears some similarities to the example of FIG. 2**, (but is perhaps not as elegant, (in terms of design/user-interface)).

In the example of FIG. 15, there are gaps, between example portions **26*b*. (So the same is the case in FIG. 16, (between example portions 26*b*1, and also between example portions 26*b*2**). However, these amount to only an extremely small percentage of the area around the example blocking body. Thus the example blocking body is an example within a scope of wherein any gap(s) around the blocking body take up less than twenty five percent of the area around the blocking body. Thus the example blocking body is an example within a scope of wherein any gap(s) around the blocking body take up less than twenty percent of the area around the blocking body. Thus the example blocking body is an example within a scope of wherein any gap(s) around the blocking body take up less than fifteen percent of the area around the blocking body. Thus the example blocking body is an example within a scope of wherein any gap(s) around the blocking body take up less than ten percent of the area around the blocking body. Thus the example blocking body is an example within a scope of wherein any gap(s) around the blocking body take up less than ten percent of the area around the blocking body.

Looking at the example embodiment of FIG. 16, example break arrangements **31*b*2 can be used, to remove not only portions 26*b*2, but also example portions 26*b*1, (if example portions 26*b*1 have not already been removed). (In the example, if this is done, each of the example portions 26*b*2 would be removed as one piece with an example portion 26*b*1). Thus this is another similarity, (at least to some extent), with the embodiment of FIG. 2, for example. However, again, whereas in the example embodiment of FIG. 2, this can be done in one go, in the embodiment of FIG. 16, all four example break arrangements 31*b*2** would have to be used. As stated/alluded to earlier, this could be argued to be less elegant, (in terms of design/user-interface).

Various feature(s) are not shown in the basic depiction of FIG. 15 (and FIG. 16). However, any feature(s)/disclosure afforded to any back blocking element, in the present application, (eg the example embodiment of FIG. 2, for example), may be afforded to the embodiments of FIGS. 15 and 16. Thus, for example, the embodiment of FIG. 15 or FIG. 16 may comprise a separation 69 such as that shown in FIG. 2, for example. Thus the blocking body of FIGS. 15 and 16 may comprise apertures 99, (etc). Thus, to be clear, any feature(s)/disclosure afforded to a back blocking element, in the present application, may be afforded to the embodiments of FIG. 15 and FIG. 16. Thus any feature(s)/disclosure shown and/or disclosed, with reference to a back blocking element, may be afforded to the embodiments of FIGS. 15 and 16.

(It should be stated, unusual blocking element embodiments may be provided. For example, looking at FIG. 2, the example portion **26*b*, in the embodiment, comprises less than half of a perimeter of the example blocking body. However, it is feasible that a portion 26*b* that comprises a portion (but not a whole) of the perimeter could be provided, wherein it comprises at least half (or more) of the perimeter of the blocking body. (It should also be stated, it is feasible a plurality of portions 26*b*** that comprises a portion (but not a whole) of the perimeter of the blocking body could be provided, wherein, in total, they comprise at least half (or more) of the perimeter of the blocking body). Thus various options and/or embodiments are possible).

According to one aspect of what is invented, there is provided a wall repair kit 10, comprising: a back blocking element 12, for blocking a hole 13 in a wall 15, behind the hole in the wall; a front blocking element 14, for blocking the hole in the wall, in front of the hole in the wall; and a connecting element 18, to connect the back blocking element and the front blocking element; wherein the front blocking element comprises an input aperture 16, to facilitate inputting a filler agent into the hole in the wall, through the front blocking element; wherein the wall repair kit is operable with the connecting element travelling through the input aperture of the front blocking element, to connect the front blocking element and the back blocking element. (An example(s) of this is clearly shown in the drawings, most clearly shown/alluded to in FIG. 6 (in combination with the sequence of FIGS. 7 to 9)).

According to another aspect of what is invented, there is provided: a wall repair kit, comprising: a back blocking element, for blocking a hole in a wall, behind the hole in the wall; a front blocking element, for blocking the hole in the wall, in front of the hole in the wall; a filler agent, to fill the hole in the wall; and a container, to contain the filler agent; wherein the container is removably attachable to the front blocking element. (An example(s) of this is clearly shown in the drawings, most clearly/demonstrably in FIG. 6, and especially in FIG. 6 in combination with FIGS. 7 to 9. (FIG. 1 also shows an embodiment of this)). Preferably, the front blocking element comprises an input aperture, to facilitate inputting the filler agent into the hole in the wall, through the front blocking element, and the container is removably attachable to the front blocking element, into a filling position, to facilitate outputting the filler agent out of the container, into the hole in the wall, through the input aperture of the front blocking element. (Again, an example(s) of this is clearly shown in the drawings, most clearly/demonstrably in FIG. 6, and especially in FIG. 6 in combination with FIGS. 7 to 9. (FIG. 1 also shows an embodiment of this)).

According to another aspect of what is invented, there is provided: a blocking element, for blocking a hole in a wall, comprising: a blocking body, for blocking the hole in the wall; wherein the blocking body comprises a break arrangement 31, configured for breaking, to facilitate breaking off a portion 26 of the blocking body, the portion being of a pre-determined shape, determined by shape and position of the break arrangement. (An example(s) of this is clearly shown in the drawings, most clearly in FIG. 2. The example back blocking element 12, (for blocking a hole in the wall, behind the hole in the wall), (in FIG. 2, (and shown elsewhere in the drawings)), is clearly an example of this). (According to this aspect, there is thus shown, in the drawings, an example of a wall repair kit, comprising: a said blocking element, (comprising a said break arrangement), the blocking element being a back blocking element, for blocking the hole in the wall, behind the hole in the wall; and a front blocking element, for blocking the hole in the wall, in front of the hole in the wall. (An example is perhaps best/most clearly shown in FIG. 1 and FIG. 7)).

According to another aspect of what is invented, there is provided: a wall repair kit, comprising: a back blocking element, for blocking a hole in a wall, behind the hole in the wall; a front blocking element, for blocking the hole in the wall, in front of the hole in the wall; and a connecting element, to connect the back blocking element and the front blocking element; wherein the front blocking element comprises: an aperture through which the connecting element travels, to facilitate connecting the front blocking element and the back blocking element; and a blocking arrangement, to block a portion of the connecting element, to hold the connecting element in a desired position. (An example(s) of this is shown in the drawings, most clearly in FIG. 6). (Note: Anywhere in the present application where the connecting element is shown/disclosed travelling through an 'input' aperture of the front blocking element, (to facilitate connecting the front blocking element and the back blocking element), (the input aperture being to facilitate inputting a filler agent into the hole in the wall, through the front blocking element), it should be stated, the input aperture, broadly speaking, is an example of an 'aperture' (of the front blocking element), through which the connecting element travels, to facilitate connecting the front blocking element and the back blocking element. According to this aspect, the 'aperture through which the connecting element travels, to facilitate connecting the front blocking element and the back blocking element' is not limited to being an 'input' aperture, (to facilitate inputting a filler agent into the hole in the wall, through the front blocking element). It can be any aperture, (through which the connecting element travels, to facilitate connecting the front blocking element and the back blocking element). Thus the example embodiment(s) in the drawings are simply an example, and, according to this aspect, the aperture through which the connecting element travels, (to facilitate connecting the front blocking element and the back blocking element), may, or may not, be an input aperture, (to facilitate inputting a filler agent into the hole in the wall, through the front blocking element). Thus, for example, (simply to take an example by way of example only), even if the front blocking element comprises an input aperture, and the connecting element does not travel through it, but instead the front blocking element comprises another aperture through which the connecting element travels, (to facilitate connecting the front blocking element and the back blocking element), (and if the wall repair kit comprises all the other feature(s) according to this aspect), then that is an example of a wall repair kit, in accordance with this aspect of what is invented, (and thus within a scope of this aspect of what is invented). Thus any disclosure afforded to a 'blocking arrangement' (and, more broadly, afforded to any 'holding arrangement' (to hold the connecting element in a (desired) position))), in the present application, with respect to the/an 'input' aperture of the front blocking element, (to facilitate inputting a filler agent into the hole in the wall, through the front blocking element), may, with regard to this aspect of what is invented, be afforded to any aperture (of the front blocking element), (that the connecting element travels through), (not limited to being an 'input' aperture of the front blocking element), (and is thus supported, as such, not limited to being an 'input' aperture of the front blocking element). (And, it should be broadly stated, any disclosure afforded to a 'holding arrangement', (to hold the connecting element in a (desired) position))), in the present application, (eg a 'blocking arrangement', for example, or any type of holding arrangement, (to hold the connecting element in a (desired) position), not limited to a blocking arrangement), in the present application, with respect to the/an 'input' aperture of the front blocking element, (to facilitate inputting a filler agent into the hole in the wall, through the front blocking element), may be afforded to any aperture (of the front blocking element), (that the connecting element travels through), (not limited to being an 'input' aperture of the front blocking element), (and is thus supported, as such, not limited to being an 'input' aperture of the front blocking element). According to this aspect, the front blocking element may, or may not, comprise an input aperture, to facilitate inputting a filler agent into the hole in the wall, through the front blocking element. Thus various options and/or embodiments are possible. (Preferably, a portion or a whole of the blocking arrangement is provided within the aperture of the front blocking element, through which the connecting element travels. (An example of this is clearly shown in the example embodiment of FIG. 6). However, the front blocking element may feasibly comprise the blocking arrangement anywhere, (not limited to a portion or a whole of the blocking arrangement being provided within the aperture through which the connecting element travels)).

Preferably the connecting element comprises a plurality of portions that fit through the blocking arrangement; and a plurality of portions that do not fit through the blocking arrangement. However, it should be stated, it is feasible there may be only one portion that does not fit through the blocking arrangement. (It should also be stated, it is feasible there may only be one portion that fits through the blocking arrangement). (However, the connecting element comprising a plurality of portions that do not fit through the blocking arrangement (and a plurality of portions that do fit through the blocking arrangement) may be useful, to facilitate getting the front blocking element and the back blocking element tight to the wall, (and may be useful for using the wall repair kit on walls of different thickness).

According to another aspect of what is invented, there is provided a wall repair kit, comprising: a back blocking element, for blocking a hole in a wall, behind the hole in the wall; and a front blocking element, for blocking the hole in the wall, in front of the hole in the wall. (Example(s) of this are shown in the drawings, which will be apparent). (The front blocking element and the back blocking element, in FIGS. 7 to 9, for example, are seen creating what could be referred to as a 'sandwiching' arrangement, sandwiching the hole in the wall between the front blocking element and the back blocking element). (According to this aspect, the front blocking element may, or may not, comprise an input aperture, to facilitate inputting a filler agent into the hole in the wall, through the front blocking element). (For example, it is technically feasible, for example, that a filler agent could be provided that is, for example, of a consistency similar to whipped cream, for example. The back blocking element could be positioned to block the hole in the wall, behind the hole in the wall. Then the 'whipped cream' consistency filler agent could be inputted into the hole in the wall. Then the front blocking element could be positioned, to block the hole in the wall, at the front of the hole in the wall. The filler agent could then dry to a solid state. (This example of a filler agent, (which is provided merely by way of example only), would also be an example of a filler agent that is dryable from a non-solid state, to a solid state). The front blocking element, (after an appropriate amount of time), could then be removed, revealing the repaired hole. Thus it is feasible embodiments can be provided, where an input aperture is not required, to facilitate inputting a filler agent into the hole in the wall.

According to another aspect of what is invented, there is provided a blocking element, for blocking a hole in a wall, comprising: a blocking body, for blocking the hole in the wall. (A front blocking element, for blocking a hole in a wall, in front of the hole in the wall, comprising: a blocking body, for blocking the hole in the wall, is an embodiment of this. (An example(s) of this is shown in FIGS. 1, 3, 4, and FIGS. 6 to 9, for example. (Various figures show an example of such a front blocking element, for use as part of a wall repair kit)). A back blocking element, for blocking a hole in a wall, behind the hole in the wall, comprising: a blocking body, for blocking the hole in the wall, is an embodiment of this. (An example(s) of this is shown/visible in FIGS. 1, 2, 6, 7, 8, 12, 13 and 14, for example. (Various figures show an example of such a back blocking element, for use as part of a wall repair kit))).

It will be apparent that example(s) have been disclosed of a blocking element, for blocking a hole in a wall, comprising: a blocking body, for blocking the hole in the wall; wherein the blocking body comprises a break arrangement, configured for breaking, to facilitate breaking off a portion of the blocking body, the portion being of a pre-determined shape, determined by shape and position of the break arrangement. Thus disclosure has been provided of a blocking body, for blocking the hole in the wall; wherein the blocking body comprises a break arrangement, configured for breaking, to facilitate breaking off a portion of the blocking body, the portion being of a pre-determined shape, determined by shape and position of the break arrangement. Thus this has been stated.

It will be apparent that example(s) have been disclosed of a blocking element, for blocking a hole in a wall, comprising: a blocking body, for blocking the hole in the wall; wherein the blocking body comprises a first break arrangement, configured for breaking, to facilitate breaking off a first portion of the blocking body, the first portion being of a pre-determined shape, determined by shape and position of the first break arrangement; and a second break arrangement, to facilitate breaking off a second portion of the blocking body, the second portion being of a predetermined shape, determined by shape and position of the second break arrangement. Thus disclosure has been provided of a blocking body, for blocking the hole in the wall; wherein the blocking body comprises a first break arrangement, configured for breaking, to facilitate breaking off a first portion of the blocking body, the first portion being of a pre-determined shape, determined by shape and position of the first break arrangement; and a second break arrangement, to facilitate breaking off a second portion of the blocking body, the second portion being of a predetermined shape, determined by shape and position of the second break arrangement. Thus this has been stated.

It will be apparent that example(s) have been disclosed of a blocking element, for blocking a hole in a wall, comprising: a blocking body, for blocking the hole in the wall; wherein the blocking body comprises a first break arrangement, configured for breaking, to facilitate breaking off a first portion of the blocking body, the first portion being of a pre-determined shape, determined by shape and position of the first break arrangement; a second break arrangement, to facilitate breaking off a second portion of the blocking body, the second portion being of a predetermined shape, determined by shape and position of the second break arrangement; and a third break arrangement, to facilitate breaking off a third portion of the blocking body, the third portion being of a predetermined shape, determined by shape and position of the third break arrangement. Thus disclosure has been provided of a blocking element, for blocking a hole in a wall, comprising: a blocking body, for blocking the hole in the wall; wherein the blocking body comprises a first break arrangement, configured for breaking, to facilitate breaking off a first portion of the blocking body, the first portion being of a pre-determined shape, determined by shape and position of the first break arrangement; a second break arrangement, to facilitate breaking off a second portion of the blocking body, the second portion being of a predetermined shape, determined by shape and position of the second break arrangement; and a third break arrangement, to facilitate breaking off a third portion of the blocking body, the third portion being of a predetermined shape, determined by shape and position of the third break arrangement. Thus this has been stated.

It should be stated, embodiment(s) have been shown (and described) of: a blocking element, for blocking a hole in a wall, comprising: a blocking body, for blocking the hole in the wall; wherein the blocking body comprises a break arrangement, configured for breaking, of a particular shape and position. Various example(s) are shown of a portion of the blocking body being removable, via breaking a break arrangement of a particular shape and position. Various example(s) are shown of a first portion of the blocking body being removable, via breaking a first break arrangement of a particular shape and position; and a second portion of the blocking body being removable, via breaking a second break arrangement of a particular shape and position. Various example(s) are shown of a first portion of the blocking body being removable, via breaking a first break arrangement of a particular shape and position; and a second portion of the blocking body being removable, via breaking a second break arrangement of a particular shape and position; and a third portion of the blocking body being removable, via breaking a third break arrangement of a particular shape and position. Broadly put, various embodiments are shown and/or disclosed of a break arrangement(s), (configured for breaking), and of a portion(s) of the blocking body being removable. As shown, a portion(s) of the blocking body that are removable may comprise a portion (but not a whole) of a perimeter of the blocking body. It is also shown that a portion(s) of the blocking body that are removable may comprise a whole of a perimeter of the blocking body.

(It will be apparent that what is shown in FIG. 2, (and various other Figures, including FIGS. 13 and 14, for example), is an example of wherein the blocking body comprises a break arrangement, configured for breaking, to facilitate breaking off a portion of the blocking body, (the portion of the blocking body being removable via breaking the break arrangement), the portion being of a pre-determined shape, determined by shape and position of the break arrangement).

(It will be apparent that what is shown in FIG. 2, (and various other Figures, including FIGS. 13 and 14, for example), is an example of wherein the blocking body comprises a first break arrangement, configured for breaking, to facilitate breaking off a first portion of the blocking body, (the first portion of the blocking body being removable via breaking the first break arrangement), the first portion being of a pre-determined shape, determined by shape and position of the first break arrangement; and a second break arrangement, to facilitate breaking off a second portion of the blocking body, (the second portion of the blocking body being removable via breaking the second break arrangement), the second portion being of a predetermined shape, determined by shape and position of the second break arrangement.

(It will be apparent that what is shown in FIG. 2, (and various other Figures, including FIGS. 13 and 14, for example), is an example of wherein the blocking body comprises a first break arrangement, configured for breaking, to facilitate breaking off a first portion of the blocking body, (the first portion of the blocking body being removable via breaking the first break arrangement), the first portion being of a pre-determined shape, determined by shape and position of the first break arrangement; and a second break arrangement, to facilitate breaking off a second portion of the blocking body, (the second portion of the blocking body being removable via breaking the second break arrangement), the second portion being of a predetermined shape, determined by shape and position of the second break arrangement; and a third break arrangement, to facilitate breaking off a third portion of the blocking body, the third portion of the blocking body thus being removable via breaking the third break arrangement, the third portion being of a predetermined shape, determined by shape and position of the third break arrangement.

According to another aspect of what is invented, there is provided a blocking element, for blocking a hole in a wall, comprising: a blocking body, for blocking the hole in the wall, wherein a portion of the blocking element is removable. Thus broad definition is provided of a blocking element, for blocking a hole in a wall, comprising: a blocking body, for blocking the hole in the wall, wherein a portion of the blocking element is removable. The portion may comprise a whole of a perimeter of the blocking body. The portion may comprise a portion but not a whole of a perimeter of the blocking body. The blocking body may comprise a first removable portion; and a second removable portion. The blocking body may comprise a first removable portion; a second removable portion; and a third removable portion, (etc). (The blocking body may comprise more than three removable portions). The blocking body may comprise a first removable portion that comprises a whole of a perimeter of the blocking body, and a second removable portion, wherein the second removable portion is larger than the first removable portion, and comprises the first removable portion. (FIG. 2 shows an example of this most clearly, with example removable portion 26*a* being larger than example removable portion 26*a*1, and comprising example portion 26*a*1). The blocking body may comprise a first removable portion that comprises a whole of a perimeter of the blocking body, and a second removable portion, wherein the second removable portion comprises the first removable portion, and wherein, with the first removable portion having been removed, what remains of the second portion comprises a whole perimeter of that which remains of the blocking body. (FIG. 2 shows an example of this most clearly, with example portion 20*a* comprising example portion 26*a*1, and wherein, with example portion 26*a*1 having been removed, what remains of the second portion comprises a whole perimeter of that which remains of the blocking body. (This is also extremely well shown by virtue of FIG. 13). The blocking body may comprise a first removable portion that comprises a whole of a perimeter of the blocking body, and a second removable portion that comprises a portion but not a whole of a perimeter of the blocking body. (FIG. 2, (as well as the combination of FIGS. 13 and 14), shows this best, with example portion 26*a*1, for example, (or example portion 26*a*), being an example of a removable portion that comprises a whole of a perimeter of the blocking body, and example portion 26*b* being an example of a removable portion that comprises a portion (but not a whole) of a perimeter of the blocking body. The blocking body may comprise a first removable portion that comprises a whole of a perimeter of the blocking body; a second removable portion, wherein the second removable portion comprises the first removable portion, and wherein, with the first removable portion having been removed, what remains of the second portion comprises a whole perimeter of that which remains of the blocking body; and a third removable portion, wherein the third removable portion comprises a portion but not a whole of a perimeter of the blocking body. (FIG. 2 most clearly shows an example of this, with example portion 20*a* comprising example portion 26*a*1, and wherein, with example portion 26*a*1 having been removed, what remains of the second portion comprises a whole perimeter of that which remains of the blocking body. (and also comprising example portion 26*b*, which is an example of a removable portion that comprises a portion (but not a whole) of a perimeter of the blocking body. (FIG. 2 is also an example of wherein the blocking body comprises a first removable portion that comprises a whole of a perimeter of the blocking body, a second removable portion, wherein the second removable portion is larger than the first removable portion, and comprises the first removable portion, and a third removable portion, wherein the third removable portion comprises a portion but not a whole of a perimeter of the blocking body. There is various disclosure in the present application, relating to removable portions that are of a predetermined shape. (Just to take several examples, example portions 26*a*1, 26*a*, and 26*b*, for example, are all examples of a removable portion of a predetermined shape. (Example portions 31*b* in FIG. 15, for example, are also examples of a removable portion that is of a predetermined shape). These are just several examples, taken simply by way of example only). The blocking body may comprise a separation 69 that travels from a perimeter of the blocking body, inwards. (Various disclosure has been provided, in the present application, relating to a separation that travels from a perimeter of the blocking body, inwards). (According to this aspect, the removable portion(s) gain all the benefit from any disclosure in the present application, (relating to removable portion(s)), and may draw from any such disclosure). (It should be stated, the example portions 31*b* in FIG. 15, (together), are an example of a portion that comprises a whole perimeter of the blocking body. This is an example of wherein the portion that comprises a whole perimeter of the blocking body itself comprises portions, (may be referred to as 'sub-portions'). (Similarly, with example portions 31*b*1, in FIG. 16, having been removed, example portions 31*b*2, (together), are an example of a portion that comprises a whole perimeter of 'that which remains' of the blocking body, (with example portions 31*b*1 having been removed).

In Use

An example(s) will now be described in use, described by way of example only, referring to a particularly preferred embodiment(s), (and most particularly to a preferred embodiment(s) as shown in the Figures), in no way limiting a scope of the invention. (Note: Step(s) are not necessarily provided in chronological order, (even if words such as 'then', or 'now', or 'after this' (or the like) are used), and, within reason, may be carried out in any order that is fitting/appropriate).

Thus, referring in use (by way of example) to a particularly preferred example, preferably the user starts by tidying the hole in the wall (eg removing any debris, etc or anything sticking out of the hole), (where the front blocking element and/or back blocking element is going to go).

Then the user may adjudge whether any removable portions 26 of the back blocking element should be removed. (ie If the hole is significantly smaller than the back blocking element such that either portions 26*a*1, or portions 26*a*1 and 26*a*2 should be removed. (Removing of the portions can be important, in such cases, to help get the back blocking element through the hole in the wall). If the back blocking element is too big for the hole to be repaired, the user may use break arrangement 31*a*1, to remove portion 26*a*1. If the back blocking element is still too big, the user may even then use break arrangement 31*a*1, to remove portion 26*a*1. (Alternatively, if the user adjudges they need both portions 26*a*1 and 26*a*2 removed, they may simply use break arrangement 31*a*2, which would remove both on them, together).

If the user adjudges it is appropriate, (eg if the hole in the wall is very close to a wall stud, for example), the user may remove example portion 26*b*, by using break arrangement 31*b*. In such a situation, this can be extremely important and/or useful, so the stud (or any relevant obstruction) does not block the back blocking element from getting into the correct position, to block the hole in the wall, (behind the wall).

If not already done, the user can then put the connecting element through the example aperture 21, to position the connecting element, so that it extends from the back blocking element. (In the example embodiment of FIG. 12, it can be seen that the example connecting element has been threaded through the example aperture 21 of the back blocking element).

The user can now position the back blocking element, (using the slit), to have a portion of the back blocking element (on one side of the slit) being in front of the hole in the wall, and a portion of the back blocking element (on the other side of the slit) being behind the hole in the wall. Thus it can be put in a type of 'straddling' position, where it is straddling the wall, (via use of the slit, (which is an example of a separation in the back blocking element)). Now the user rotates the back blocking element, which, (due to the straddling position), allows the user to get the back blocking element behind the hole in the wall. (Thus it can now block the hole in the wall, behind the hole in the wall).

The user now feeds the connecting element through the input aperture of the front blocking element, and gets the front blocking element in position. Pulling the connecting element, (to get the front blocking element and the back blocking element tight to the wall, the user now uses the blocking arrangement, to secure the connecting element in the desired position, thus maintaining the tightness of the front blocking element and the back blocking element to the wall.

If not already done, the user now adds water, (eg tap water), into the water area 40*b* of the filler agent container. Preferably the water area is then closed. If not already done, the seal/barrier between the water area and the filler base agent area can then be broken, thus allowing for the water and the filler base agent, (eg powder), to be mixed. In this way, the user creates the filler agent that is dryable from a non-solid state, to a solid state. (Preferably the filler agent, having been mixed, if of a paste-like consistency).

The user now screws the container into the input aperture of the front blocking element. Now the user squeezes the container, thus filling the hole in the wall with the filler agent, between the front blocking element and the back blocking element. Once the hole is filled, the user removes the container, (by unscrewing it from the input aperture).

The filler agent is then left to set. Thus it is left, to dry into a solid state. In approximately 15 to 20 minutes, for example, (or however long it takes to set, for example), (or at any later point that the user chooses), the user releases the connecting element from the blocking arrangement.

The user then removes the front blocking element. The raised portion of the front blocking element can be useful, to help get leverage, (ie by getting a digit(s) underneath the raised portion), to remove the front blocking element from the wall.

If not already done, preferably the user then pulls the connecting element, to break it. (This could be done before removing the front blocking element from the wall. This tends to remove any portion of the connecting element that is protruding from the filler agent. If not, (and if the connecting element protrudes from the filler agent at all, (or enough to be in any way problematic), the user may take any action necessary to remove any portion of the connecting element that is deemed to be protruding to an extend that requires removal. ((Some of the connecting element(s), (eg a portion of the elongate body, for example), may remain. In the example embodiment in the Figures, feature 23 of the connecting element remains, and this most likely leads to a portion of the elongate body of the example connecting element remaining, as well. (However, the connecting element will tend to break at a point such that none of it protrudes through the wall repair)).

The front blocking element can then be used, preferably, as a 'smoother', for smoothing the surface of the filler agent, (and thus for smoothing the wall repair). Thus it is preferably used as a spatula-type tool, (for smoothing). Thus the filler agent, (and thus the wall repair), may be smoothed. (Note: This may be most possible if the user returns fairly quickly to the wall repair. If they return later, the filler agent may have dried to such an extent that it is harder (or not possible) to affect it, (eg 'smooth' it, for example). It is feasible no more filler agent is needed to achieve this. If further filler agent is needed, there may (or may not) be some that remains in the filler agent container that has been used, (that has not already dried to an extent that it cannot be used). If no (usable) filler agent remains in the container, and more is needed, either a new such filler agent container can be used, or any other filler agent, (from any other container). (Thus a totally different filler agent could feasibly be used).

Thus an example has been described, in use.

It should be stated, once again, that the example(s) described, in use, is/are described simply by way of example only, referring to a particularly preferred embodiment(s), and in no way limiting a scope of the invention.

Broadly speaking, then, there is provided a method of repairing a hole in the wall, comprising: positioning a back blocking element in a position where it blocks the hole in the wall, behind the hole in the wall; positioning a front blocking element in a position where it blocks the hole in the wall, in front of the hole in the wall; inputting filler agent that is dryable from a non-solid state to a solid state, into the hole in the wall; the filler agent drying into the solid state; and removing the front blocking element.

(Note: The front blocking element may be removed once the filler agent is in a 100% (ie 'fully') dried state, or when the filler agent is 'sufficiently' dried. As will be explored, removing the front blocking element when the filler agent has 'sufficiently' dried, (but is not 100% (ie 'fully') dried), may have benefits, (eg in terms of removing excess filler agent and/or 'smoothing' the filler agent, (and thus the repair).

Preferably the method comprises connecting the back blocking element and the front blocking element, with a connecting element.

Preferably the method comprises positioning a connecting element so that a portion of the connecting element is held behind a portion of the connecting element. (Whilst this is shown by virtue of use of a separation in the blocking element (that runs from a perimeter of the back blocking element), (ie the example slit 24, shown most clearly in FIG. 2), other options and/or embodiments are possible. For example, a portion of the connecting element, (such as example portion 23 in FIG. 5, for example), could go through an aperture of the back blocking element, (eg much like how a button goes through a button hole), and then be held behind the aperture, (just like a button is held behind the button hole). Thus various options and/or embodiments are possible, and various options and/or embodiments are possible for the back blocking element comprising an aperture, behind which a portion of the connecting element is held. (And it should also be stated, an aperture behind which a portion of the connecting element is held need not necessarily go through the whole of the back blocking element—for example, such an aperture may only partially go through the back blocking element, and the portion of the connecting element that is held behind it may feasibly then be held 'within' the back blocking element. Thus various options and/or embodiments are possible). (And it is even possible that the connecting element is attached to the back blocking element, in front of the blocking body of the back blocking element. For example, the back blocking element may have an attachment feature, (such as an openable and closable ring, for example), via which the connecting element can be attached. Thus various options and/or embodiments are possible). (And it should also be stated, it is feasible embodiments may be provided wherein a portion or a whole of the connecting element is formed as one part with a portion or a whole of the blocking element. Thus various options and/or embodiments are possible, and various ways of there being a connecting element that extends from the back blocking element are possible). (It is even technically feasible that a connecting element could extend from the front blocking element, and then be connected to the back blocking element. (eg An elastic embodiment, (for example), of a connecting element could feasibly be provided. (An elastic embodiment of a connecting element could be provided, whether the connecting element extends from the front blocking element, (and is then connected to the back blocking element), or whether the connecting element extends from the back blocking element, (and is then connected to the front blocking element)). Thus whilst much disclosure is provided of a connecting element that extends from the back blocking element (and then connects to the front blocking element), if a connecting element extends from the front blocking element (and then connects to the back blocking element), that is nevertheless an example of, (and thus within a scope of), a connecting element that connects the front blocking element and the back blocking element together.

(In the example embodiment(s) in the Figures, the connecting element is held, (with regard to the back blocking element), in a central position. (In other embodiments, the connecting may, or may not, extend from the back blocking element, in a central position, (with regard to the back blocking element)).

It should be made clear, it is possible there could be a hole in a wall that acts as a partition wall between rooms, where both sides of the wall are easily accessible. In such a case, (either via a second person holding the back blocking element in place, or, if the back blocking element is adhesive, for example, and can adhere to the wall, via adhering the back blocking element in place, (which may thus not even need a second person to achieve)), there may be no need to get the back blocking element 'through' the hole in the wall, (to get it to a position where it blocks the hole in the wall, 'behind' the hole in the wall). (Note: In such an example, where both side of the wall the hole is in are (easily) accessible, either side may be seen as the 'back' of the wall, (with the other side then being seen as the 'front' of the wall). It will be apparent then, that either side may be used to position the back blocking element 'behind' the hole in the wall, (with the front blocking element then blocking the hole on the other side).

However, in most cases, the back of a wall is not accessible. Thus, preferably the method comprises getting the back blocking element through the hole in the wall. This is preferably achieved via the back blocking element comprising a separation, (that runs from a perimeter of the back blocking element), and positioning a portion that is on one side of the separation through the hole in the wall, positioning a portion that is on the other side of the separation at a front side of the hole. (See the example in FIG. 12, where example portion 202 (on one side of the example separation, (which is (and thus comprise) example slit 24, in the example)), is positioned through the hole, and example portion 201 (on the other side of the example separation), is positioned at a front side of the hole, (and extending beyond the perimeter of the hole). The back blocking element is then rotated. Thus the back blocking element can be rotated, through the hole in the wall. Thus it can then be positioned in a position where it blocks the hole in the wall, behind the hole in the wall. Thus the method preferably comprises rotating the back blocking element, to get the back blocking element through the hole in the wall.

(Preferably the connecting element is held by the user, whilst the back blocking element is got through the hole, (whether it be via this rotation method, or any other way of getting it through the hole). This (ie holding on to the connecting element) can be useful, to make sure the back blocking element does not fall through the hole in the wall, (and possibly get lost), and/or to help keep/get the back blocking element in position, behind the hole in the wall).

Preferably the method comprises the connecting element going through an input aperture of the front blocking element.

Preferably the method comprises tightening the front blocking element and the back blocking element to the wall, via use of the connecting element. (In the example, (best shown in FIG. 6), this is achieved by way of a blocking arrangement).

Preferably the method comprises attaching a container that contains the filler agent, (dryable from a non-solid state into a solid state), into a filling position, (to facilitate inputting filler agent into the hole in the wall). Most preferably, the method comprises screwing an outputting portion of the container into an input aperture of the front blocking element.

Preferably the method comprises outputting filler agent (that is dryable from a non-solid state into a solid state) from the container, via squeezing the container. (Thus preferably the container can be squeezed, to facilitate outputting of the filler agent out of the container, and into the hole in the wall). As stated, the example embodiment of a container is provided by way of example only. In other embodiments, the container may be more of a bag-type container. Thus the 'bag' could be squeezed, to output filler agent, into the hole in the wall. (Note: A bag-type container may still be afforded any of the feature(s) shown and/or disclosed in the present application, (eg to the example embodiment(s) of a container in the Figures, for example). Thus, even if the container comprises/is a 'bag', it may be similarly screwable to the front blocking element, (as best shown/alluded to in FIGS. 6 (and 7 to 9), for example). Thus it may comprise a similar (protruding) outputting portion, for example, even in a 'bag-type' embodiment).

In various embodiments, the container may be made out of plastic. However, various options and/or embodiments are possible, and various material(s) may be possible, not limited to plastic).

Preferably a filler base agent is provided, to which water can be added, to form the filler agent that is dryable from a non-solid state into a solid state. The filler base agent may, for example, be a powder. (For the sake of the present application, a filler base agent is considered an embodiment of a filler agent, (and thus to be within the scope of the term 'filler agent').

Preferably, the container comprises an area for the filler base agent, and an area for water. Preferably the container comprises a barrier between the area for the filler base agent, and the area for water. Preferably the barrier can be broken, (and is thus a breakable barrier). Thus, once broken, the filler base agent and the water can mix, (to form a filler agent that is dryable from a non-solid state into a solid state). Preferably the filler base agent is provided in the container. (Most preferably, the filler base agent is provided in the container, in the area for the filler base agent, (and there being an area for water, and a breakable barrier, etc. Preferably water is not provided in the water area, (so that the user can add the water themselves, (eg tap water). However, it is feasible water is provided in the area (of the container) for water. However, it should be stated, it is feasible filler base agent is provided separately, (not in a container for use in filling the hole in the wall). It should also be stated, it is feasible filler base agent is provided in the container, but without the container having a separate area for water; for example, the container could simply contain filler base agent, and then allow for water to be added to it. (Such filler base agent could be provided in the container (for use in filling the hole in the wall), or may not be; for example, it could be provided in a different container, (eg a bag), thus requiring it to be added to the container, (by the user). Rather than there being a separate area for water, (or in combination with it), there may be an indicating means, (such as a line(s), or any mark(s), for example), to denote to the user how much water to add to the filler base agent. (The (or any) indicating means may be provided on an inside and/or on an outside of the (or any) container). (It should also simply be stated that the container may be provided, already container a filler agent that is dryable from a non-solid state into a solid state, (without requiring mixing by the user). However, preferably mixing (of filler base agent and water) is required by the user. (It should also be stated, it is technically possible a container could be provided with a water area and a filler base agent area, but without a breakable barrier. For example, as how some yoghurts come in a container that has an area for (more generally neutral tasting) yoghurt, and then an area for an extra foodstuff, (such as strawberry concentrate, or chocolate pieces, etc), and the yoghurt is intended to be used by the user removing a top off the container, (the top often being a thin metallic paper-type covering), and then mixing the extra foodstuff, (eg strawberry concentrate, or chocolate pieces, etc) with the more neutral tasting yoghurt, (either by simply moving the extra foodstuff into the section (ie area) where the more neutral tasting yoghurt is, and/or by 'folding' the container, to thus move the extra foodstuff into the section (ie area) where the more neutral tasting yoghurt, (and then possibly 'mix' the more neutral tasting yoghurt and the extra foodstuff together), so such a similar or same solution could feasibly be provided for mixing water with a filler base agent. In such a way, (in the example, with the example 'top' (eg sheath) removed), there need not be a 'breakable barrier' between the water area and the filler base agent. Thus a container may be provided, comprising a water area, and a filler base agent area, (but not limited to comprising a breakable barrier that separates the water area, and the filler base agent area). (In all embodiments defined as comprising a 'water area', the water may, or may not, initially be provided. If the water is not initially provided, it will be apparent that the user can add water, (eg tap water) into the water area. (This may be preferable, to keep the weight of the container as low as possible, when initially provided). Thus various options and/or embodiments are possible).

In all embodiments of a container where water (eg tap water) must be added, preferably there is provided an annotation(s) to denote to a user how much water should be added. (Note: There being provided an annotation(s), to denote to a user how much water should be added, is not limited to embodiments of a container that comprise a water area and a filler base agent area. For example, a container could be provided wherein water is added to the filler base agent, without there being separate areas for the water and the filler base agent. Nevertheless, there may still be provided an annotation(s) to denote to a user how much water should be added. The annotation(s) may be as simple as a line, for example, to denote where to fill to. (The annotation (s) may comprise word(s) such as 'filler to here', (or the like)). (It should also be stated, whilst it is preferred that the filler base agent is provided in the container that is used for filling the hole in the wall, it is feasible the/a filler base agent could be provided in a separate container, and that the filler base agent must then be added to the container. (In such case, there may feasibly be an annotation(s) to denote to a user how much filler base agent should be added). Thus various options and/or embodiments are possible, and, (unless stated otherwise, any such options may be provided for a container that has a water area and a filler base agent area, or for a container that does not have a separate water area and filler agent base area. (It should be noted, a container may comprise an annotation(s) to denote to a user how much filler base agent should be added and/or an annotation(s) to denote to a user how much water should be added, whether the container comprises a separate water area and filler base agent area, or not).

In the example embodiment in the Figures, the user opens the area for water. (This is done, in the example, by taking an example top off the container). In the example, the user then inputs water into the area for water. In the example, the user then breaks an example breakable barrier. In the example, the user then mixes the filler base agent and the water.

Thus the method preferably comprises adding water (eg tap water) to the area of the container for water, breaking the breakable barrier between the water area and the filler base agent area, and mixing the water and the filler base agent area, (to create a filler agent that is dryable from a non-solid state into a solid state).

Preferably the user removes the front blocking element when the dryable filler agent has dried into a solid state, but is not 100% dry yet. This allows the user to potentially make adjustment(s) to the filler agent that is filling the hole, (such as removing of excess filler agent, and/or 'smoothing' the filler agent). Preferably a portion or a whole of the connecting element is removed. (In the example, this is done via pulling the connecting element, (strongly), which, in the example, results in the connecting element breaking). In other examples, it is technically feasible that a whole of the connecting element may be removed. However, this may be counter-productive, as it may lead to a larger hole being created in the filler agent, when removing the connecting element. (Furthermore, in the example shown in the drawings, only a portion of the connecting element breaks off when removed, (as long as the filler agent is adequately dried), due to the connecting element, (in particular, feature 23 of the connecting element), being held behind the back blocking element. However, as previously stated, the example shown is just one example of how a connecting element may extend from the back blocking element, and various options and/or embodiments are possible. It is feasible an embodiment can be provided where the whole connecting element could be removed). Preferably the front blocking element has a straight edge(s), (ie a portion(s) 55 of a perimeter of the front blocking element that is straight, (rather than curved, for example). (An example of this is example portion 55, best shown in FIG. 1 and FIG. 4. Thus the method preferably comprises, (after having removed the front blocking element), using the front blocking element to remove excess filler agent and/or to smooth the filler agent. (Most preferably one or both of these, (ie removing excess filler agent and/or to smooth the filler) are done with a portion of the perimeter of the front blocking element that is straight. This is helpful in getting the wall repair to look as good as possible. (It may sometimes even be important in completing the wall repair fully, if there are any (minor) gap(s) in the filler agent, for example). (It should, however, be stated, that removing excess filler agent and/or smoothing the filler agent may be done, without the front blocking element, (eg with a different tool(s)/equipment and/with a hand/digit(s), (ie finger(s), thumb(s), etc), for example)). (Note: In the example embodiments (and various other embodiments, for example), the user releases the connecting element (from the front blocking element), before the front blocking element is removed from the wall. Thus, in the example embodiment(s) in the drawings, the user releases the example connecting element from the example blocking arrangement, (which is an example of a holding arrangement, to hold the connecting element in a (desired) position), before removing the front blocking element from the wall).

Preferably a portion or a whole of the connecting element is removed. (Preferably this is done after the front blocking element is removed, (and before any smoothing and/or removing of any excess filler agent is done). Thus a good time to do this is when the filler agent has (sufficiently) dried, after the front blocking element is removed. (However, in various embodiments, is may be possible to remove a portion or a whole of the connecting element before the front blocking element is removed). Preferably the portion or the whole of the connecting element is removed by ripping it out. Thus, once the filler agent is sufficiently dried, the portion or the whole of the connecting element may be ripped out by the user. (This, broadly speaking, (if it is a portion of the connecting element that is removed), is an example of a portion of the connecting element being broken off, (by the user). This can be important, so that none of the connecting element protrudes out of the filler agent. If any hole/mark is made by this, 'smoothing' may be done by the user. (New filler agent may be used, for this, (or for any other reason(s)), and/or, if the filler agent used to repair the hole is sufficiently dry, (bit not 100% dried), it may be possible to smooth any mark with the same filler agent used to fill the hole.

It is feasible no more filler agent is needed to smooth and/or complete the repair. If further filler agent is needed, the user may use more of the same filler agent. (For example, they may use a new container, for example, and add water, (if the filler agent that is dryable from a non-solid to a solid state is provided by way of a filler base agent, to which water must be added). (Note: If such a filler agent is used, (ie derived from a filler base agent to which water must be added), it is unlikely the user can use any filler agent (agent that is dryable from a non-solid to a solid state) remaining in the same container of filler agent used to fill the hole, because such filler agent will more than likely be dried by this point, to an extend that it cannot be used. However, if any such filler agent can still be used, (which is not already dried at this point, to an extent that it cannot be used), then it is feasible this could be used, (ie from the same container of filler agent used to fill the hole). (Note: if any filler agent can be used from the same container, even if it is not already dried at this point, to an extent that it cannot be used, it may be dried enough that it cannot be outputted from the container via normal means, (eg, in the examples in the drawings, out through the example outputting portion). Thus, in such situations, user may feasibly take unusual action, (eg accessing the inside of the container, (eg via cutting the container open, (eg via use of scissors, or any sharp implement/tool)). Thus user, in such situation, may be able to use more filler agent, from the same container)). If the filler agent that is dryable from a non-solid to a solid state was provided by way of a container that already contained such a filler agent (ie that is dryable from a non-solid to a solid state), then they may use more of that, (either from a new container, or from the same container used, to fill the hole). Alternatively, (or in combination with any of these option(s)), the user may use a totally different filler agent. (For example, they may use a different, 'commercial' filler agent product, which, for example, is provided in a non solid state, (eg 'paste', for example), and is dryable into a solid state. Thus various options and/or embodiments are possible.

(Note: Smoothing and/or completing the repair is not limited to being done with the front blocking element. It may be done in any way. Any tool/implement, for example, may feasibly be used).

Thus an example has been described, in use. (It should be stated, once again, that the example(s) described, in use, is/are described simply by way of example only, referring to a particularly preferred embodiment(s), and in no way limiting a scope of the invention).

(As stated, the steps are not necessarily in chronological order, and, within reason, may be carried out (and/or may occur) in any order that is fitting/appropriate).

It should be stated, once again, that the example(s) described, in use, is/are described simply by way of example only, referring to a particularly preferred embodiment(s), and in no way limiting a scope of the invention.

The embodiments described above are provided by way of example only, and various other modifications will be apparent to persons skilled in the art without departing from the scope of the invention as defined in the appended claims.

The invention claimed is:

1. A wall repair kit, comprising:

a back blocking element, for blocking a hole in a wall, behind the hole in the wall;

a front blocking element, for blocking the hole in the wall, in front of the hole in the wall; and a connecting element, to connect the back blocking element and the front blocking element;

a filler agent, for filling the hole in the wall; and a container, to contain the filler agent, wherein the front blocking element comprises an input aperture through the front blocking element, to facilitate inputting the filler agent into the hole in the wall, through the front blocking element;

wherein the wall repair kit is operable with the connecting element travelling through the input aperture and the container being in a filling position, simultaneously, wherein, in the filling position, an output aperture of the container, out of which the filler agent is outputted from the container, is engaged with the input aperture of the front blocking element.

2. A wall repair kit as claimed in claim 1, wherein, in the filling position, the output aperture of the container is received into the input aperture of the front blocking element.

3. A wall repair kit as claimed in claim 2, wherein the container is removably attachable to the front blocking element, into the filling position.

4. A wall repair kit as claimed in claim 1, wherein the wall repair kit is operable with the connecting element travelling through the input aperture, to a side of the output aperture of the container, when the container is in the filling position.

5. A wall repair kit as claimed in claim 4, wherein the container is removably attachable to the front blocking element, into the filling position.

6. A wall repair kit as claimed in claim 1, wherein the container is removably attachable to the front blocking element, into the filling position.

7. A wall repair kit as claimed in claim 1, wherein the input aperture of the front blocking element is the only input aperture that the front blocking element has, to facilitate inputting the filler agent into the hole in the wall.

8. A wall repair kit as claimed in claim 1, wherein, in use, the filler agent is dryable from a non-solid state to a solid state.

9. A wall repair kit as claimed in claim 1, wherein the front blocking element comprises a holding arrangement, to hold the connecting element.

10. A wall repair kit as claimed in claim 9, wherein a portion or a whole of the holding arrangement is provided within the input aperture.

11. A wall repair kit as claimed in claim 10, wherein the container is removably attachable to the front blocking element, into the filling position.

12. A wall repair kit as claimed in claim 9, wherein the container is removably attachable to the front blocking element, into the filling position.

13. A wall repair kit, comprising:

a back blocking element, for blocking a hole in a wall, behind the hole in the wall;

a front blocking element, for blocking the hole in the wall, in front of the hole in the wall; and a connecting element, to connect the back blocking element and the front blocking element;

wherein the front blocking element comprises:

an aperture through the front blocking element, through which the connecting element travels, to facilitate connecting the front blocking element and the back blocking element; and a blocking arrangement, to block a portion of the connecting element from moving backwards and thus hold the connecting element in position, wherein the blocking arrangement comprises an opening at its perimeter, to facilitate entry of the connecting element into the blocking arrangement;

and the connecting element comprises:

a plurality of portions along its length that are dimensioned to fit through the blocking arrangement; and a plurality of portions along its length that are dimensioned to be blocked by the blocking arrangement.

14. A wall repair kit as claimed in claim 13, wherein a portion or a whole of the blocking arrangement is provided within the aperture through the front blocking element, through which the connecting element travels.

15. A wall repair kit as claimed in claim 14, wherein the wall repair kit comprises:

a filler agent, for filling the hole in the wall; and a container, to contain the filler agent.

16. A wall repair kit as claimed in claim 15, wherein the aperture through the front blocking element, through which the connecting element travels, is an input aperture, to facilitate inputting filler agent into the hole in the wall, the wall repair kit being operable with the connecting element travelling through the input aperture of the front blocking element, and the container being in a filling position, to facilitate outputting the filler agent out of the container, into the hole in the wall, through the input aperture of the front blocking element, simultaneously.

17. A wall repair kit as claimed in claim 13, wherein the wall repair kit comprises:

a filler agent, for filling the hole in the wall; and a container, to contain the filler agent.

* * * * *